US009458614B2

(12) United States Patent
Muderlak et al.

(10) Patent No.: US 9,458,614 B2
(45) **Date of Patent: *Oct. 4, 2016**

(54) WATER CONSERVATION FIXTURE SYSTEM AND METHOD OF USE

(71) Applicant: Xela Innovations, LLC, Glendale, WI (US)

(72) Inventors: Todd J. Muderlak, Whitefish Bay, WI (US); Kenneth J. Muderlak, Milwaukee, WI (US)

(73) Assignee: XELA INNOVATIONS, LLC, Glendale, WI (US)

( * ) Notice: Subject to any disclaimer, the term of this patent is extended or adjusted under 35 U.S.C. 154(b) by 571 days.

This patent is subject to a terminal disclaimer.

(21) Appl. No.: 13/842,095

(22) Filed: Mar. 15, 2013

(65) Prior Publication Data

US 2014/0259349 A1 Sep. 18, 2014

(51) Int. Cl.
*E03D 13/00* (2006.01)
*E03D 5/02* (2006.01)

(52) U.S. Cl.
CPC ..... *E03D 5/026* (2013.01)

(58) Field of Classification Search
CPC . E03D 13/005; E03D 2201/20; E03D 9/002; E03D 9/005; E03D 9/007; E03D 9/032; E04H 4/1236; E04H 4/1272; F16K 35/06; F16K 35/08; F16K 35/10
USPC ..... 210/166, 167.1, 167.16; 4/222, 222.1, 4/223, 231–232, 249, 256.1, 286, 290, 4/292–294, 300.3, 301, 302–305, 309, 4/405, 415, 422, 504, 507, 661; D8/338, D8/346, 347; D23/261, 310; 137/383, 137/384.2, 385; 251/101, 107, 40, 90–93; 292/1, 256.6, 307 B, 336.3; 70/175–180, 18, 20, 201–203, 208, 70/209, 211, 212, 215, 232
See application file for complete search history.

(56) References Cited

U.S. PATENT DOCUMENTS 1,494,882 A * 5/1924 Barger ..... E03C 1/264 4/292
1,916,357 A * 7/1933 Brownstein ..... E03D 9/032 4/222.1

(Continued)

OTHER PUBLICATIONS

Hybrid H2O HL-28 Urinal; retrieved from url: https://www.sustainablerestroomproducts.com/products/featured-products/hybridh2o-hl-28-waterless-urinal; printed on May 14, 2014; 2 pages.

(Continued)

*Primary Examiner* — Paul R Durand
*Assistant Examiner* — Nicholas Ros
(74) *Attorney, Agent, or Firm* — Husch Blackwell LLP

(57) ABSTRACT

A water conservation fixture system comprises a handle lock assembly configured for placement on a handle of a fixture and at least one other structure selected from a fixture drain insert trap assembly, a fixture screen and combinations of both. The handle lock assembly comprises a top component and at least one locking arm pivotally attached to the top component, and the locking arm further comprising a locking element for releasably locking with a mating locking element on the top component. The fixture system may be integrated into existing fixture to significantly reduce or control water usage or otherwise convert the fixture to a low-water or no-water fixture without having to replace the current water-based fixture. The fixture system may also be integrated into new fixtures with corresponding mating features to optimize fit and function of the system with the new fixture.

18 Claims, 57 Drawing Sheets

(56) References Cited

U.S. PATENT DOCUMENTS

| | | | | |
|---|---|---|---|---|
| 4,134,162 | A * | 1/1979 | Sharland | E03C 1/264 4/292 |
| 4,134,570 | A | 1/1979 | Walker | |
| 4,210,309 | A | 7/1980 | Grenier | |
| 4,272,052 | A | 6/1981 | Gidner | |
| 4,868,931 | A | 9/1989 | Schneeweiss | |
| 5,024,303 | A | 6/1991 | Kosloff | |
| 5,033,280 | A * | 7/1991 | Johnson | E05B 13/001 70/178 |
| 5,359,866 | A * | 11/1994 | Boddy | F16B 2/10 24/270 |
| 5,394,715 | A | 3/1995 | Guerette | |
| 5,604,937 | A | 2/1997 | Davenport | |
| 5,711,037 | A | 1/1998 | Reichardt et al. | |
| 5,806,555 | A | 9/1998 | Magno, Jr. | |
| 6,089,054 | A * | 7/2000 | Stukas | A63C 11/005 70/18 |
| 6,286,153 | B1 | 9/2001 | Keller | |
| 6,698,035 | B1 | 3/2004 | Grueser | |
| 6,701,541 | B2 | 3/2004 | Romagna et al. | |
| 6,920,648 | B1 * | 7/2005 | Suski | E03D 13/00 4/222.1 |
| 6,959,723 | B2 | 11/2005 | Gorges | |
| 7,246,386 | B2 | 7/2007 | Hall | |
| 7,571,741 | B2 | 8/2009 | Higgins | |
| 7,636,957 | B2 | 12/2009 | Funari | |
| 7,900,288 | B2 | 3/2011 | Fima | |
| 8,231,865 | B2 | 7/2012 | Pliszka | |
| 8,234,723 | B2 | 8/2012 | Allen | |
| 8,291,522 | B2 | 10/2012 | Kueng | |
| 8,322,682 | B2 | 12/2012 | Maercovich | |
| 2007/0266486 | A1 * | 11/2007 | Ramirez | E03D 13/00 4/309 |
| 2012/0117719 | A1 | 5/2012 | Brooks | |
| 2012/0317707 | A1 | 12/2012 | Romero | |
| 2013/0031708 | A1 | 2/2013 | Sensel | |
| 2013/0199252 | A1 * | 8/2013 | Harder | F16L 35/00 70/57 |

OTHER PUBLICATIONS

Hybrid H2O featured products; retrieved from url: https://www.sustainablerestroomproducts.com/featured-products; printed on Jul. 24, 2013; 2 pages.

Hybrid H2O Waterless Urinal Replacement Cartridges; retrieved from url: https:// www.sustainablerestroomproducts.com/waterless-urinal-replacement-cartridges; printed on Jul. 24, 2013; 2 pages.

Hybrid H2O Waterless Urinal Accessories; retrieved from url: https://www.sustainablerestroomproducts.com/waterless-urinal-accessories; printed on Jul. 24, 2013; 2 pages.

Hybrid H2O "Waterless or Water . . . You Choose!" Specification Sheet; Apr. 2013; 2 pages.

* cited by examiner

WATER CONSERVATION FIXTURE SYSTEM AND METHOD OF USE

FIELD

Embodiments of this disclosure relate to plumbing fixture systems, and more specifically to a water-use reduction fixture system and method of using the same.

BACKGROUND

Water conservation is a major concern in many areas and is likely to become even more important in the future as populations increase resulting in more water consumption. Practicing water conversation on a regular basis has many benefits including saving money both in the short term and long term. In the short term, water conservation saves the consumer money by reducing a consumer's monthly water utility bill. In the long term, consumers save money by postponing, or even preventing, the building of new water supply infrastructures, thereby reducing the per unit cost (or slowing the increase in cost) of water. In addition, those in charge of water utilities have become increasing militant in the way they promulgate rules regulating water usage and imposing fines for violation thereof. The bathroom is one area where water is often needlessly used.

The largest daily user of water in the commercial establishments is the urinal and in homes is the toilet. The average urinal uses over 40,000 gallons of water per year! To further conserve water use, low water use urinals and no-water urinals have been devised. These no-water urinals are not flushed with water each time a person uses the urinal and, in fact, they are not equipped for flushing as they are not connected to a water supply. As the no-water urinal is repeatedly used, most urine is collected in a compartment of the urinal. An oily sealing liquid (some organic oils) that is immiscible with the urine and is lighter than the urine covers the collected urine. This oily sealing liquid floats on the surface of the urine, serving as a barrier that prevents odors from the urinal from escaping to the environment. Typically, such no-water urinals include a removable cartridge having a top with an opening in communication with the compartment holding an initial water charge that mixes with urine flowing into the compartment through the opening. A stand pipe type drain is in communication with the compartment that allows the compartment to be drained continually to a sewer or other waste disposal system as the compartment is filled with urine. Dry traps using mechanical valves or small p-traps are also used to prevent odor from escaped while still allowing urine and fluids to pass.

A disadvantage of these no-water urinals is that the urinals are specially designed to accept these removable cartridges. For an institution to convert from water-based urinals to no-water urinals requires the complete replacement of the existing water-based urinals. This can be an expensive and time-consuming process.

It is desirable to provide a plumbing fixture system which may be retrofit into existing fixtures such as urinals and toilets or provided with new fixtures and reduces water usage.

It is further desirable to provide a fixture system which reduces water usage by controlling or prohibiting flushing of a fixture, providing an improved trap and/or providing an improved fixture screen.

SUMMARY

In at least one embodiment, a fixture system is provided, the fixture system comprising a handle lock assembly configured for placement on a handle of a fixture. The handle lock assembly comprises a top component and at least one locking arm pivotally attached to the top component, and the locking arm further comprising a locking element for releasably locking with a mating locking element on the top component. The fixture system also includes at least one of a fixture drain insert with trap and an adjustable fixture screen.

In at least another embodiment, a fixture system is provided which comprises a handle lock assembly, a fixture drain insert with trap, and a fixture screen.

In at least another embodiment, a fixture system is provided which comprises a handle lock assembly and a fixture drain insert trap configured to install in an existing fixture drain. In at least another embodiment, a fixture system is provided which comprises a handle lock assembly and an adjustable fixture screen.

BRIEF DESCRIPTION OF THE DRAWINGS

Preferred embodiments of the disclosure are described below with reference to the following accompanying drawings, which are for illustrative purposes only. Throughout the following views, the reference numerals will be used in the drawings, and the same reference numerals will be used throughout the several views and in the description to indicate the same or like parts.

DETAILED DESCRIPTION

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible.

As used herein, the term "fixture," whether used alone or in the phrase "fixture system" refers to a fixture which may be operatively connected to a drain or other plumbing system, including, but not limited to, urinals, sinks and toilets. Fixtures include low-water and no-water fixtures, as well as plumbing fixtures.

Figure 1:
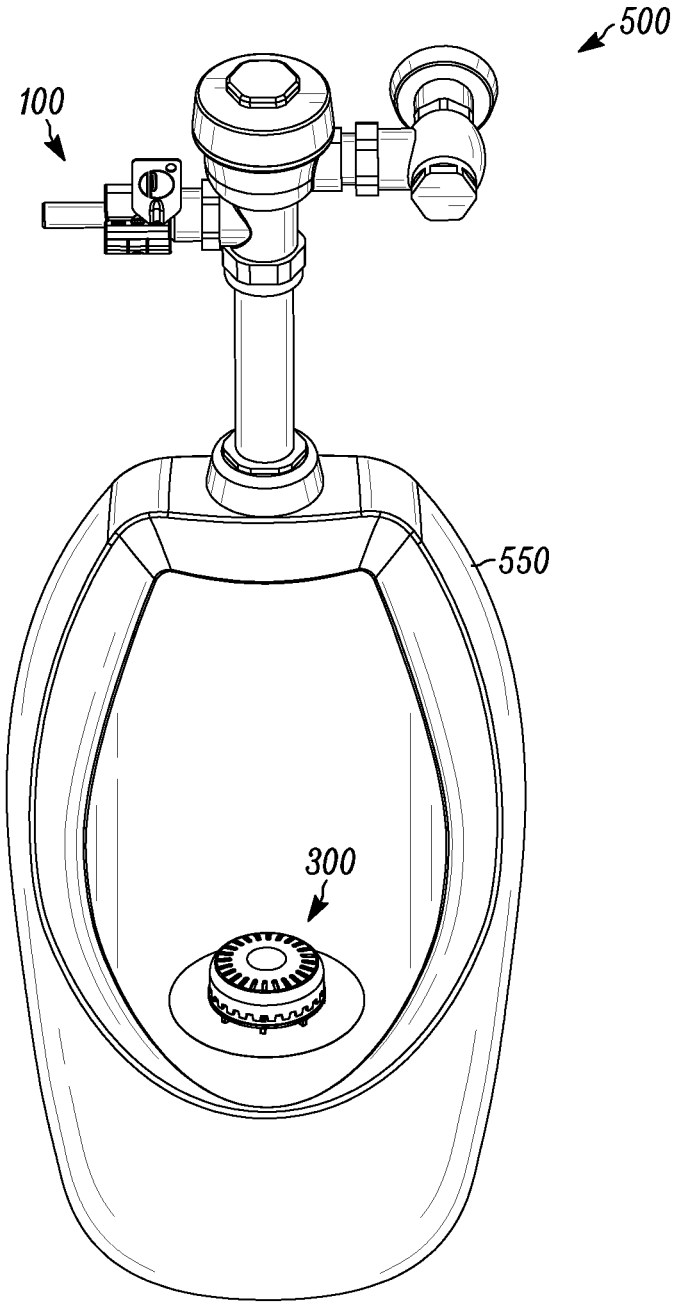
FIG. 1 illustrates an exemplary fixture system installed in a wall mounted urinal.
Figure 2:
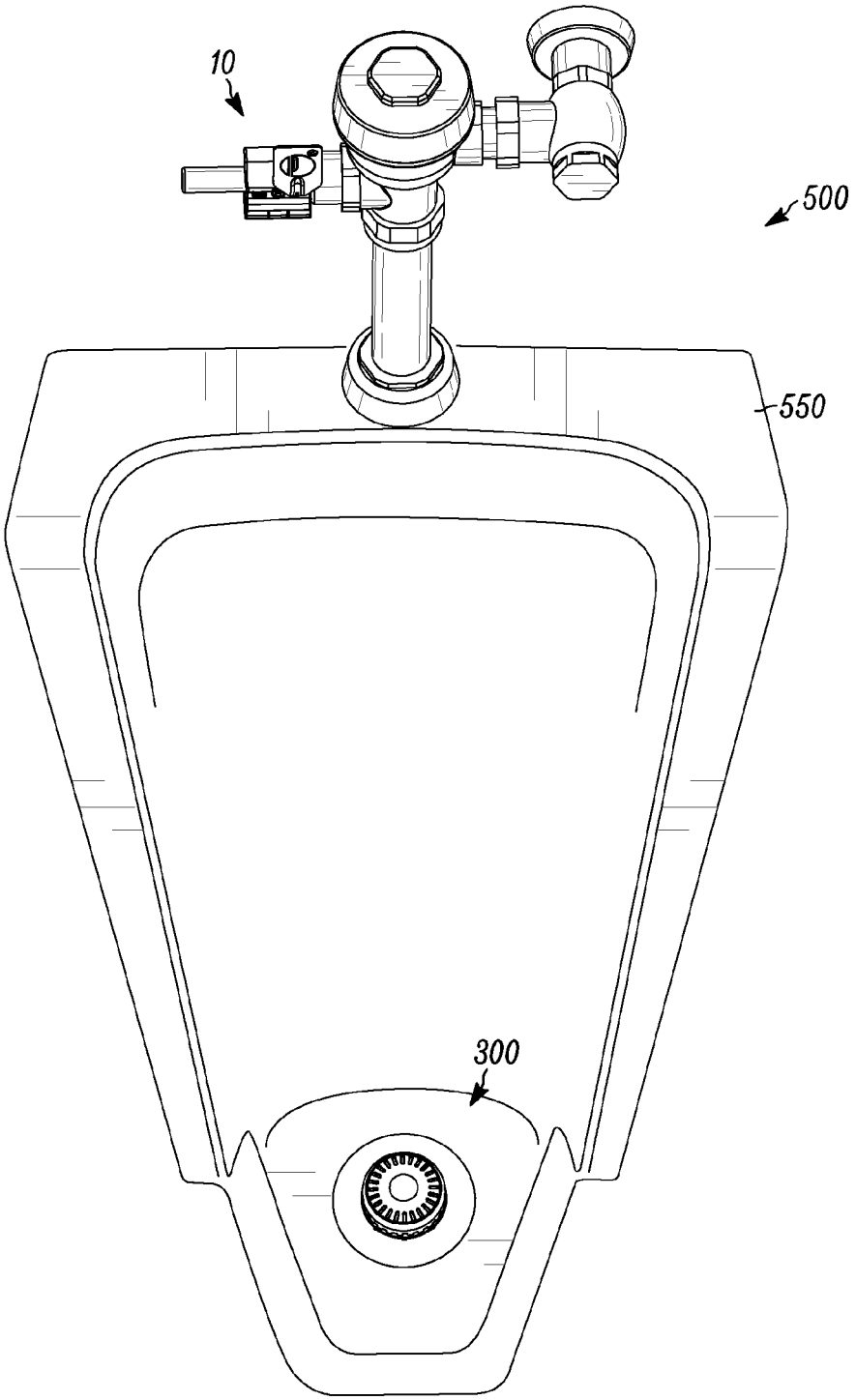
FIG. 2 illustrates an exemplary fixture system installed in a floor mounted urinal.

The description and figures disclose an exemplary fixture system and method of use. FIGS. 1 and 2 illustrate an exemplary fixture system 500 installed on a wall mounted urinal 550 and a floor mounted urinal 550, respectively. It is to be understood, however, that fixture system may be installed in any fixture. In the exemplary embodiments shown, fixture system 500 includes handle lock assembly 100 and fixture drain insert assembly 300. In further embodiments, fixture system 500 may include only one of these, or may include, in addition, an adjustable fixture screen system, as described below.

Handle Lock Assembly

An embodiment of a handle lock assembly 100 according to the disclosure is described with reference to FIGS. 3-16. In one embodiment, the handle lock assembly can be installed on any type and size of handle. In another embodiment, the handle lock assembly can be installed on a left or right handle installation. In yet another embodiment, the handle lock assembly can be mounted on an already installed urinal or toile valve handle.

Figure 3:
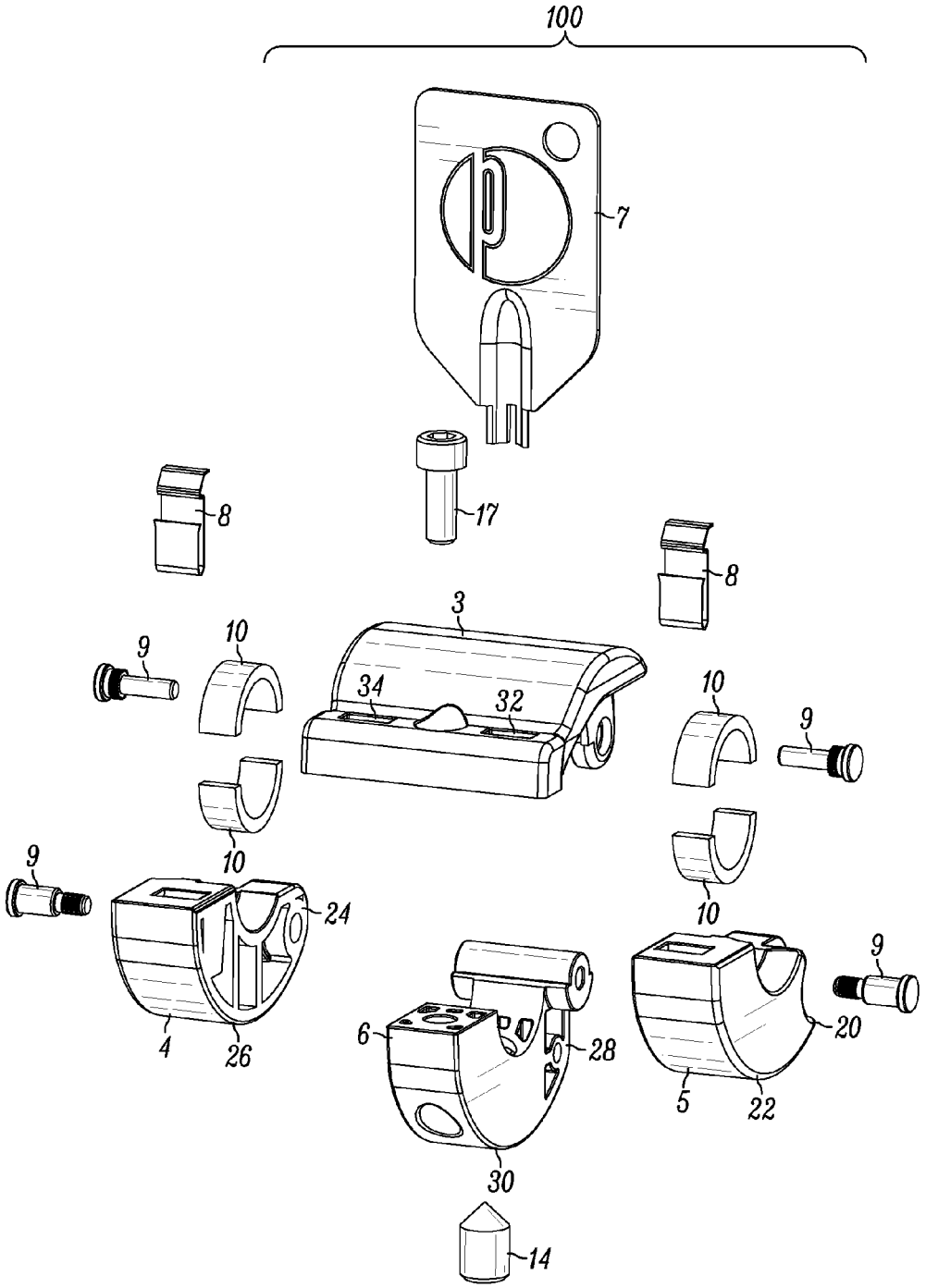
FIG. 3 is a front view of a disassembled handle lock assembly with associated parts.

Referring to FIG. 3, an exploded view of the handle lock assembly 100 is provided. The handle lock assembly 100 comprises a top component 3 having an arcuate inner surface and first and second ends. The handle lock assembly 100 also comprises a bottom component comprising first 4 and second arm 5 sections and a center support section 6 situated between the first 4 and second 5 arm sections. The first 4 and second 5 arm sections, as well as the center support section 6 of the bottom component each have an arcuate inner surface and first 20, 24, and 28 and second ends 22, 26, and 30.

The first ends of the first 4 and second 5 arm sections, and the center support section 6 are pivotally connected to the first end of the top component 3. The first 4 and second 5 arm sections comprise a hinge of the release arm 9 so that the arms can rotate about the hinge (as shown in a downward direction) to create a clearance when a flush is desired.

Each of the second ends of the first 4 and second 5 arm sections have a locking element 8 for releasably locking with a mating locking element on the second end of the top component 3. A lock spring 8 holds the first 4 and second 5 arm sections locked in place.

The second end of the center support section 6 is rigidly connected to the second end of the top component 3. A set screw 14 can be used to tightly mount the handle lock to the handle. A screw 17 can be used to tighten the top component 3 to the center support section 6.

The top component 3 contains a receiving slot or aperture 32, 34 for a release key 7 for flushing. The release key 7 is inserted into the receiving slot or aperture of the top component 3, and pushes in the lock spring 8, thereby causing the first 4 or second 5 arm sections to rotate down and create a clearance so a flush can be achieved.

The handle lock assembly can be installed on any handle of any size. Rubber shims 10 are used to ensure the handle lock assembly is securely affixed to the handle. The number of rubber shims 10 used depends on the thickness of the handle. For example, a thinner handle will likely require more rubber shims 10 to ensure a secure fit to the handle.

The handle lock assembly can be made from any material known in the art, including, but not limited, plastic, metal and combinations thereof. In further embodiments, the handle lock assembly may be treated, such as with an antibacterial/antimicrobial coating, to protect the handle lock assembly.

Figure 4:
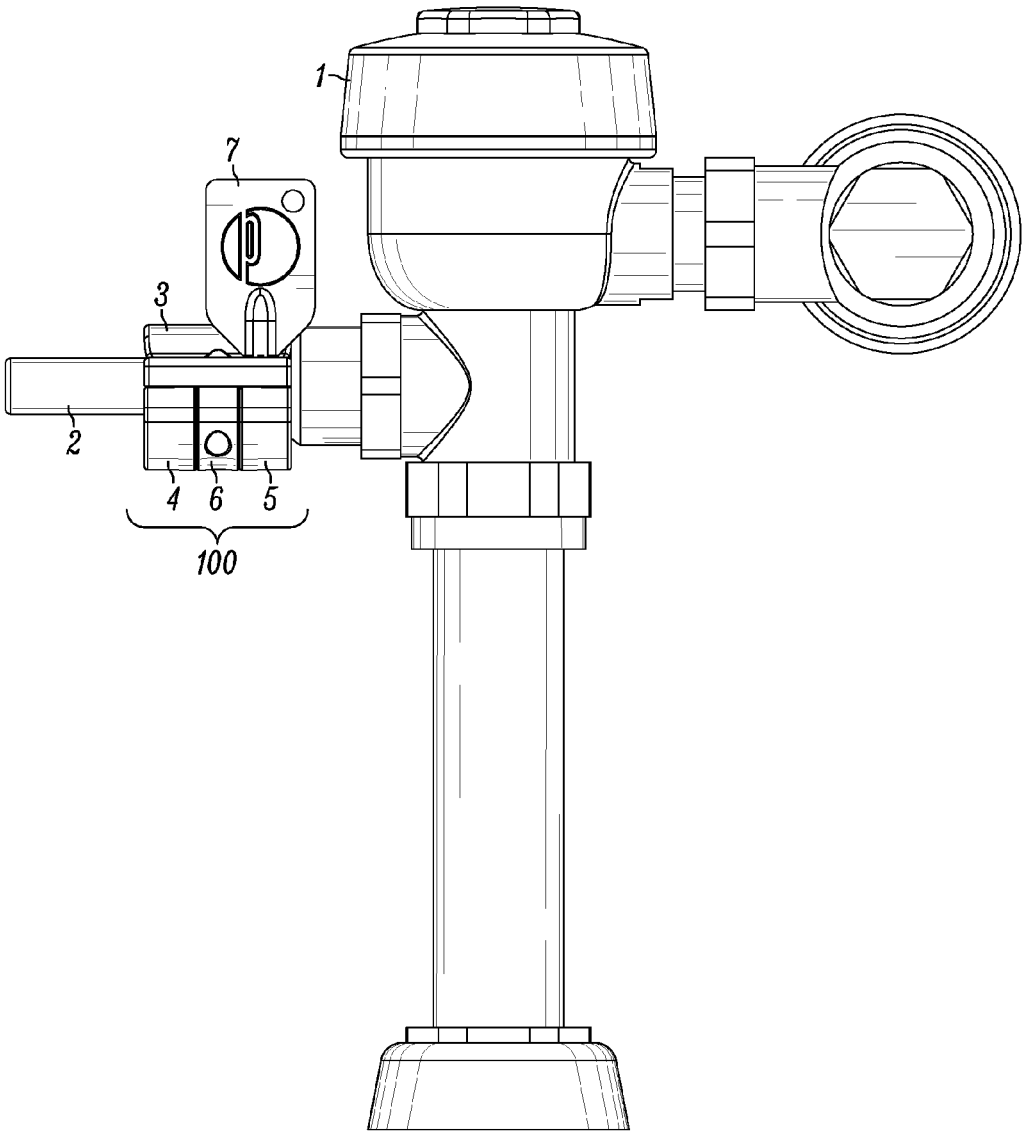
FIG. 4 is a front view of an assembled handle lock assembly on a left hand installation.

FIG. 4 depicts a representative example of a handle lock assembly 100 on a left handle 2 installation. The handle lock assembly is used to lock the flush valve 1 on this particular flush valve system. The handle lock assembly slides over the handle and when locked prevents flushing.

As shown in FIG. 4, the first 4 and second 5 arm sections are separated by the center support 6. The center support section 6 secures the handle assembly 100 to the handle 2. The release key 7 is inserted into a receiving slot in the top component 3 of the handle assembly.

Figure 5:
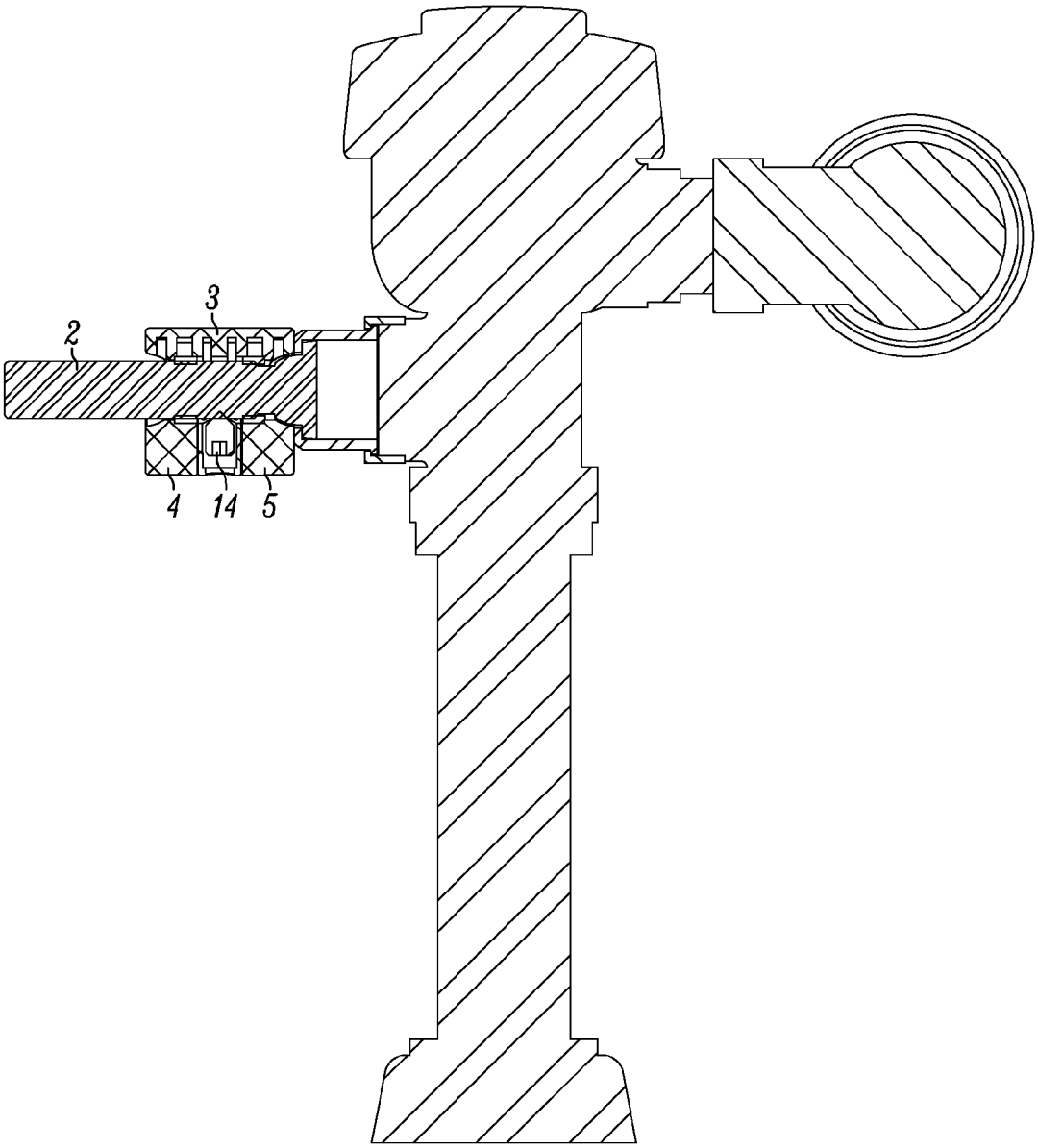
FIG. 5 is a cross-sectional view of FIG. 4.
Figure 6:
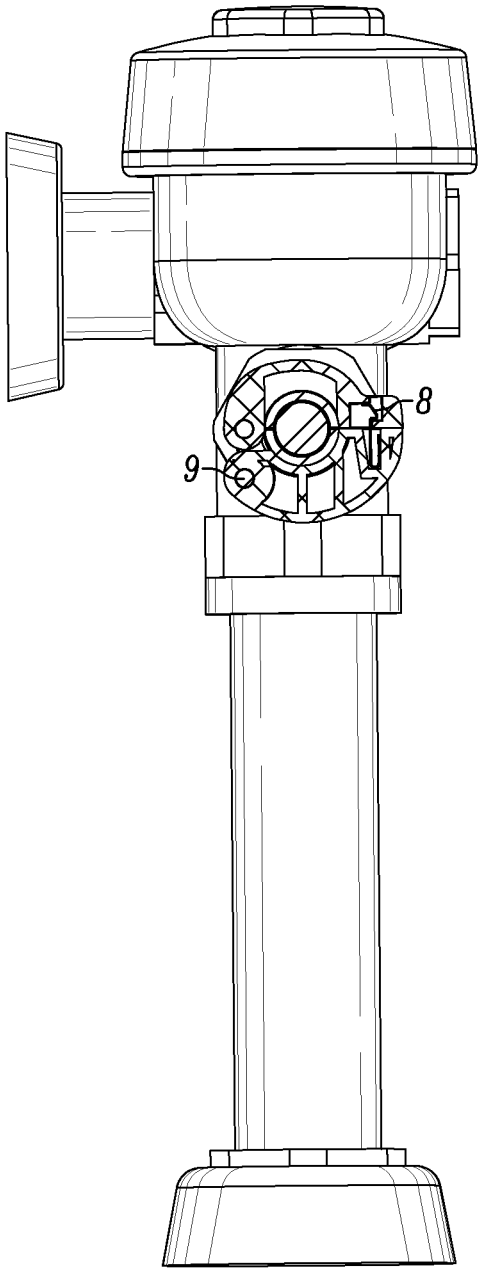
FIG. 6 is a cross-sectional view of a handle lock assembly on a handle depicting the lock spring and the hinge release arm of the first and second arm sections.
Figure 7:
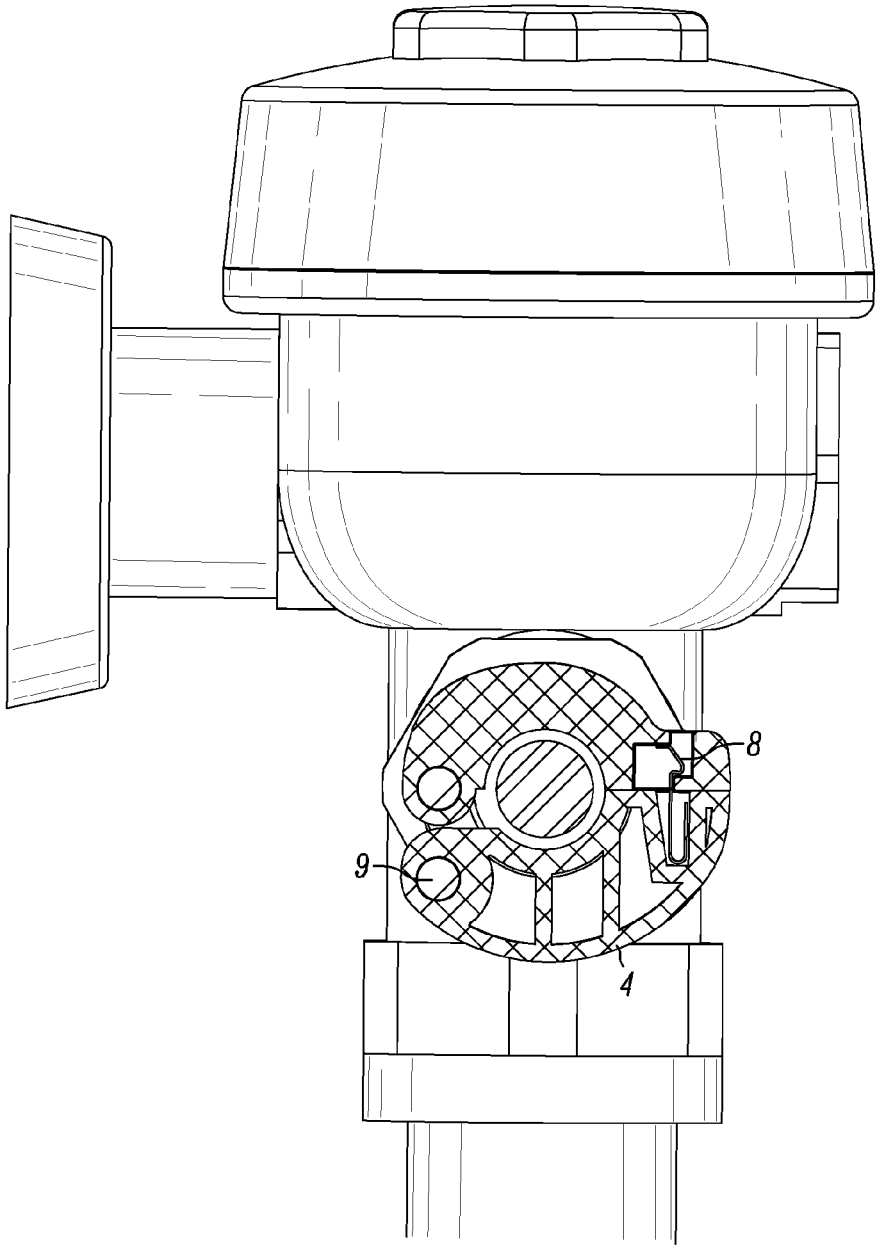
FIG. 7 is an exploded view of the FIG. 6.

FIG. 5 provides a partial cross-sectional view of FIG. 4. As can be seen, a set screw 14 is used to secure the handle lock assembly 100 to the left handle 2. More specifically, the set screw 14 is positioned to pass through and engage the handle 2 and engage the top component 3. The first 4 and second 5 arm sections can be seen in cross-section, again separated by the center support section 6. FIGS. 6-7 provide a partial cross section view showing the lock spring 8, which holds the first 4 and second 5 arm sections in place. Each of the first 4 and second 5 arm sections have a hinge 9 that allows the arms to rotate down so that clearance can be created when a flush is desired.

Figure 8:
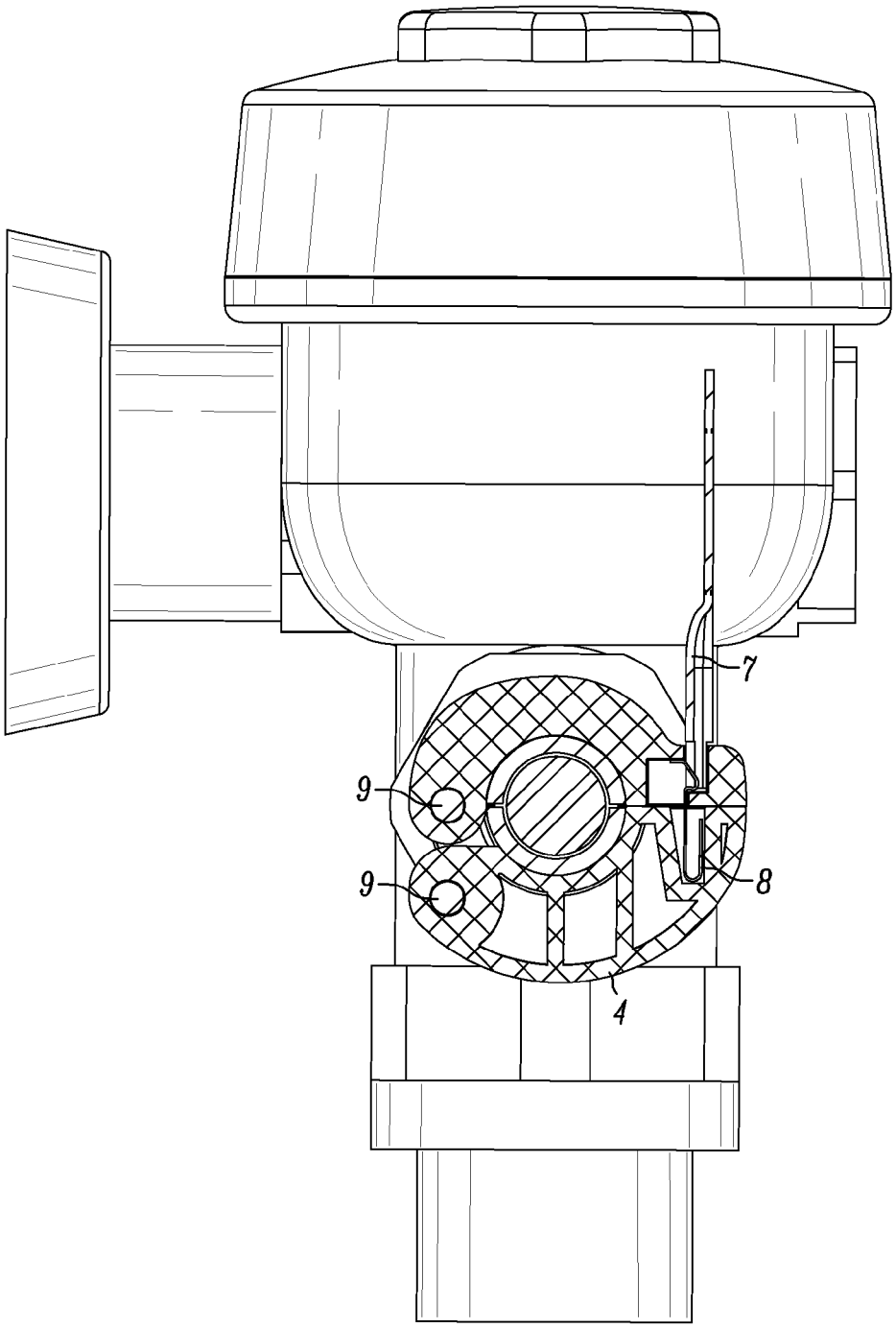
FIG. 8 is an exploded view of FIG. 6.

FIG. 8 provides a partial cross sectional view showing the release key 7 inserted into the receiving slot on the top component 3. When the key 7 is inserted, the key 7 pushed the leaf spring 8, which releases the first 4 and second 5 arm sections and unlocks the handle 2.

Figure 9:
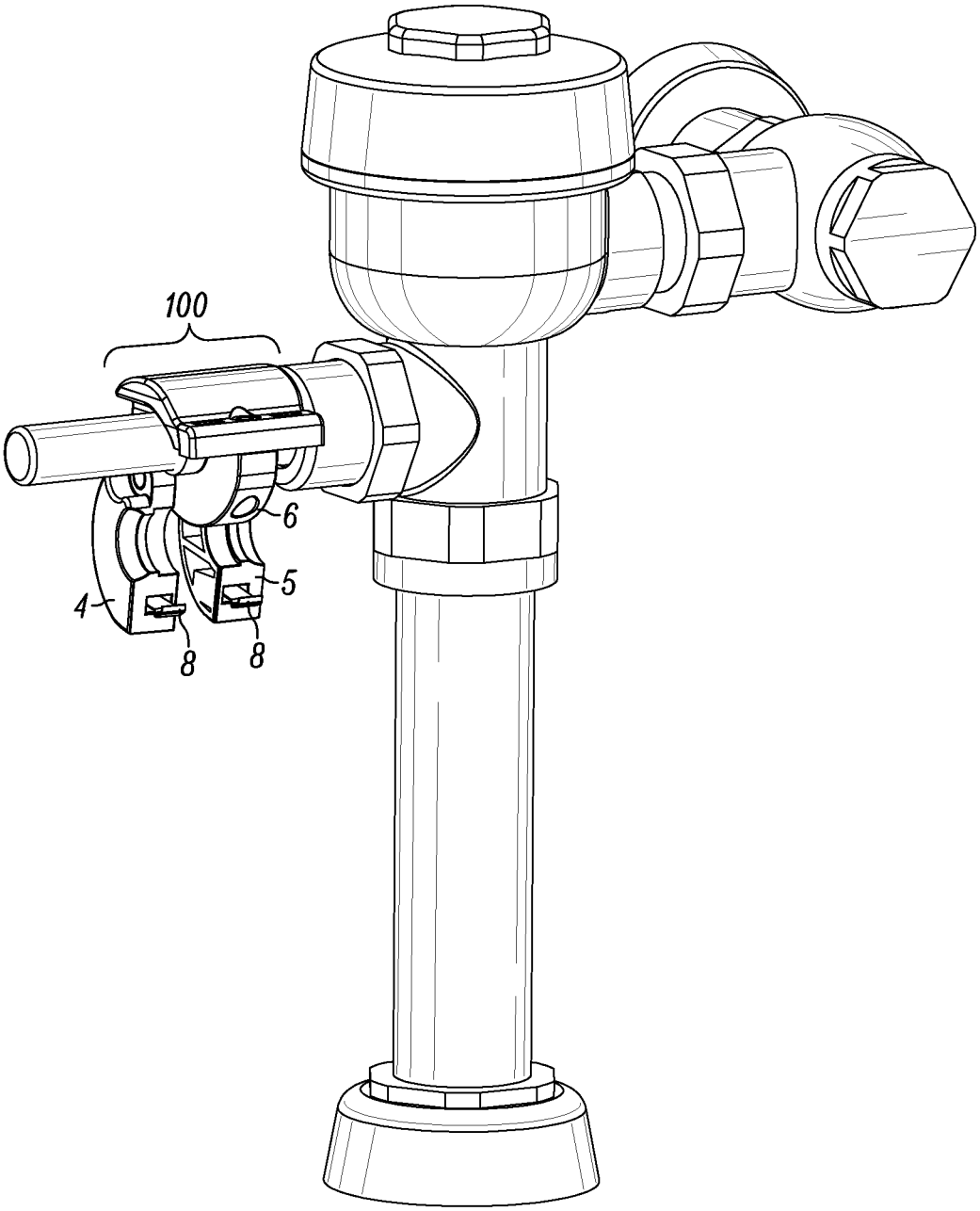
FIG. 9 is a front view of a handle lock assembly secured to a left handle installation with the first and second arm sections in the open position.

Turning now to FIG. 9, the handle lock assembly 100 is secured to the handle 2 through the center support section 6. FIG. 9 shows the handle lock assembly 100 with the first 4 and second 5 arm sections in the open position. The lock spring 8 can be seen with both the first 4 and second 5 arm sections. When the first 4 and second 5 arm sections engage with the top component 3, the lock spring 8 will engage with a mating locking element 32, 34 on the top component 3, which will secure first 4 and second 5 arm sections into a locked configuration.

Figure 10:
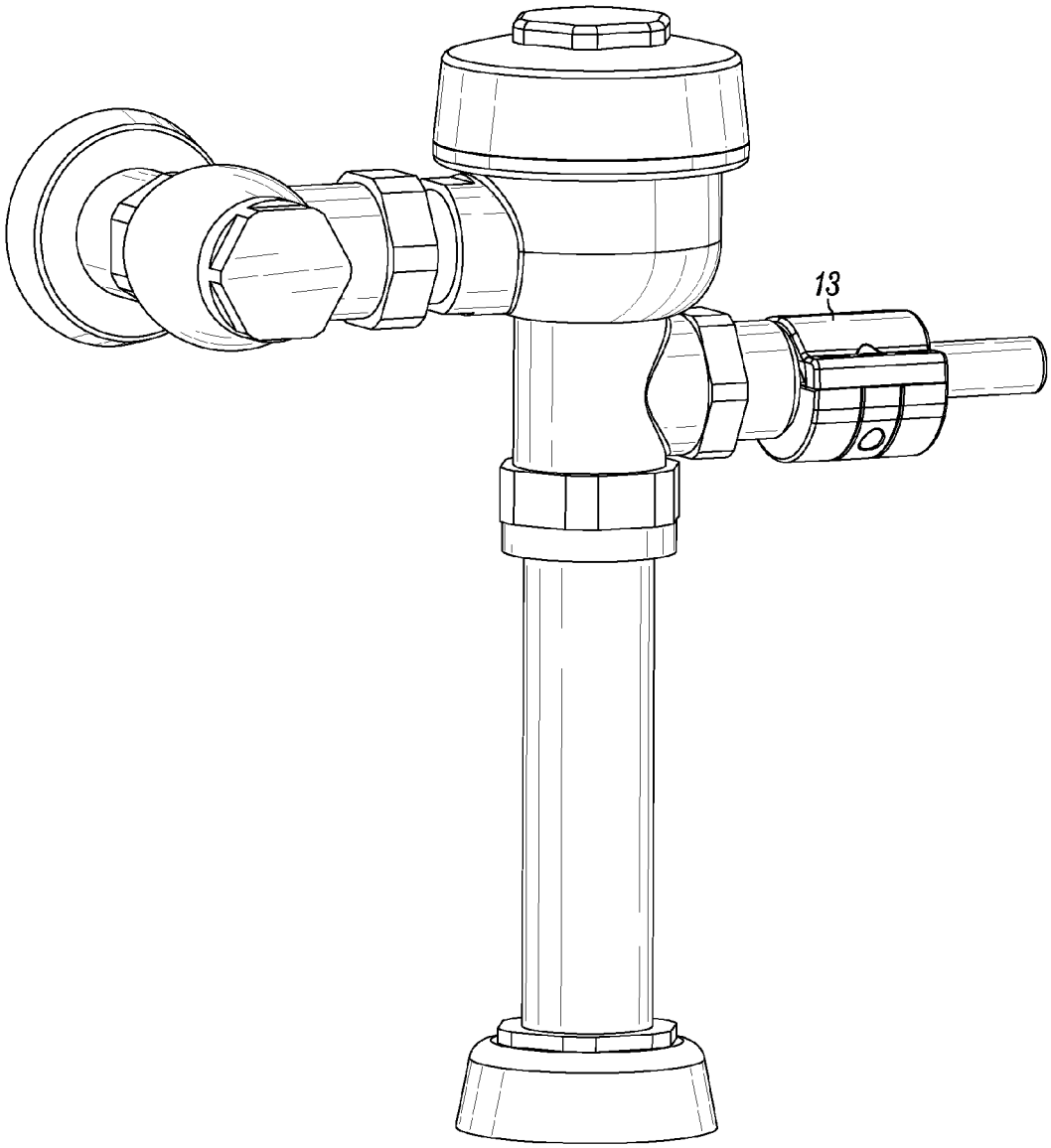
FIG. 10 is a front view of a handle lock assembly secured to a right handle installation with the first and second arm sections in the closed position.

FIG. 10 is a representative schematic of a handle lock assembly 100 on a right handle 13 installation. The first 4 and second 5 arm sections are in locked configuration, which will prevent the handle from flushing. The handle lock assembly 100 easily adapts to either a left 2 or right handle 13 installation, providing universal applicability and versatility.

Figure 11:
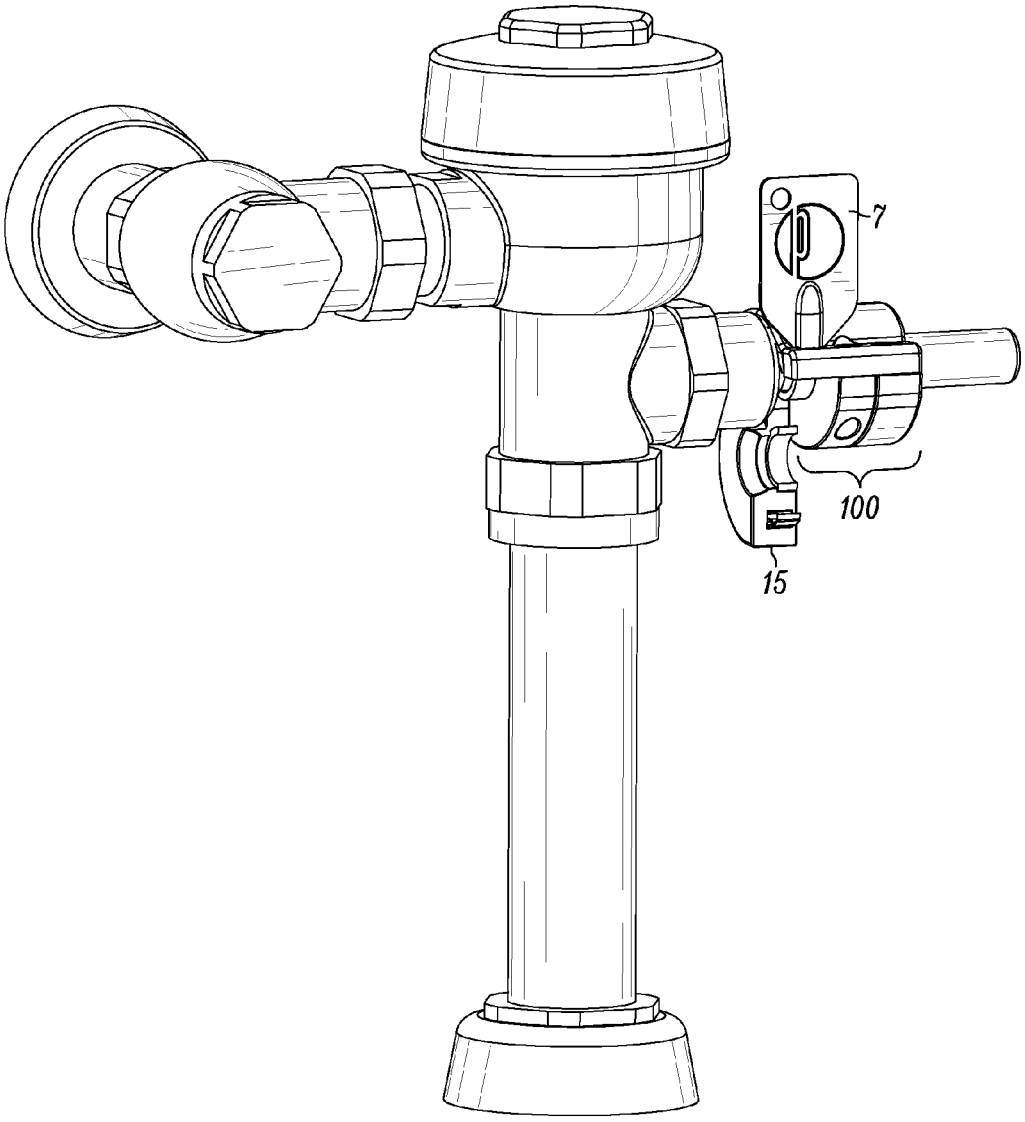
FIG. 11 is a front view of a handle lock assembly secured to a right handle installation with the release key inserted into the receiving slot or aperture in the top component and the first arm section in the open position.
Figure 12:
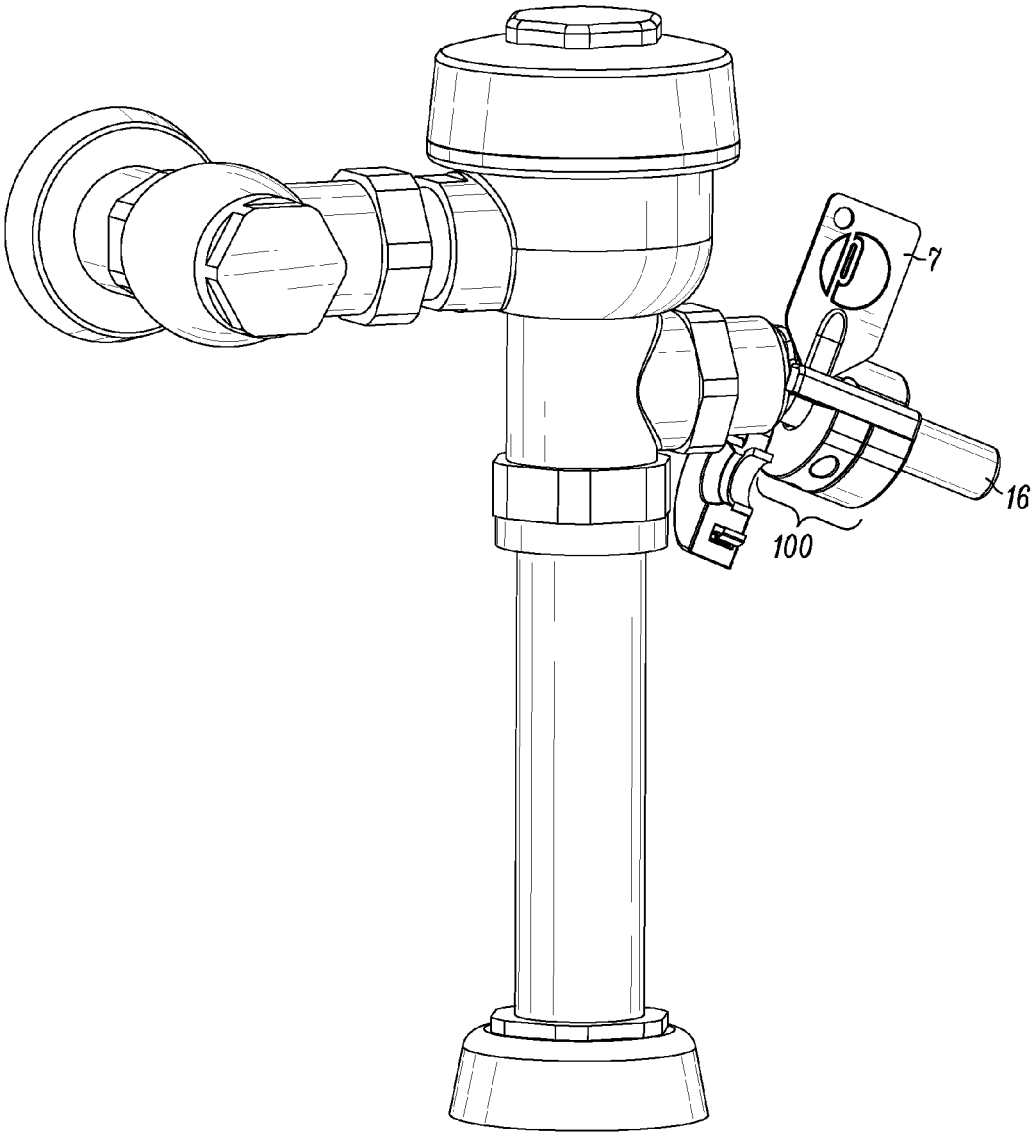
FIG. 12 is a front view of a handle lock assembly secured to a right handle installation with the release key inserted into the receiving slot or aperture in the top component, the first arm section in the open position, and the handle in a down position, indicating the handle has been flushed.

FIGS. 11-12 are representative schematics of the handle lock assembly 100 on a right handle assembly with the release key 7 inserted into the receiving slot in the top component 3. The first arm section 4 is in the down position, indicating that the handle is ready to flush. As shown in FIG. 12, when the release key 7 is engaged, the arm is released, thereby allowing the right handle 16 to move downward and flush. In some embodiments, release key 7 will be removed after releasing first arm section 4 and prior to flushing. Release key 7 does not need to remain engaged in order to flush once first arm section 4 is in the down position.

Figure 13:
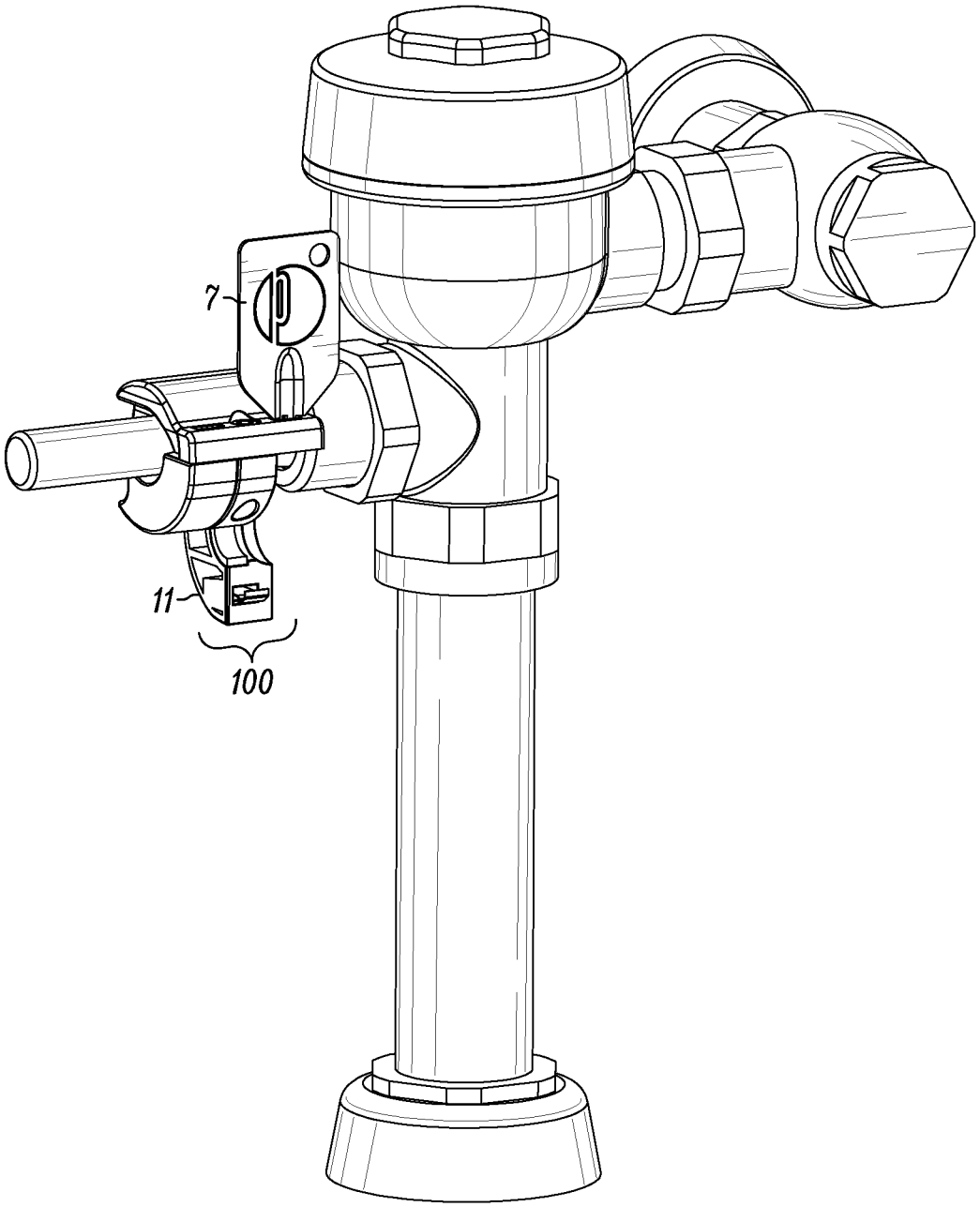
FIG. 13 is a front view of a handle lock assembly secured to a left handle installation with the release key inserted into the receiving slot or aperture in the top component and the second arm section in the open position.
Figure 14:
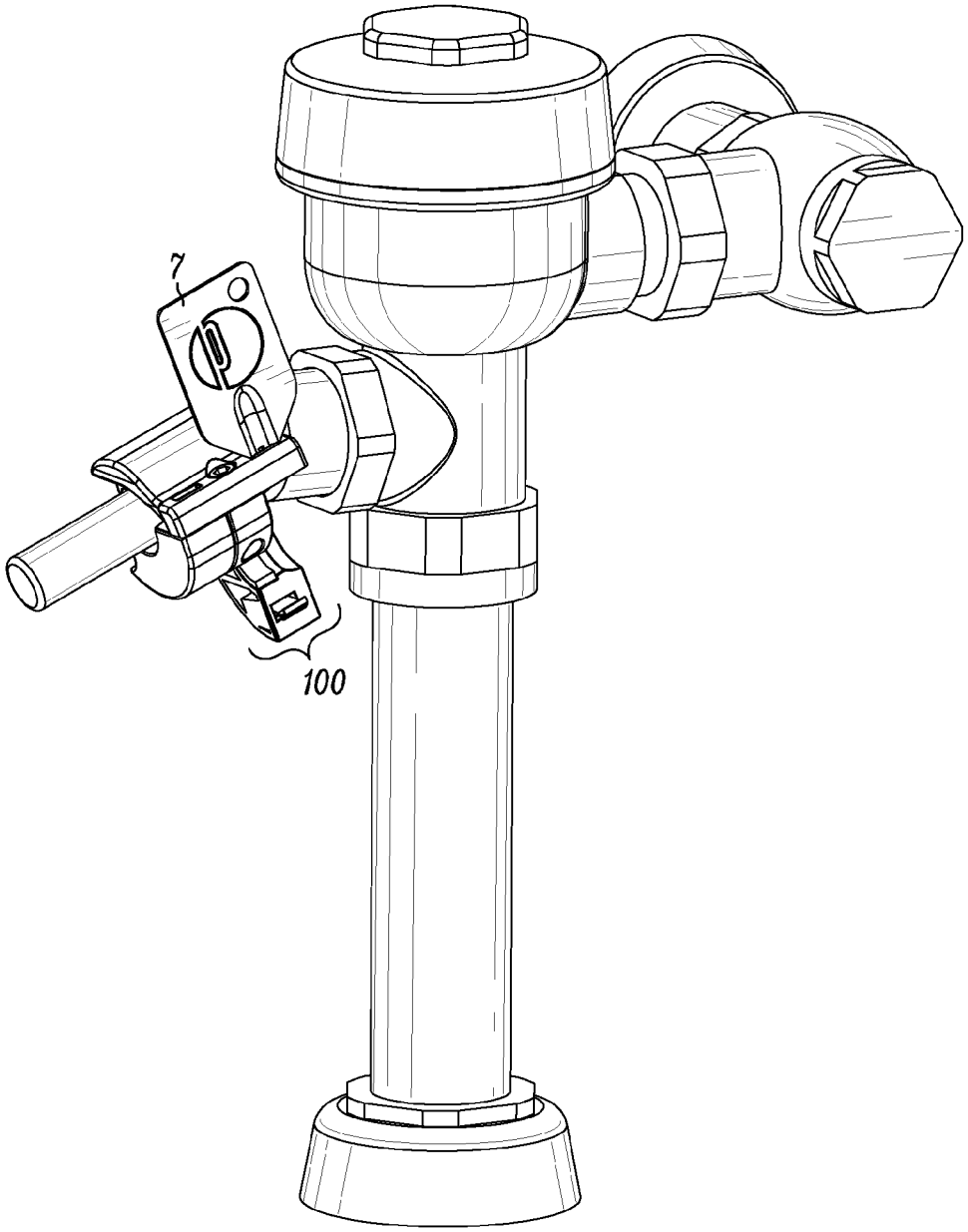
FIG. 14 is front view of a handle lock assembly secured to a left handle installation with the release key inserted into the receiving slot or aperture in the top component, the second arm section in the open position, and the handle in a down position, indicating the handle has been flushed.
Figure 15:
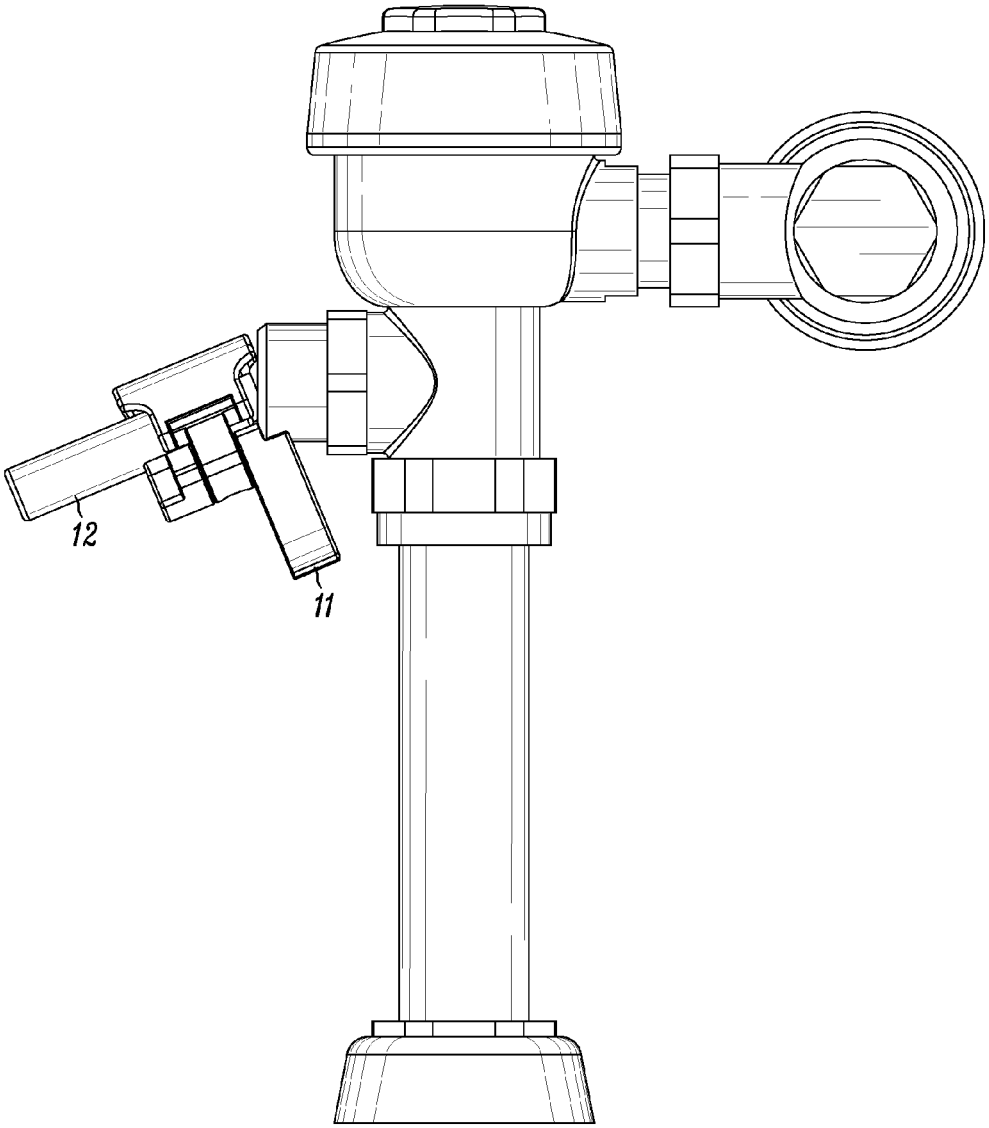
FIG. 15 is a back view of a handle lock assembly secured to a right handle installation with the second arm section in the open position, and the handle in a down position, indicating the handle has been flushed.

FIGS. 13-15 are representative schematics of the handle lock assembly 100 on a left handle assembly with the release key 7 inserted into the receiving slot in the top component 3. The second arm section 5 is in the down position, indicating that the handle is ready to flush. As shown in FIGS. 14-15, when the release key 7 is engaged, the arm is released, thereby allowing the left handle 15 to move downward and flush. As mentioned above, however, release key 7 does not need to remain engaged after second arm section 5 is in the down position. Once the second arm section 5 is in the down position, release key 7 may be removed and the handle will be ready to flush without the release key 7 engaged.

FIG. 15 depicts a left handle installation. The release key 7 has been inserted so the second arm 5 section is in the down position, and the left handle 12 is in a down position, indicating the handle has been flushed.

Figure 16:
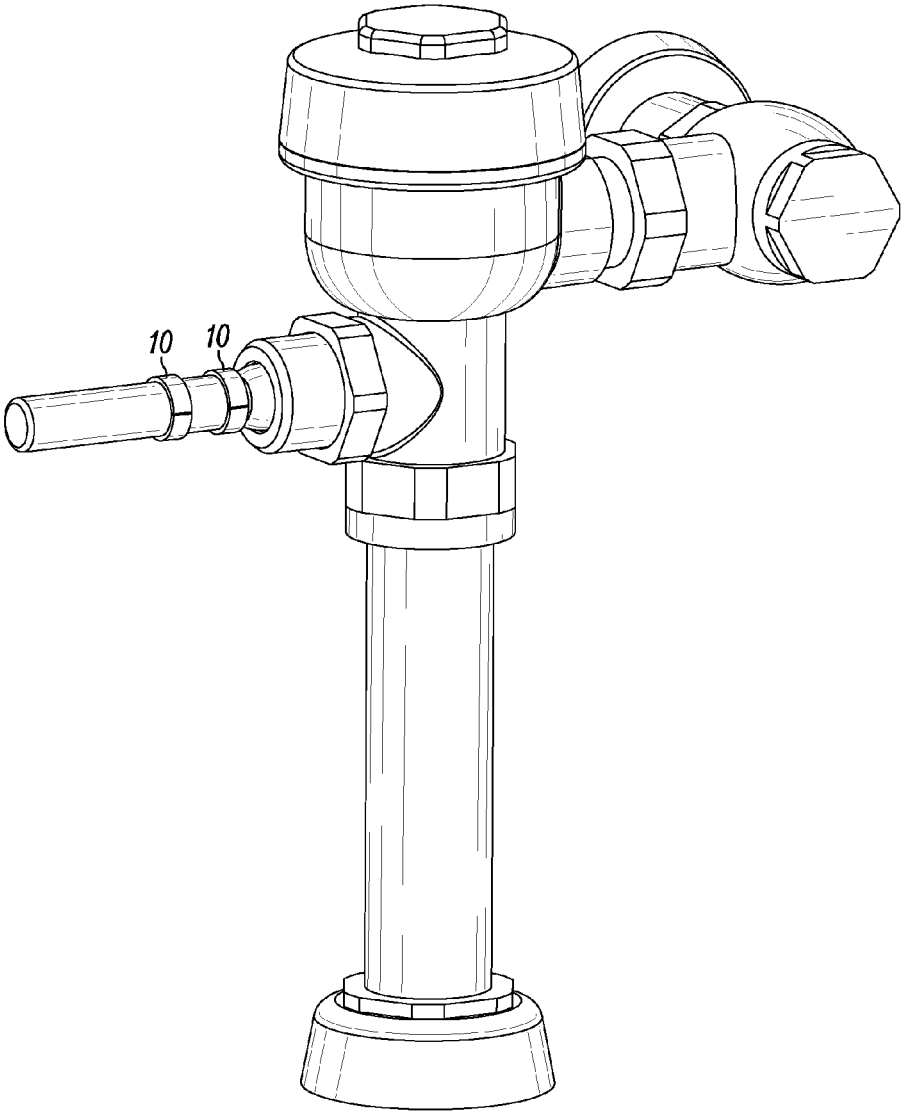
FIG. 16 is a front view of the left hand installation showing rubber shims on a handle. The rubber shims can be used to secure the handle lock assembly to the handle.

As shown in FIG. 16, rubber shims 10 can be used to secure the handle lock assembly 100 to any type of handle and any size of handle. Any number of rubber shims can be used to secure the handle lock assembly including but not limited to 2, 3, 4, 5, 6, 7, 8, 9, 10, and greater than 10. One of ordinary skill in the art will understand that the rubber shims can be of any size and thickness. If the handle lock assembly 100 is going to be secured to a thinner handle, more rubber shims may be needed to securely attach the handle lock assembly 100. Conversely, with a thicker or bulkier handle, less rubber shims may be needed to secure the handle assembly to the handle.

In the embodiments described above, handle lock assembly 100 has been described as secured to a lever-type flush actuator; however, in further embodiments, the flush actuator may be any style actuator used on a urinal, toilet or other fixture, including, but not limited to, push buttons. In some embodiments, such as when used with a push button style actuator, the handle lock assembly 100 may include only a single pivoting arm section.

Method of Conserving Water with Handle Lock Assembly

In one embodiment, the disclosure relates to a method of conserving water. In one embodiment, the method comprises placing a handle lock assembly on a handle of a urinal or toilet, wherein the handle lock assembly prevents flushing if a release key has not been inserted into the assembly. When a release key is inserted into the assembly, an arm on the assembly falls, permitting space to maneuver the handle to flush the urinal or toilet. Thus, the handle lock assembly provides for control over when flushing occurs, and provides for the reduction in the number of flushes for a particular installation over a period of time. The handle lock assembly can reduce water usage from 1 to 5% or from 5 to 10% or from 10 to 20% or from 20 to 30% or from 30 to 40% or from 40 to 50% or from 50 to 60% or from 60 to 70% or from 70 to 80% or from 80 to 90% or from 90 to 95% or from 95 to 100% or from 100 to 200% and greater than a 200% reduction in water usage.

Fixture Drain Insert Assembly

In some embodiments, fixture system 500 can also include a fixture drain insert trap assembly 300, with or without or handle lock assembly 100.

Figure 17:
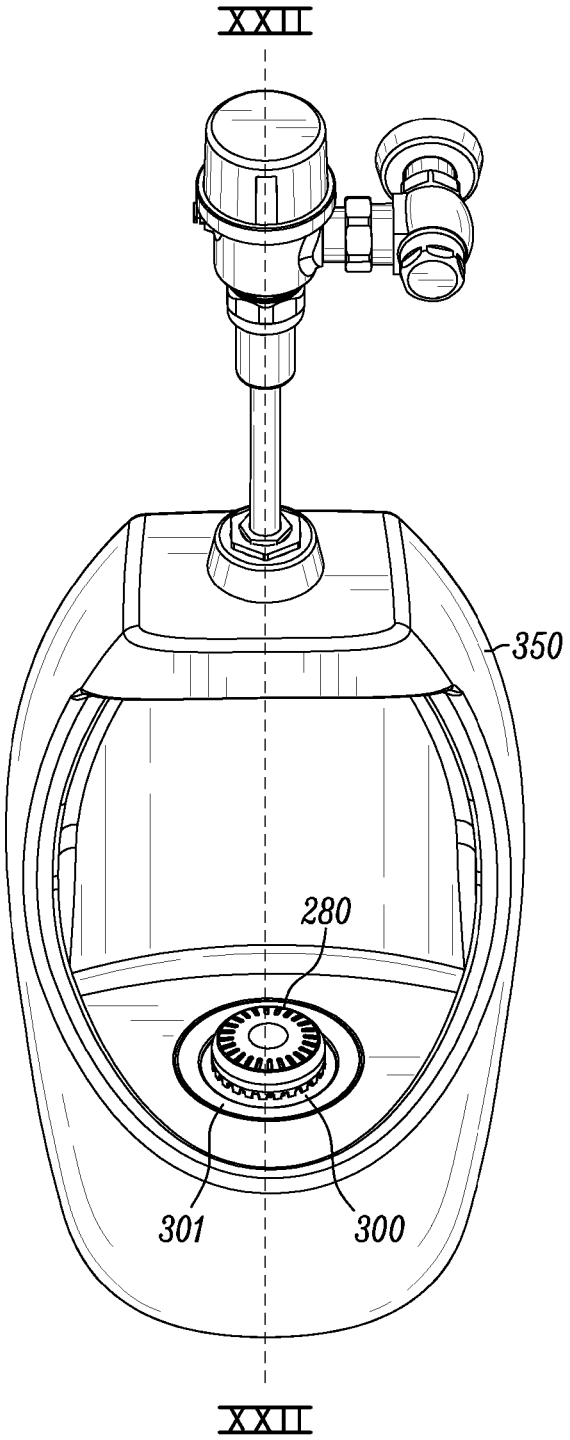
FIG. 17 illustrates a perspective view of an embodiment of a fixture drain insert assembly inserted in a urinal.

FIG. 17 illustrates a perspective view of an embodiment of a fixture drain insert trap assembly 300 with material support module 280 inserted in a urinal 350. While in the exemplary embodiments described herein, fixture drain insert trap assembly 300 is described in the context of urinal drains, it is to be understood that fixture drain insert trap assembly 300 may be used with other fixtures, such as sinks.

Figure 18:
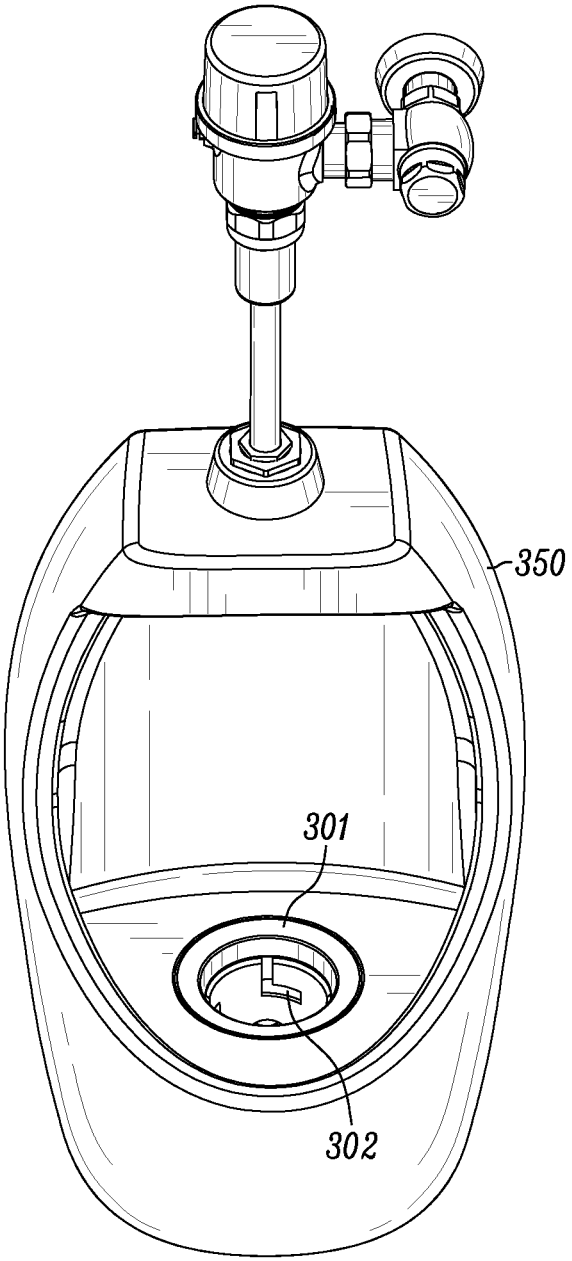
FIG. 18 illustrates a perspective view of drain mounting component in a urinal for securing the fixture drain insert assembly shown in FIG. 17.

FIG. 18 illustrates a perspective view of urinal 350 with drain mounting component 301. Drain mounting component 301 fits within the urinal drain and contains interlocking members 302 which engage protuberances 241 of trap housing 240 (see FIG. 20) in a bayonet mount style. Other forms of securing trap housing 240 to drain mounting component 301 may be used however, such as threaded structures, friction fit components, and other attachment structures and assemblies known in the art.

Figure 19:
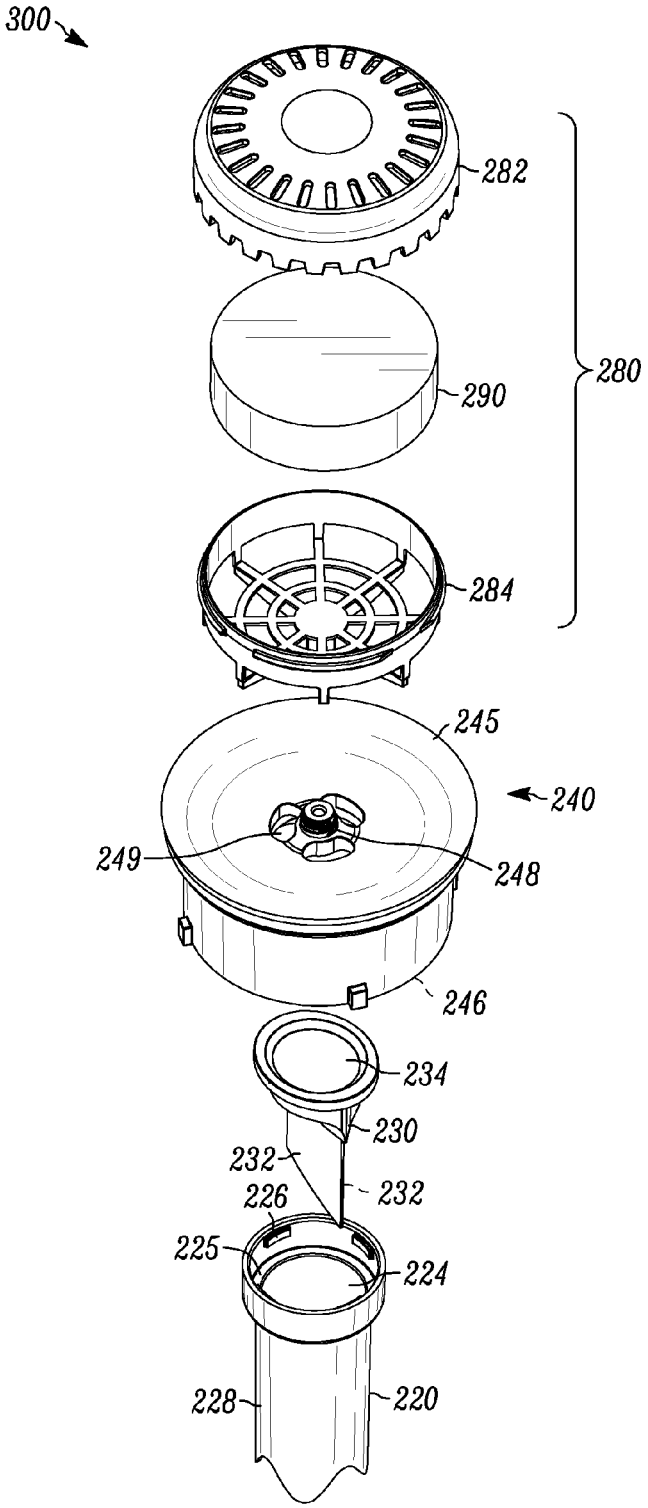
FIG. 19 illustrates an exploded view of the fixture drain insert assembly.

FIG. 19 illustrates an exploded view of the fixture drain insert trap assembly 300 shown in FIG. 17. Material support modules 280 comprises cover 282 and bottom 284 which secure together to enclose fragrance or enzyme/bacteria material 290. In the exemplary embodiment shown, material 290 is a solid block containing a fragrance or enzyme/bacteria or other cleaning agent. In further exemplary embodiments, material 290 could be a gel or liquid.

Bottom 282 of material support module 280 includes securing component 288 (shown in dashed) on its bottom surface. Securing component 288 connects and secures material support module 280 to trap house 240. Trap housing 240 has a corresponding securing component 248 at the center of sloped upper surface 245 which engages securing component 288 of material support module 280. In the exemplary embodiment shown, securing component 248 is a threaded male member which threadingly engages securing component 288, which is a threaded female member. However, in further exemplary embodiments, material support module 280 and trap housing 240 may secure to each other through any means known in the art. Sloped upper surface 245 is sloped downwardly towards drain apertures 249 which permit the passage of liquid through trap housing 240 and the rest of fixture drain insert assembly 300.

The inner bottom surface of trap housing 240 includes an interlocking structure 246 (shown in more detail in FIG. 21), which, in the exemplary embodiment described, is a plurality of L-shaped protuberances oriented radially around the outer surface of an inner diameter 247 (not shown) of trap housing 240. Interlocking structure 246 engages corresponding interlocking structure 226 of housing support 220. As shown in FIG. 19, corresponding interlocking structure 226 comprises a plurality of pin protuberances radially configured around the inner surface of open top end 224. When housing support 220 and trap housing 240 are secured together, open top end 224 slides over inner diameter 247 of trap housing 240 when interlocking structures 246 and 226 of offset relative to each other. Once interlocking structures 246 and 226 are past each other, trap housing 240 and housing support 220 are rotated relative to one another to align interlocking structures 246 and 226 such that the pin interlocking structures 226 are secured against the L-shaped protuberances 246. This style of joining is called a bayonet mount, which is easy to engage and disengage for quick and easy joining/removal of trap housing 240 from housing support 220.

In further exemplary embodiments, any structure, mechanism or combination thereof may be used to join trap housing 240 and housing support 220. For example, trap housing 240 and housing support 220 could be joined by interlocking threaded components, adhesives or sonic welding. However, using a form of interlocking components, such as the bayonet mount or threads, provides a quick and easy way to remove fixture drain insert assembly 300 components for cleaning, replacement or repair. It also makes accessing the trap and valve easy without having to remove the entire fixture drain insert assembly 300 from the fixture.

As illustrated in FIG. 19, housing support 220 also includes a smooth cylindrical body 228 for insertion into a fixture drain. In other embodiments, cylindrical body 228 may be threaded or have a different shape to conform or secure to a given drain/trap style.

Fixture drain insert assembly 300 also includes elastomer trap 230 which has an open top end 234 configured to sit on inner lip 225 of housing support 220. Open top end 234 of elastomer trap 230 provides a passage for liquid from trap housing 240 into housing support 220 (and therefore a fixture drain) through flaps 232. While two flaps 232 are shown, other exemplary embodiments may use more flaps 232. When urinal drain insert assembly 300 is assembled, the joining of housing support 220 and trap housing 240 secures elastomer trap 230 between them.

Figure 20:
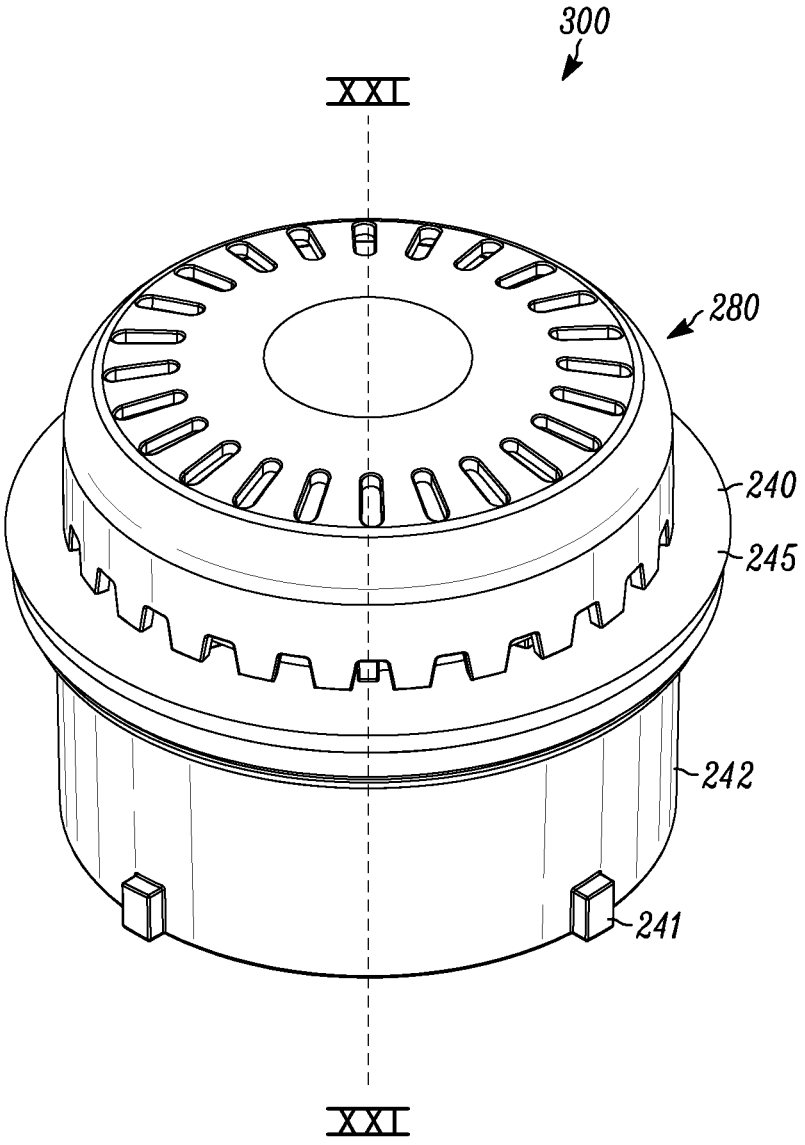
FIG. 20 illustrates a side perspective view of the fixture drain insert assembly of FIG. 17.

FIG. 20 illustrates a side perspective view of the fixture drain insert assembly 300. Material support module 280 is assembled and secured to trap housing 240 with sloped upper surface 245 extending beyond material support module 280. Trap housing 240 has cylindrical outer surface 242 with protuberances 241 for securing in a fixture drain.

Figure 21:
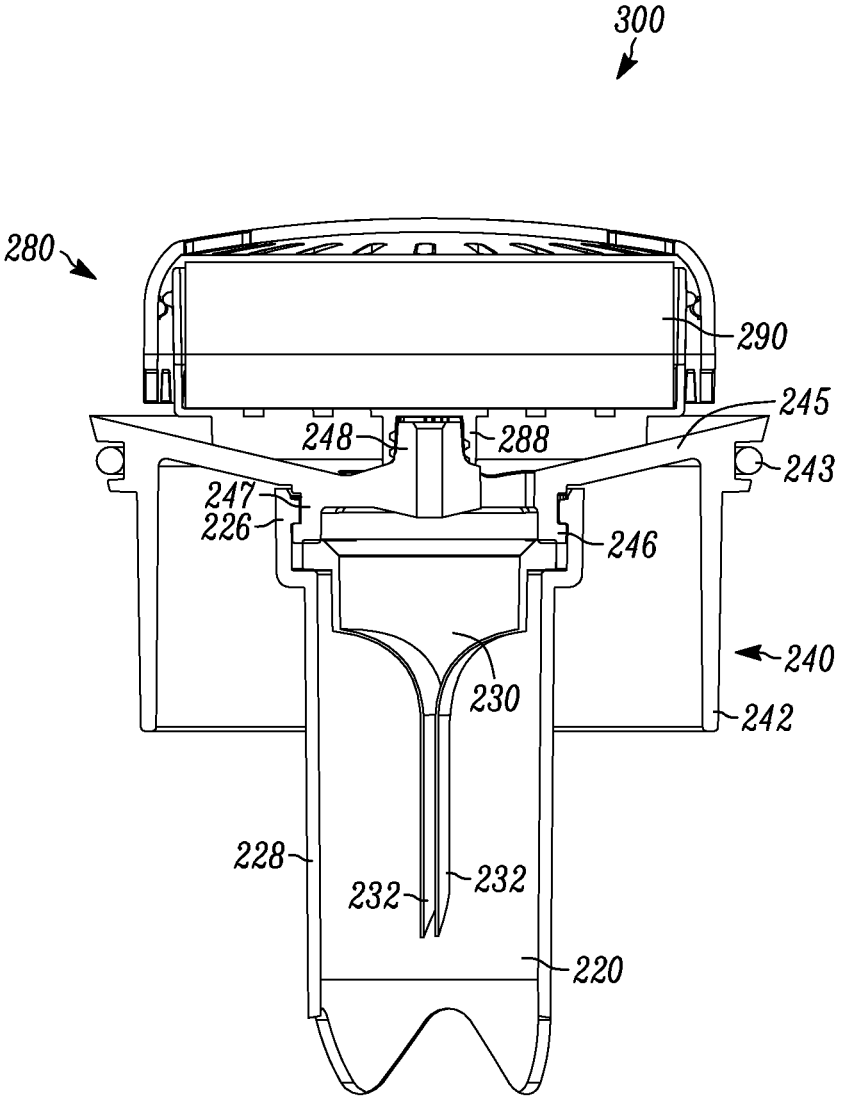
FIG. 21 illustrates a cross-sectional view of the fixture drain insert assembly taken along the line XXI-XXI of FIG. 20.

FIG. 21 illustrates a cross-sectional view of the fixture drain insert assembly 300 taken along the line XXI-XXI of FIG. 20. Material support module 280 contains fragrance or enzyme/bacteria material 290 and is secured to trap housing 240 at securing components 248 (on trap housing) and 228 (on material support module 280). As illustrated, male securing component 248 is securely threaded into female securing component 288.

The mating of interlocking structures 246 (on inner diameter 247 of trap housing 240) and 226 on housing support 220 is also shown. Interlocking structures 246 and 226 are aligned to engage one another and connected as in a bayonet mount, described above. Elastomer trap 230 with two flaps 232 is secured between trap housing 240 and housing support 220. Trap housing 240 also contains gasket 243 which helps create a seal around a fixture drain.

Figure 22:
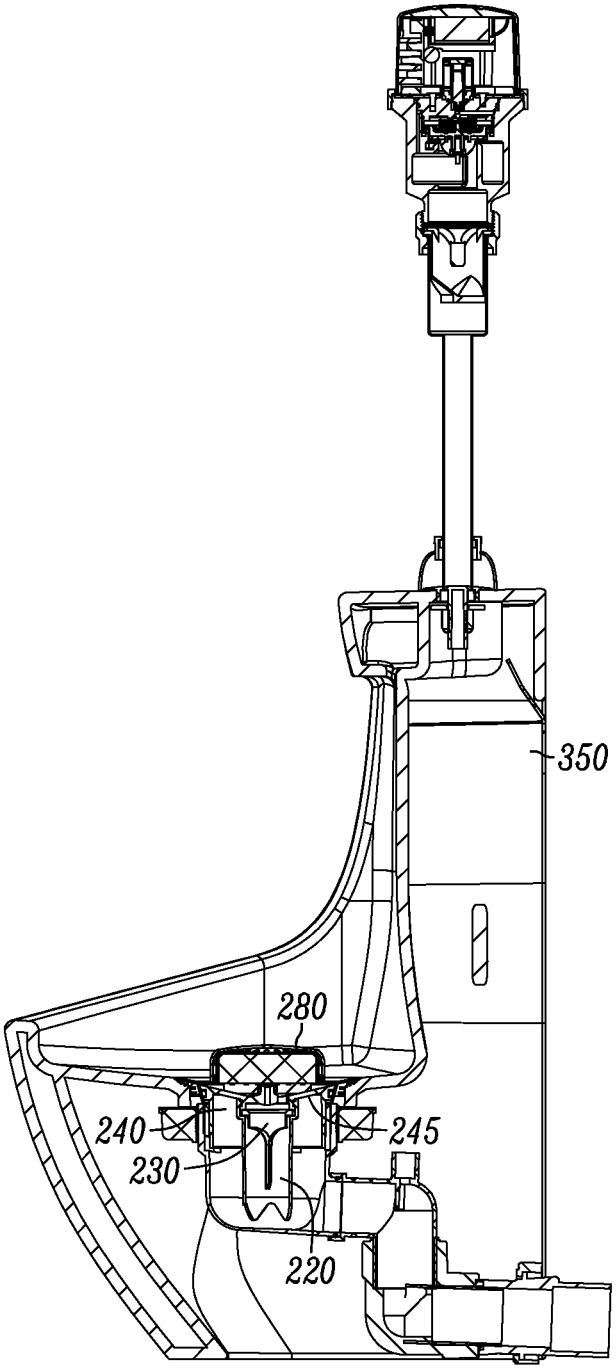
FIG. 22 illustrates a cross-sectional view of the fixture drain insert assembly inserted in a urinal drain taken along the line XXII-XXII of FIG. 17.

FIG. 22 illustrates a cross-sectional view of the fixture drain insert trap assembly 300 inserted in a urinal 350 taken along the line XXII-XXII of FIG. 17. Material support module 280 projects into the basin of urinal 350 and is visible. Trap housing 240 is secured within the urinal's drain with sloped upper surface 245 concealed in the drain beneath material support module 280. Housing support 220 projects downward into the urinal trap with elastomer trap 230 secured between housing support 220 and trap housing 240.

In the exemplary embodiment shown, as liquid (i.e., water, urine, etc.) flows enters the urinal basin, the liquid passes through drain apertures 249 of trap housing 240, through elastomer trap 230 and out housing support 220. Elastomer trap 230 acts as a one-way valve permitting only the passage of liquid downward through its flaps 232 and preventing the backup of liquid or gas through elastomer trap 230. Trap housing 240 further prevents gases and liquids from escaping back up the urinal drain.

Figure 23:
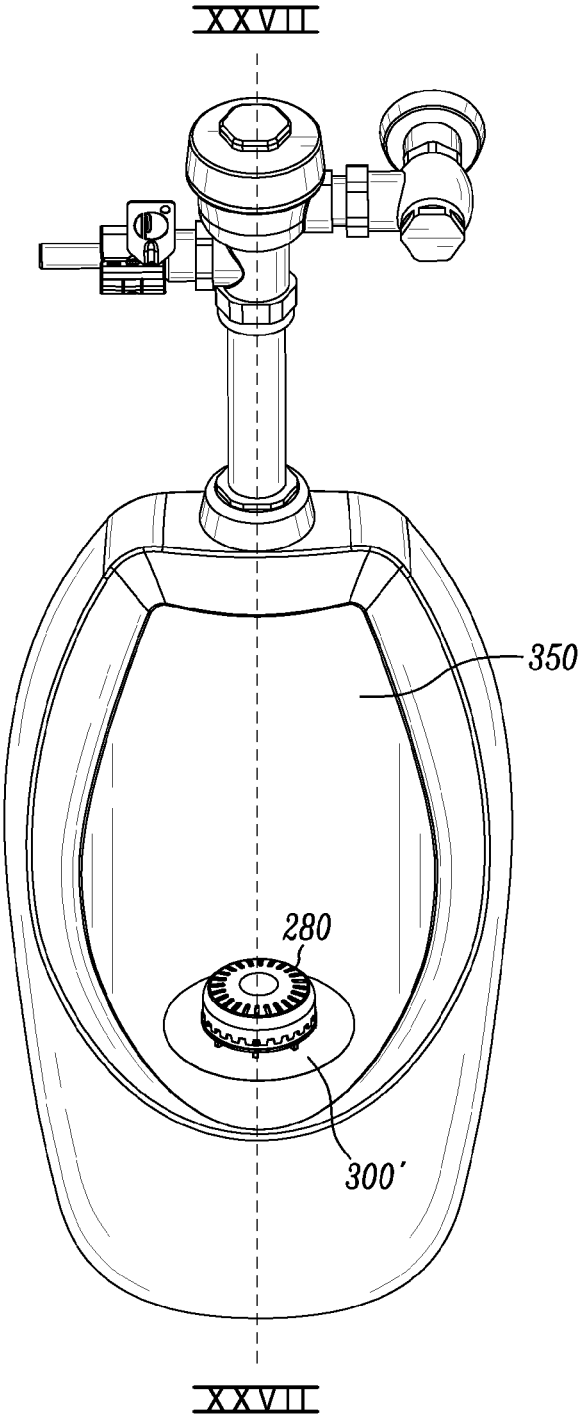
FIG. 23 illustrates a perspective view of another embodiment of a fixture drain insert assembly inserted in a urinal drain.

FIG. 23 illustrates a perspective view of another embodiment of a fixture drain insert trap assembly 300' with material support module 280 inserted in a urinal 350. In the exemplary embodiment shown in FIGS. 23-27, fixture drain insert assembly 300' is designed to retrofit into any existing fixture drain.

Figure 24:
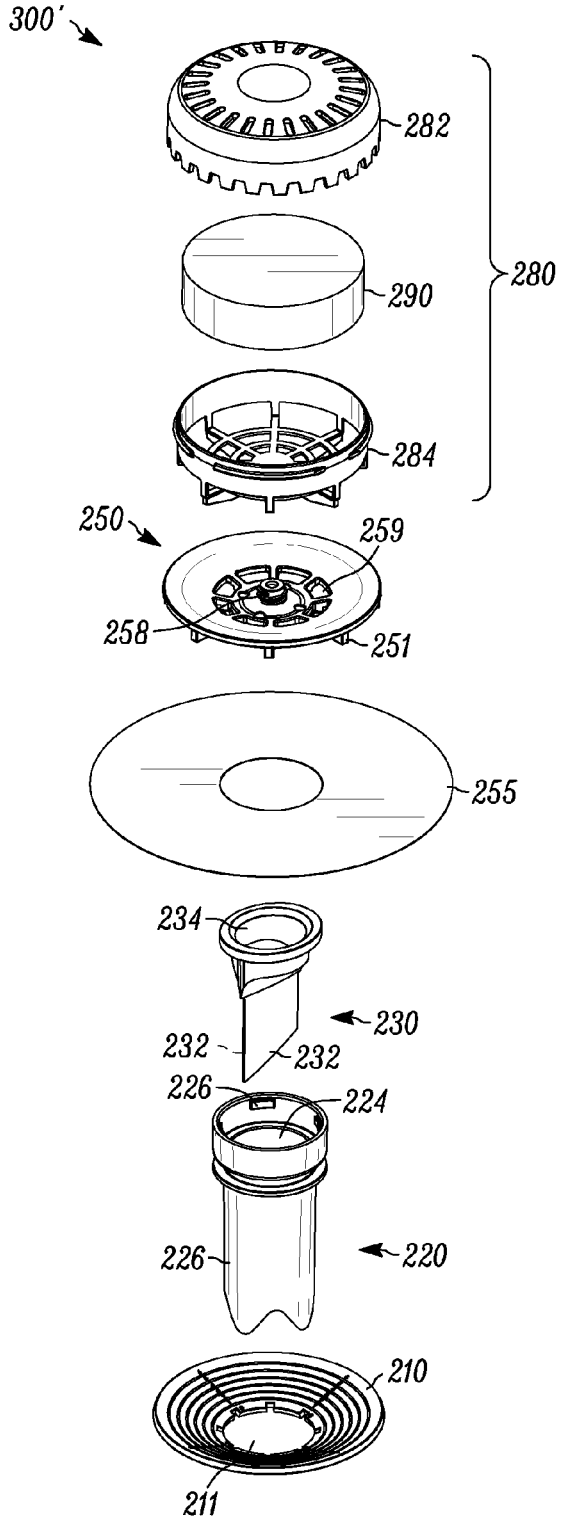
FIG. 24 illustrates an exploded view of the fixture drain insert assembly of FIG. 23.

FIG. 24 illustrates an exploded view of the fixture drain insert trap assembly 300' of FIG. 23. Material support module 280 comprises cover 282 and bottom 284 which secure together to house material 290. In place of trap housing 240, however, fixture drain insert assembly 300' comprises trap cover 250 which secures to support module 280 through the connection of securing components 288 (on support module 280) and 258 (on trap cover 250). Like trap housing 240, trap cover 250 includes an inner diameter 257 which contains an interlocking structure 256 which corresponds to interlocking structure 226 of housing support 220. Trap cover 250 also contains legs 251 which keep trap cover with drain apertures 259 slightly raised over drain cover skirt 255. Drain cover skirt 225 is a flexible piece of material that does not interact with most liquids exposed in urinals (such as a polymeric-based material, silicone, thermoplastic elastomers, thermoplastic olefinic elastomers, etc.) which conforms to a fixture surface to seal around a drain. Drain cover skirt 225 functions to further ensure no odor escapes the drain and helps ensure that urine/liquids pass through drain apertures 259 and, ultimately, elastomer trap 230.

Fixture drain insert trap assembly 300' also includes elastomer trap 230 which has two flaps 232 and an open top end 234 which provides passage of liquid from trap cover 250 through housing support 220 and is designed to rest on inner lip 225 of housing support 220. Housing support has interlocking structure 226 which corresponds to interlocking structure 256 of trap cover 250 and cylindrical body 228. In the exemplary embodiment shown, cylindrical body 228 includes ridge 221 for seating gasket 210. Inner edge 211 of gasket 210 secures in ridge 221 to connect gasket 210 to housing support 220. Gasket 210 creates an odor seal for fixture drain insert trap assembly 300'.

Figure 25:
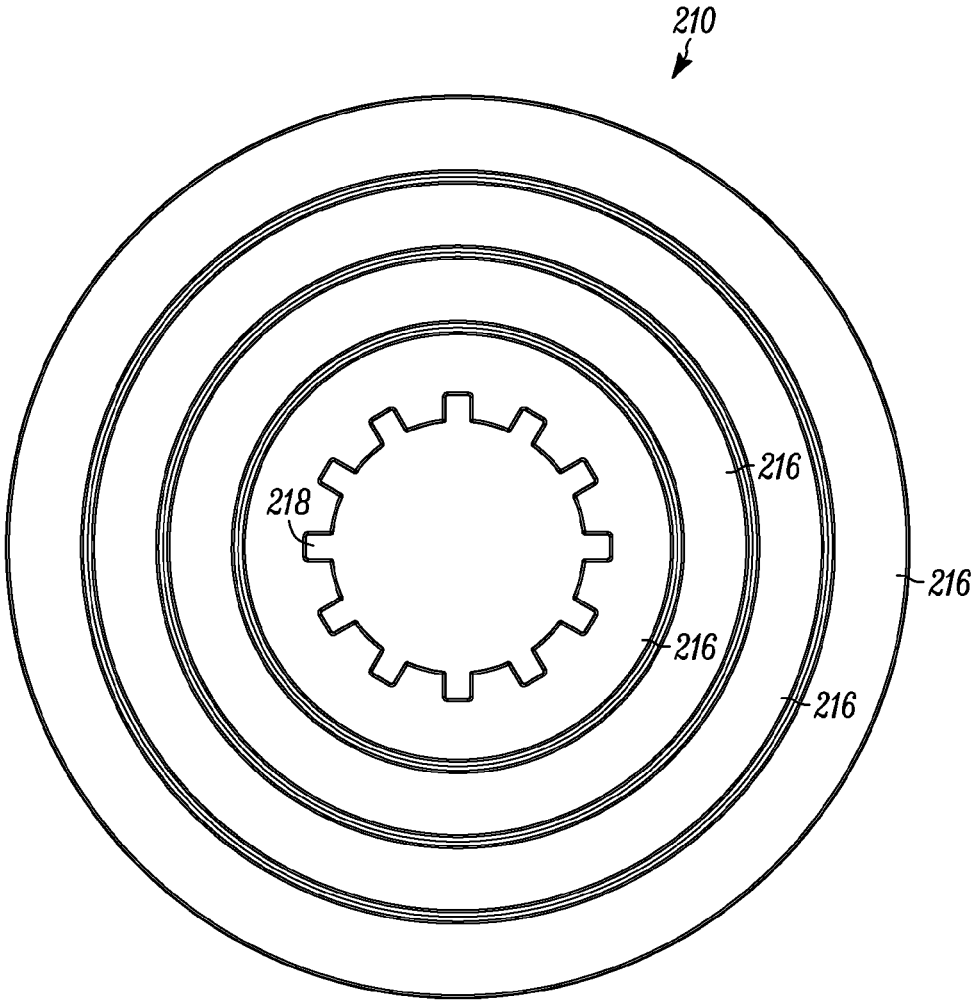
FIG. 25 illustrates the gasket of the fixture drain insert assembly shown in FIG. 24.

FIG. 25 illustrates a top view of gasket 210. Gasket 210 includes a plurality of removable concentric rings, allowing gasket 210 to be sized to any existing drain or trap style and still create a seal to prevent odors from escaping. Gasket 210 also includes drain apertures 218 which permit liquid to flow past gasket 210 if it should leak past drain cover skirt 255. Gasket 210 also serves to help secure fixture drain insert assembly 300' in the drain and prevent movement.

Figure 26:
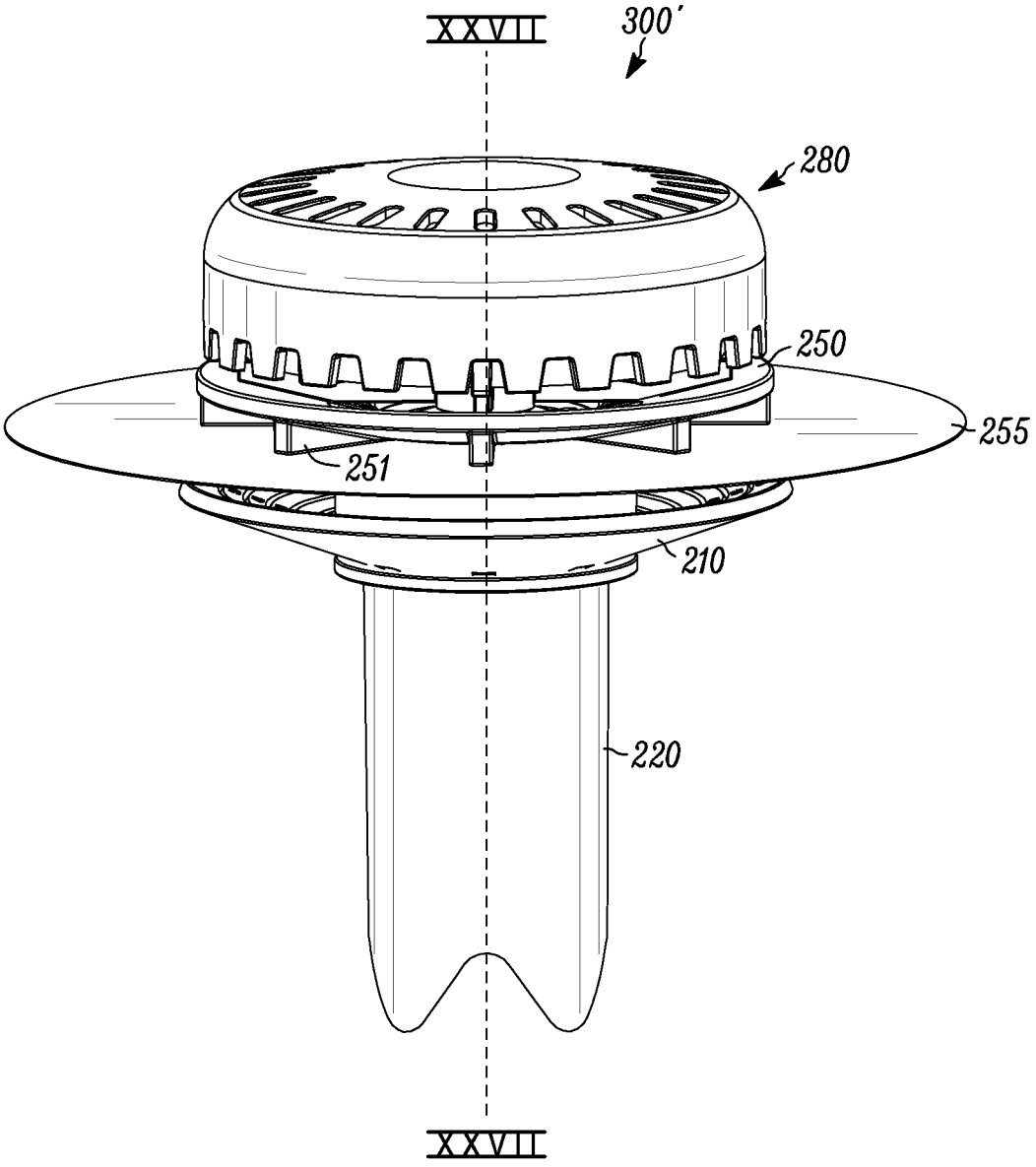
FIG. 26 illustrates a perspective view of the fixture drain insert assembly.

FIG. 26 illustrates a perspective view of the fixture drain insert trap assembly 300'. Material support module 280 is assembled and secured to trap cover 250. Legs 251 hold trap cover 250 up from drain cover skirt 255, with gasket 210 secured to housing support 220.

Figure 27:
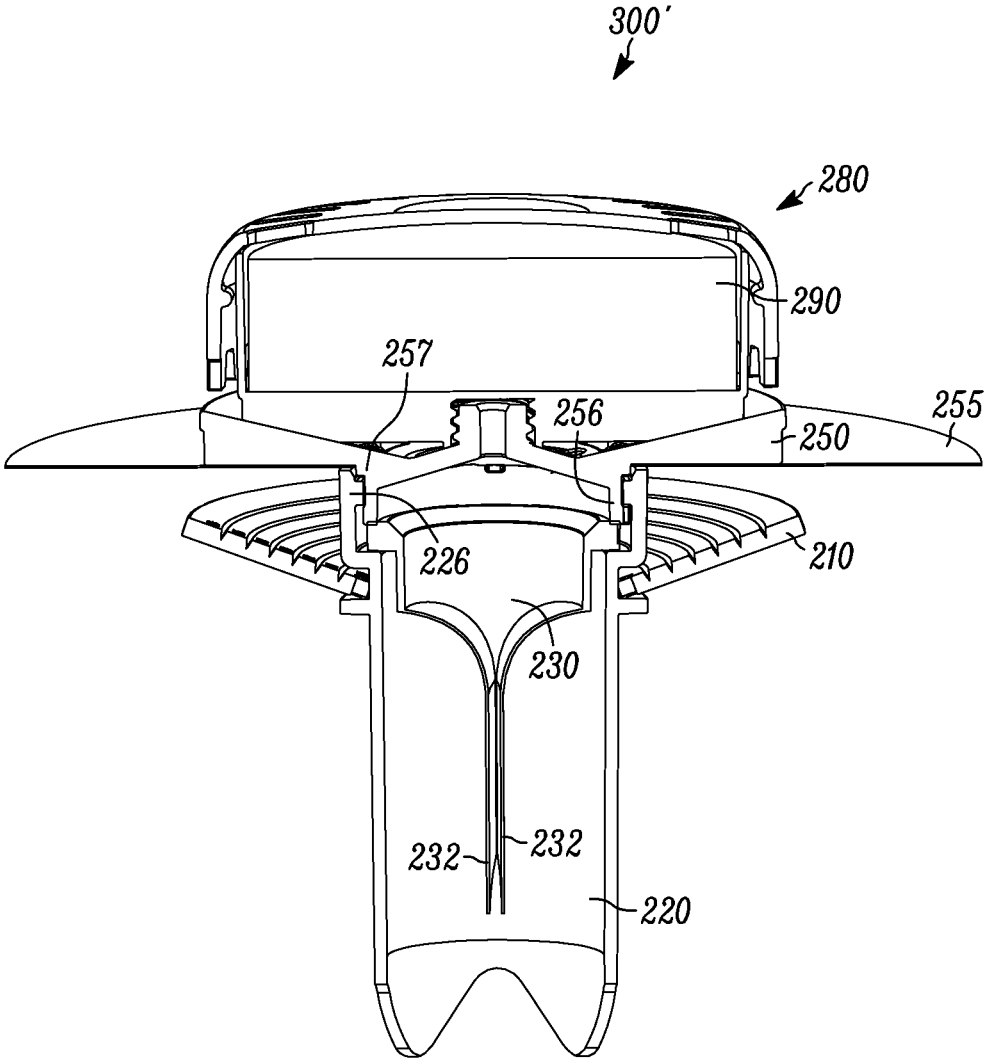
FIG. 27 illustrates a cross-sectional view of the fixture drain insert assembly taken along the line XXVII-XXVII of FIG. 26.

FIG. 27 illustrates a cross-sectional view of the fixture drain insert trap assembly 300' taken along the line XXVII-XXVII of FIG. 26. Material support module 280 contains material 290, which may be a block, gel or liquid material containing a fragrance, enzyme/bacteria or other cleaning/deodorizing agent. Material support module 280 is secured to trap cover 250 at securing components 258 and 288. In the embodiment shown, securing component 288 (on material support module 280) is a threaded female component into which securing component 258 (on trap cover 250), a threaded male component, is threaded. Other securing structures, however, may be used.

Trap cover 250 with interlocking structures 256 on inner diameter 257 are joined with corresponding interlocking structures 226 on housing support 220 in a bayonet mount style. Elastomer trap 230 with two flaps 232 is secured between trap cover 250 and housing support 220, and drain cover skirt 255 is secured around inner diameter 257 of trap cover 250.

Figure 28:
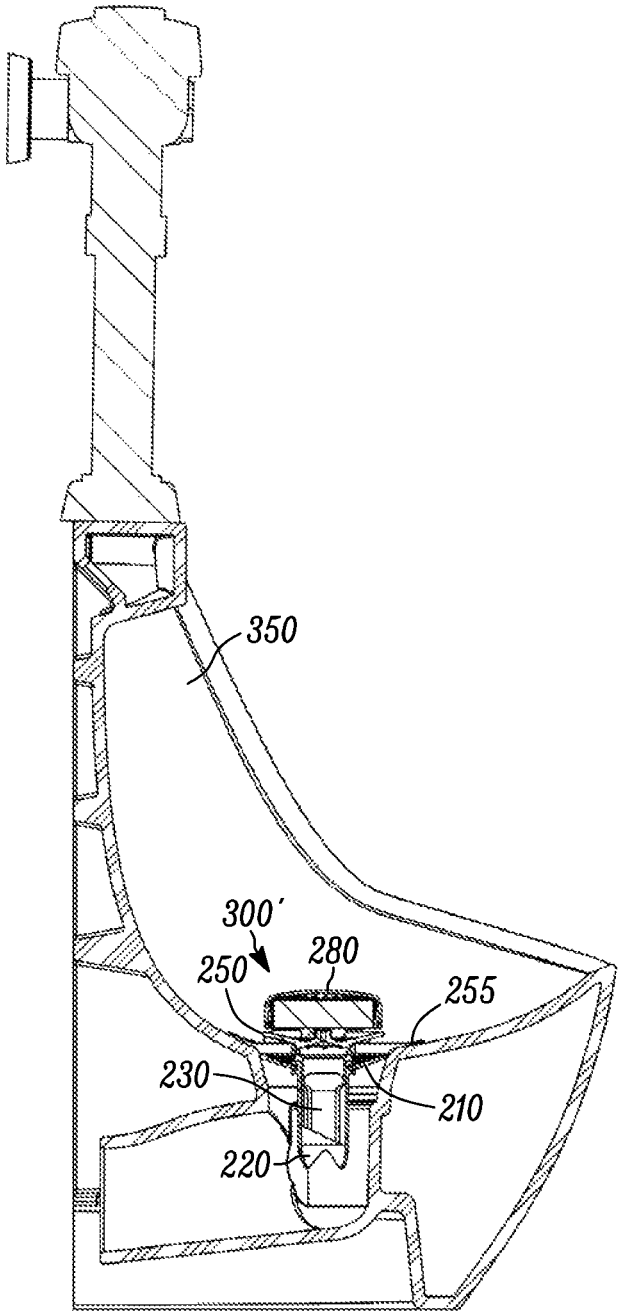
FIG. 28 illustrates a cross-sectional view of the fixture drain insert assembly inserted in a urinal drain taken along the line XXVIII-XXVIII of FIG. 23.

FIG. 28 illustrates a cross-sectional view of the fixture drain insert trap assembly 300' inserted in a urinal 350 taken alone the line XXVIII-XXVIII of FIG. 23. Material support module 280 projects into the basin of urinal 350 and is visible. Trap cover is secured underneath material support module 280 outside of the urinal drain with drain cover skirt 255 creating a liquid seal around the drain. Gasket 210, secured to housing support 220, creates a gas tight seal from under the urinal drain. Elastomer trap 230 is secured between housing support 220 and trap cover 250.

In the exemplary embodiment shown, as liquid (i.e., water, urine, etc.) flows enters the urinal basin, the liquid passes through drain apertures 259 of trap cover 250, through elastomer trap 230 and out housing support 220. Elastomer trap 230 acts as a one-way valve permitting only the passage of liquid downward through its flaps 232 and preventing the backup of liquid or gas through elastomer trap 230. Gasket 210 and drain cover skirt 255 further prevents gases and liquids from escaping back up the urinal drain. Drain cover skirt 255 also directs liquids to drain apertures 250 of trap cover 250 so that the liquids (i.e., urine, water) are directed through elastomer trap 230.

Figure 29:
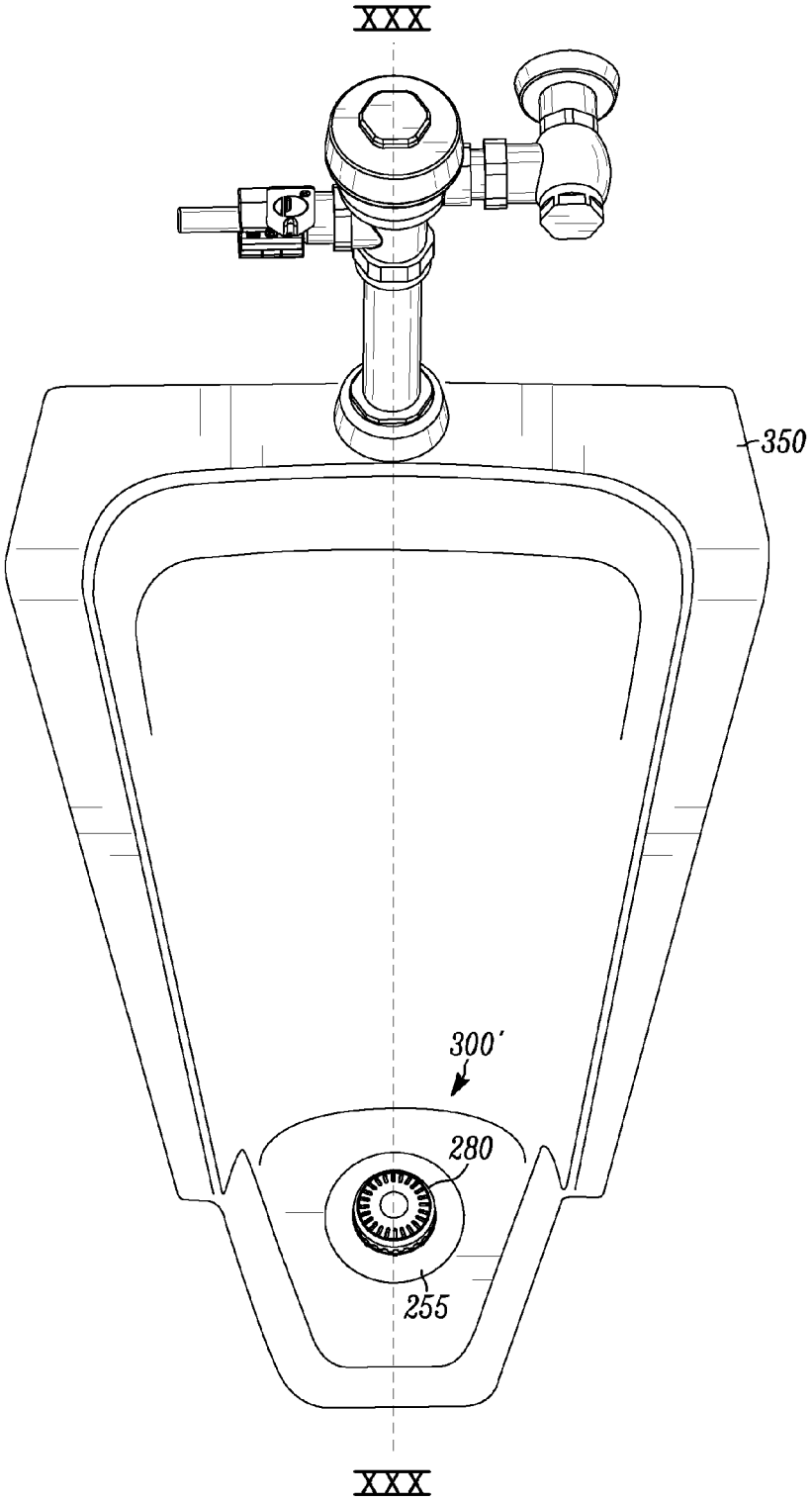
FIG. 29 illustrates a perspective view of the fixture drain insert assembly inserted in a floor mounted urinal.
Figure 30:
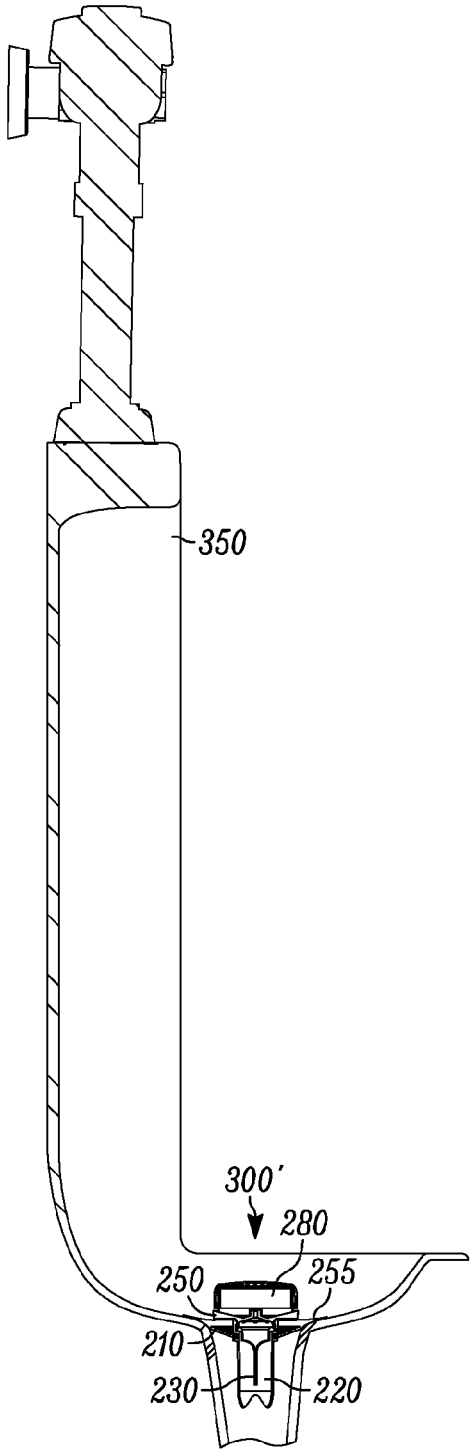
FIG. 30 illustrates a cross-sectional view of the fixture drain assembly inserted in a floor mounted urinal taken along the line XXX-XXX of FIG. 29.

While in the exemplary embodiments above fixture drain insert assembly 300/300' have been shown in use with wall-mounted urinals, fixture drain insert assemblies 300/300' may be used with other fixtures, including, but not limited to, floor mounted urinals, such as depicted in FIGS. 29-30. FIGS. 29-30 illustrate fixture drain insert assembly 300' with material support module 280 and drain cover skirt 255 secured in a floor mounted urinal 350.

Figure 31:
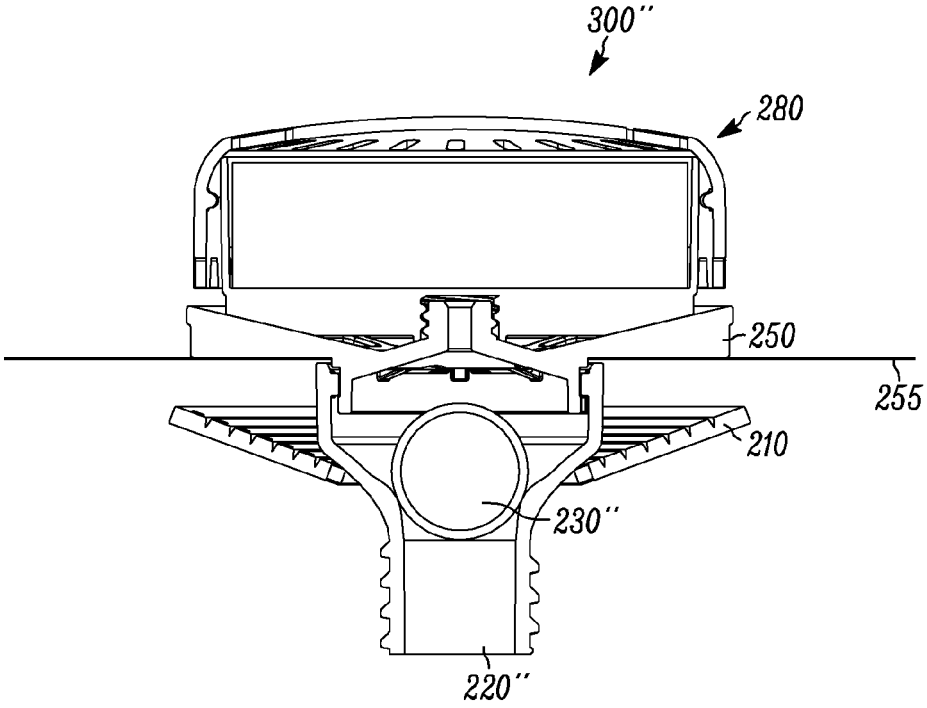
FIGS. 31-36 illustrate alternative embodiments of a fixture drain insert assembly in use with various types of traps.
Figure 32:
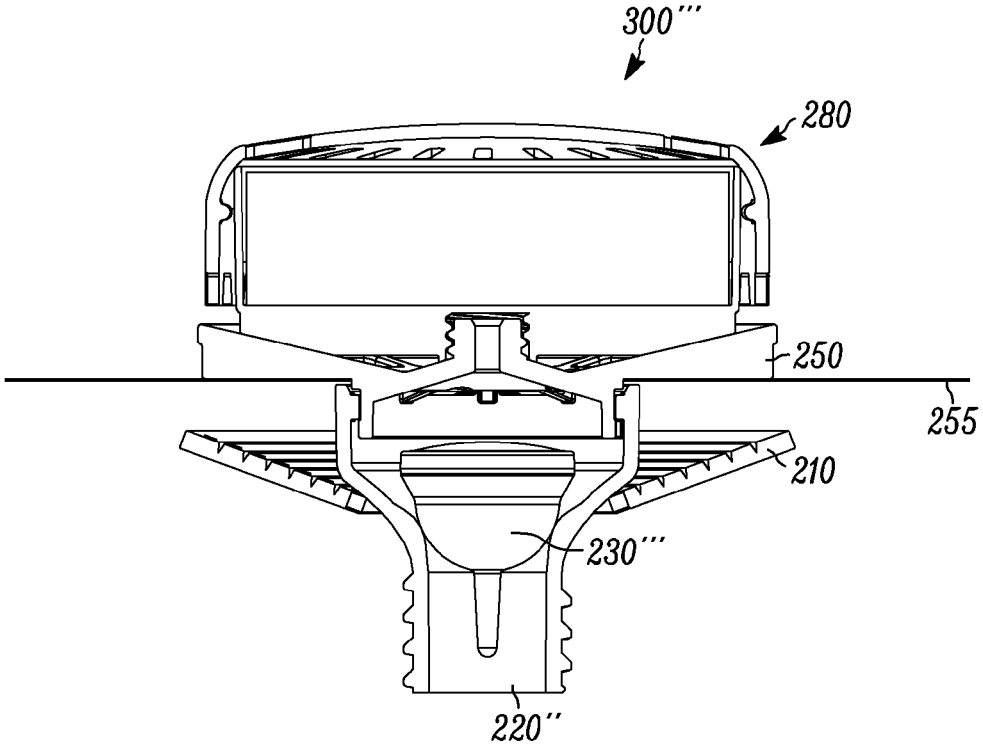
Figure 33:
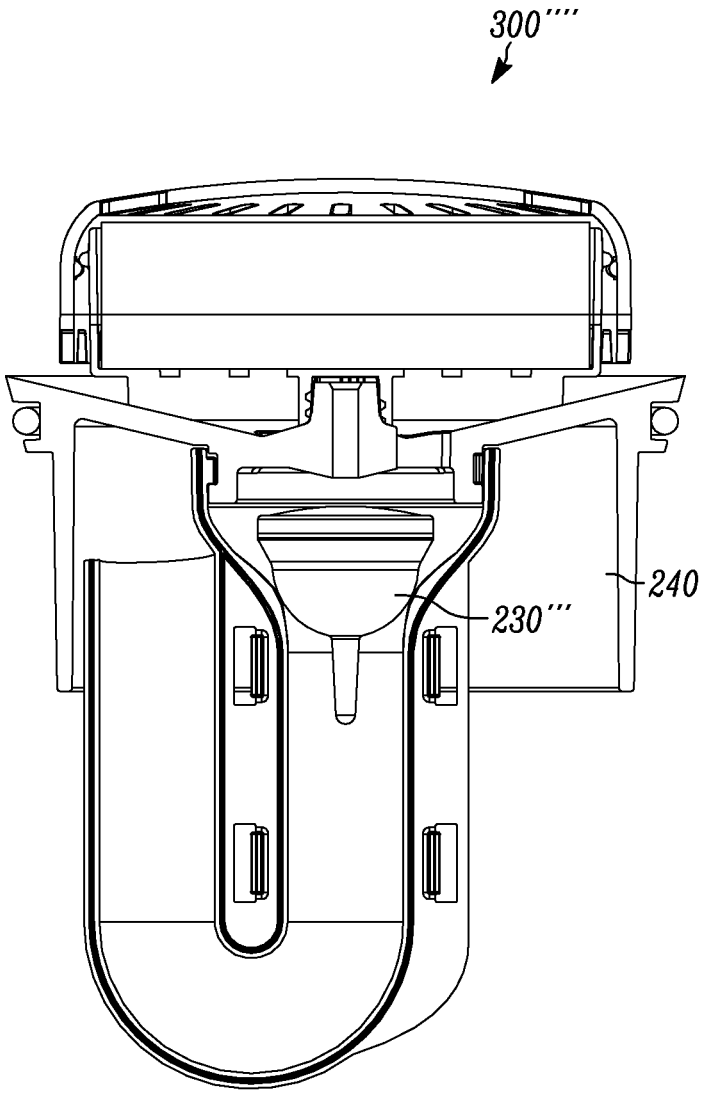

FIGS. 31-36 illustrate alternative embodiments of a fixture drain insert assembly. In FIG. 31, fixture drain insert trap assembly 300" is as shown in FIGS. 23-30, but uses a ball valve 230" instead of elastomer trap 230. In the exemplary embodiment shown, housing support 220" is threaded; however, it is to be understood that housing support 220 may be any shape or include threads or other securing structures to be configured for insertion into a given drain style. In the embodiment illustrated in FIG. 32 fixture drain insert assembly 300'" uses a bulb valve 230'" instead of elastomer trap 230. As illustrated in FIG. 33, different styles of valves (i.e., elastomer trap, ball valve, bulb valve) may be used with different styles of existing traps. In the embodiment shown in FIG. 34, fixture drain insert trap assembly 300"" with bulb valve 230''' uses trap housing 240, as shown with FIGS. 17-22, and is shown in a J-trap design. However, it should be understood that the different fixture drain insert assembly embodiments (i.e., trap housing style and trap cover/drain cover skirt style) may be used with a variety of valves and therefore be configured for use in a variety of drain/trap styles.

Figure 34:
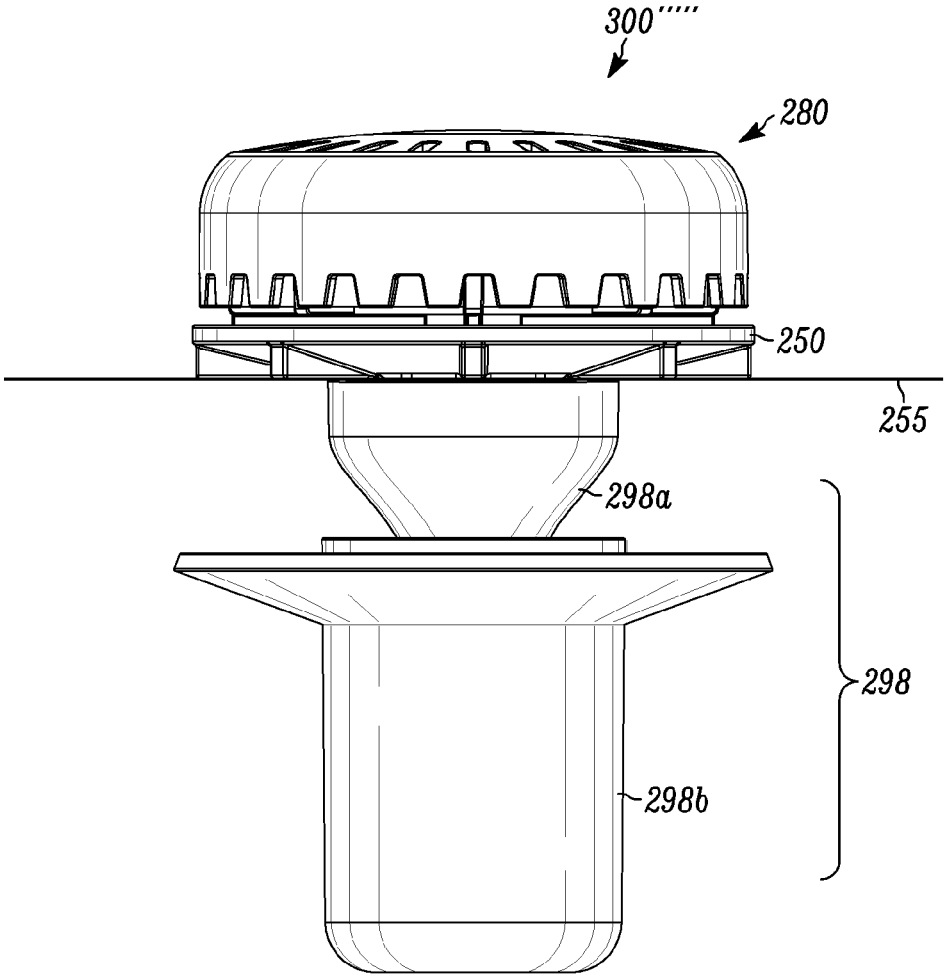
Figure 35:
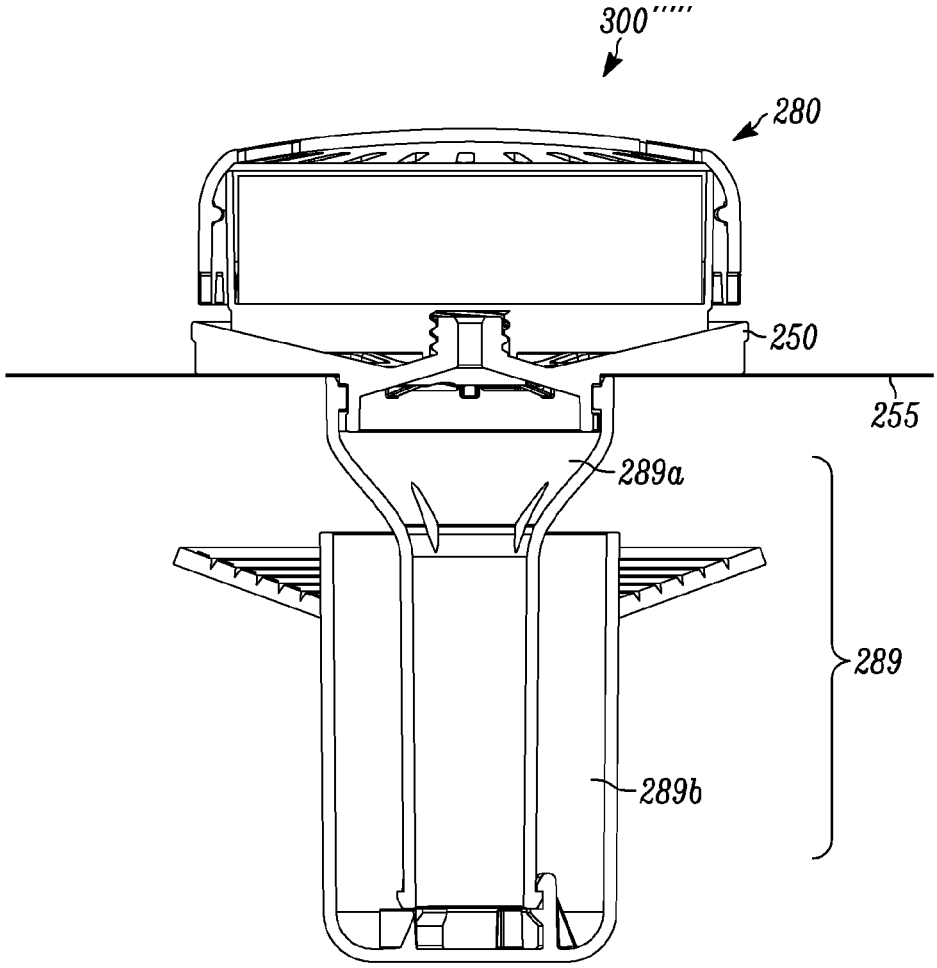
Figure 36:
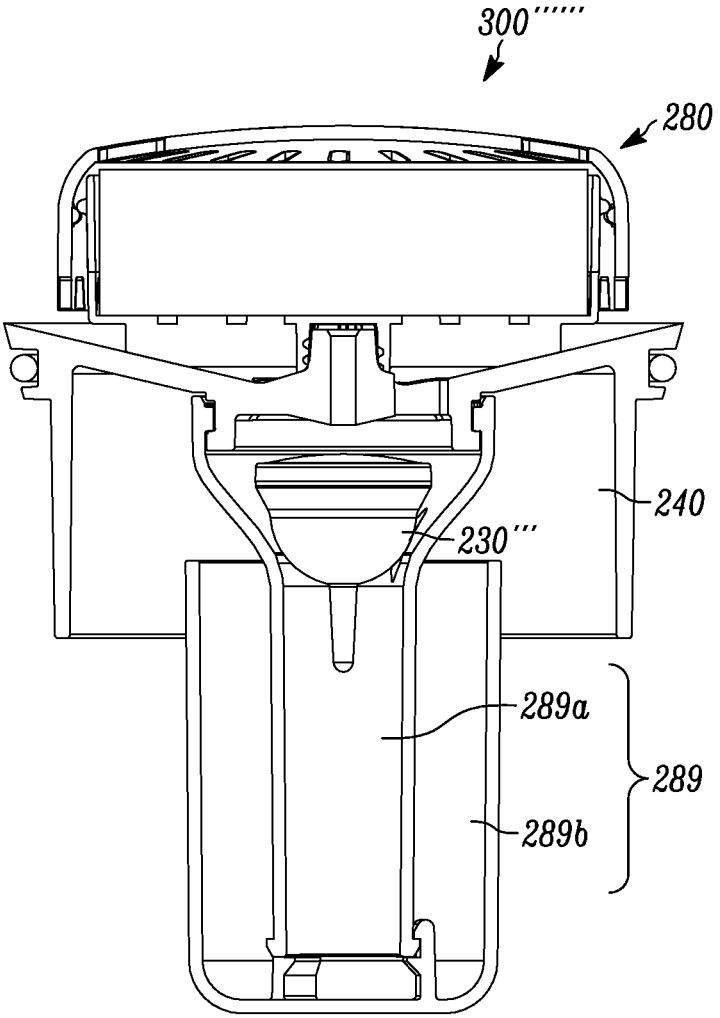

FIGS. 34-36 illustrate an exemplary fixture drain insert trap assembly 300""" as used with a two-inch code valve (298*a*, 298*b*). The embodiment in FIGS. 34-35 uses a trap cover 250 with drain cover skirt 255, while the embodiment in FIG. 36 uses a trap housing 240 with a bulb valve 230'''.

In the exemplary embodiments described above, the embodiments of the fixture drain insert trap assembly are described for use with various valve, trap and drain styles. It is understood that assemblies described herein may be used with any valve and trap known in the art, including, but not limited to, elastomer valves comprising at least two flexible flaps, ball valves, bulb valves, two-inch code valves, J-traps, and S-traps.

Adjustable Fixture Screen System

In some embodiments, fixture system 500 can also include an adjustable urinal screen system 810, with or without fixture drain trap insert assembly 300 or handle lock assembly 100.

An embodiment of an adjustable urinal screen system 810 according to the disclosure is described with reference to FIGS. 37-38. While the embodiments described herein illustrate the use of adjustable urinal screen system 810 with a urinal, it is understood that urinal screen system 810 may be used with other fixtures containing drains (e.g., sinks) to prevent debris and other matter from clogging a drain or pipe and cover standing used liquid.

Figure 37:
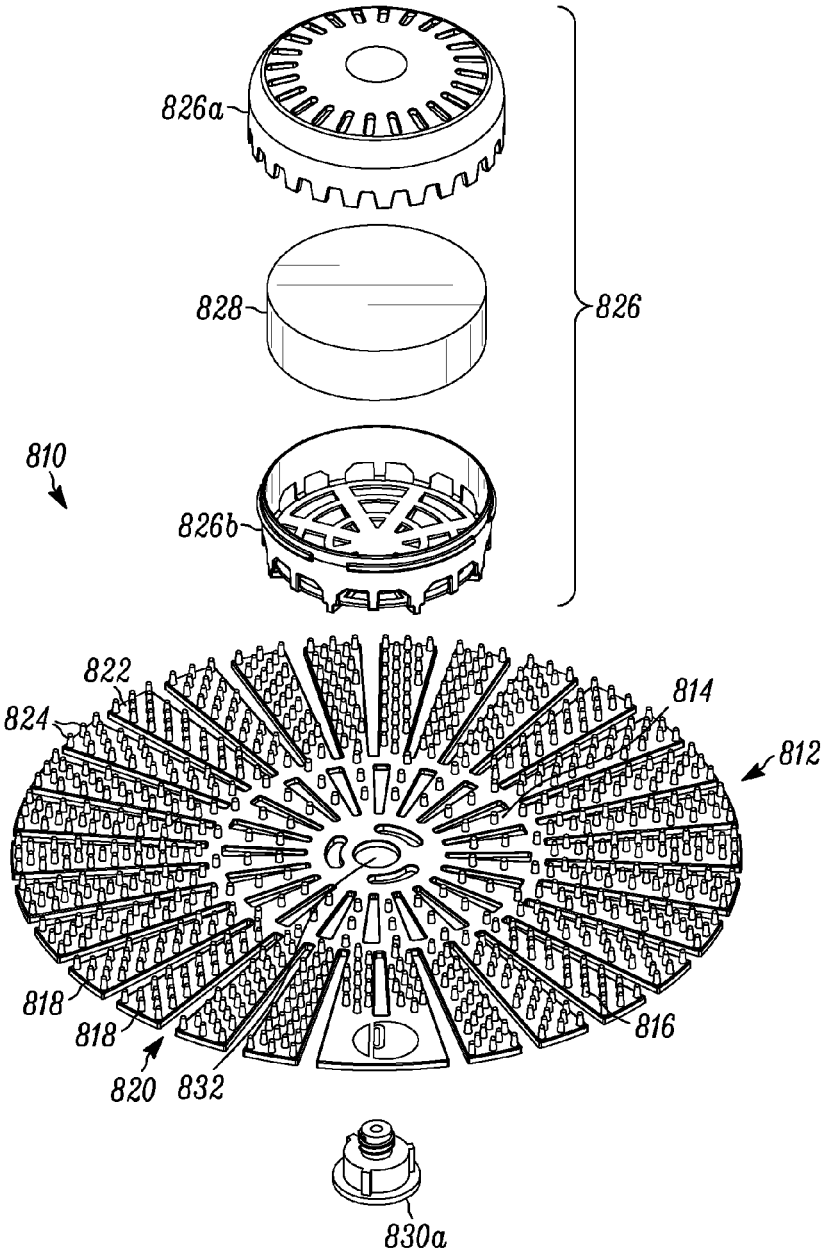
FIG. 37 is a perspective exploded view of an embodiment of an adjustable urinal screen system according to the disclosure.
Figure 38:
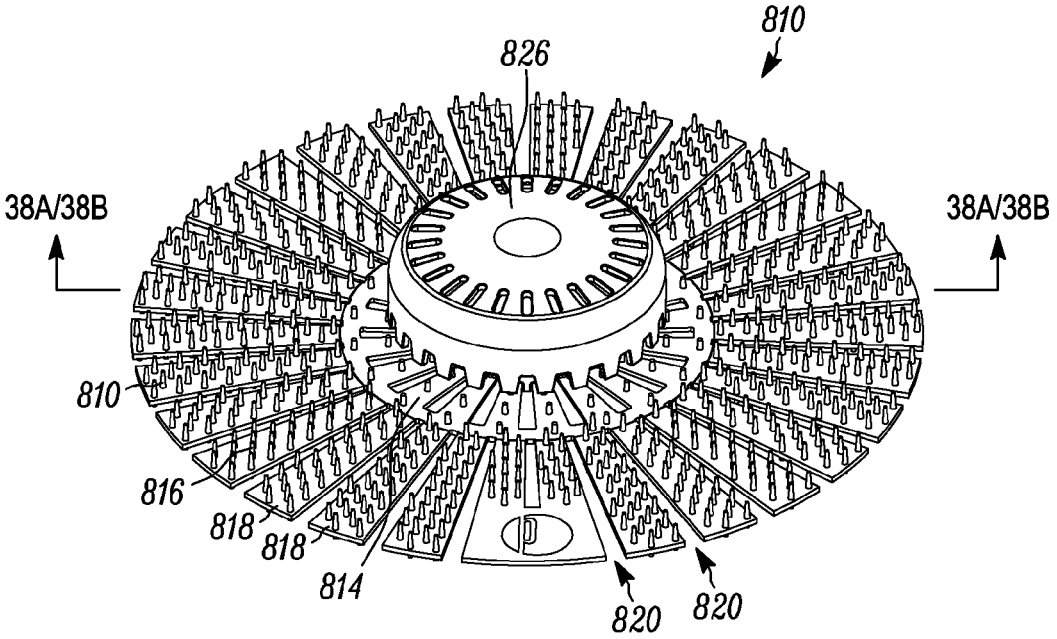
FIG. 38 is a perspective view of the assembled adjustable urinal screen system of FIG. 37.

Referring to FIG. 37, the adjustable urinal screen system 810 comprises a flexible screen 812 in a generally circular configuration comprising a center portion 814 and a contiguous outer portion 16 connected to and encircling the center portion 814. While flexible screen 812 is shown as primarily circular in configuration in the exemplary embodiments illustrated, in further embodiments, flexible screen 812 may have a triangular, rectangular or other configuration provided outer portion 816 was always in physical contact with a fixture surface to prevent debris from entering the drain at all angles.

The outer portion 816 is configured as one or more elongated strips 818 extending outwardly from the center portion 814. The strips 818 are adjacently positioned with narrow slits 820 therebetween. This configuration of the outer portion 816 as one or more strips 818 allows the screen 812, when positioned over the drain of a urinal, to substantially adapt and conform to the contours of the urinal surface and prevent passage of debris into the drain.

Figure 39:
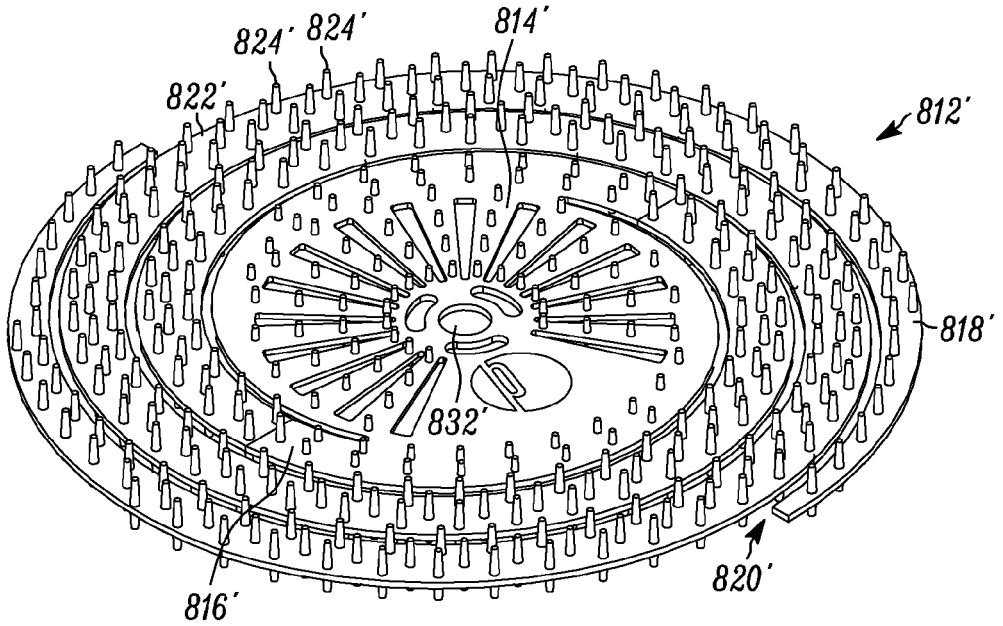
FIGS. 39 and 40 are perspective views of other embodiments of a flexible screen for an adjustable urinal screen system.
Figure 40:
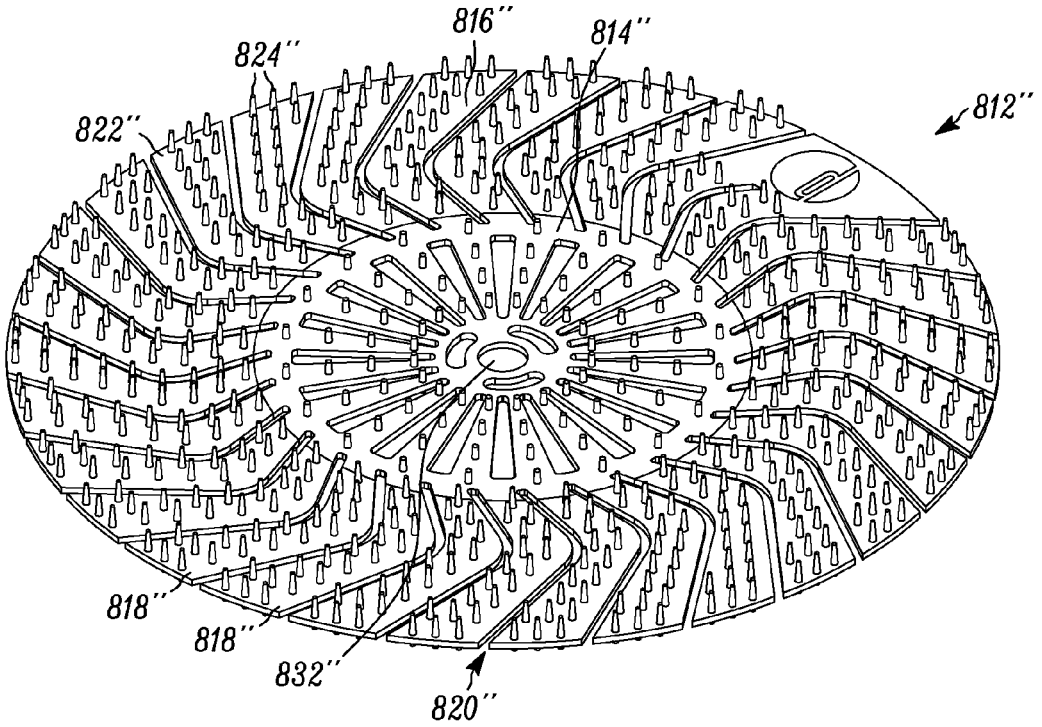

For example, as illustrated in FIG. 37, the outer portion 816 of the urinal screen 812 can be constructed as a plurality of elongate strips 818 that extend radially outward from and in a perpendicular orientation to the center portion 814. Other exemplary embodiments are illustrated in FIGS. 39 and 40. Optionally, as shown in FIG. 37, for example, the surface 822 of one or more of the elongated strips 818 can include multiple protrusions 824 which function to collect debris in use of the urinal screen.

The screen 810 can be manufactured from a variety of flexible materials, for example, a polymeric-based material, silicone, thermoplastic elastomers, thermoplastic olefinic elastomers, and other materials known in the art by compression molding, injection molding or other process known and used in the art. In some embodiments, that material from which adjustable screen 810 is made may contain or include a fragrance, antibacterial/antimicrobial agent or other treatment.

Figure 38A:
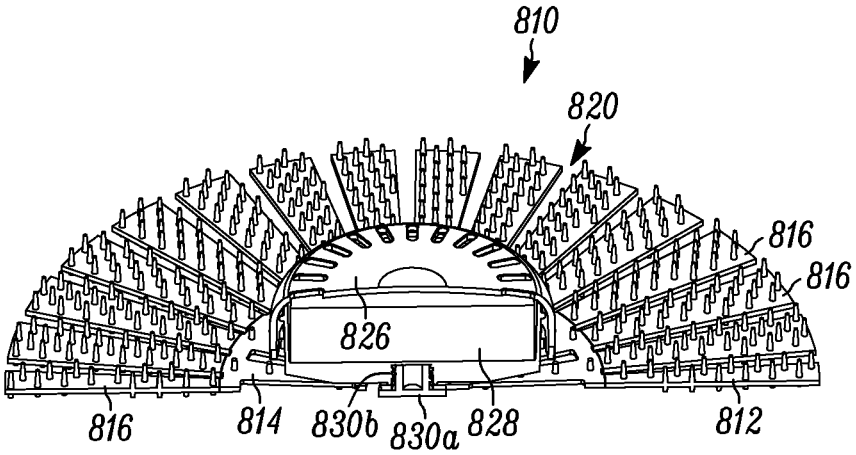
FIG. 38A is a perspective, cross-sectional view
Figure 38B:
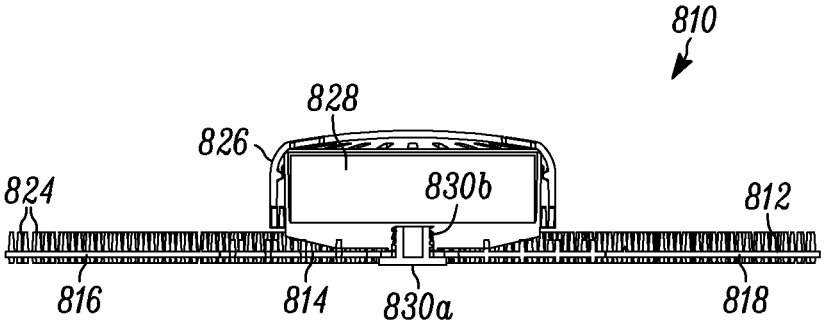
FIG. 38B is an elevational cross-sectional view of the adjustable urinal screen system of FIG. 38, taken along lines 38A/38B.

In embodiments, the screen 812 can be used in combination with a module 826 configured for containing an enzyme (cleaner) or fragrance (deodorizer) material 828. As illustrated in FIG. 37, the module 826 includes a cover portion 826*a* and a base portion 826*b*. The module 826 can be positioned over and attached to the screen 812 by means of a fastening element 830*a* (e.g., a threaded fastener) inserted through a center hole 832 within the center portion 814 of the screen, which engages with a mating element 830*b* (e.g., threaded opening) in the base section 826*b* of the module 826, as further shown in FIGS. 38A-38B. In an embodiment, the fastening element 830*a* comprises external threads and the base section 826*b* of the module 826 comprises internal threads, and the fastening element and the module are connected in a threaded engagement.

In another embodiment, as depicted in FIG. 39, the outer portion 816' of the screen 812' can be one or more elongated strips 818' in a spiral configuration. In yet another embodiment, as depicted in FIG. 40, the outer portion 816" of the urinal screen 812" can constitute a plurality of strips 818" in a zigzag or bent configuration that extend outwardly from the center portion 814". In embodiments, the zigzagged strips 818" comprise a plurality of bent arm portions connected together at an angle.

Figure 41:
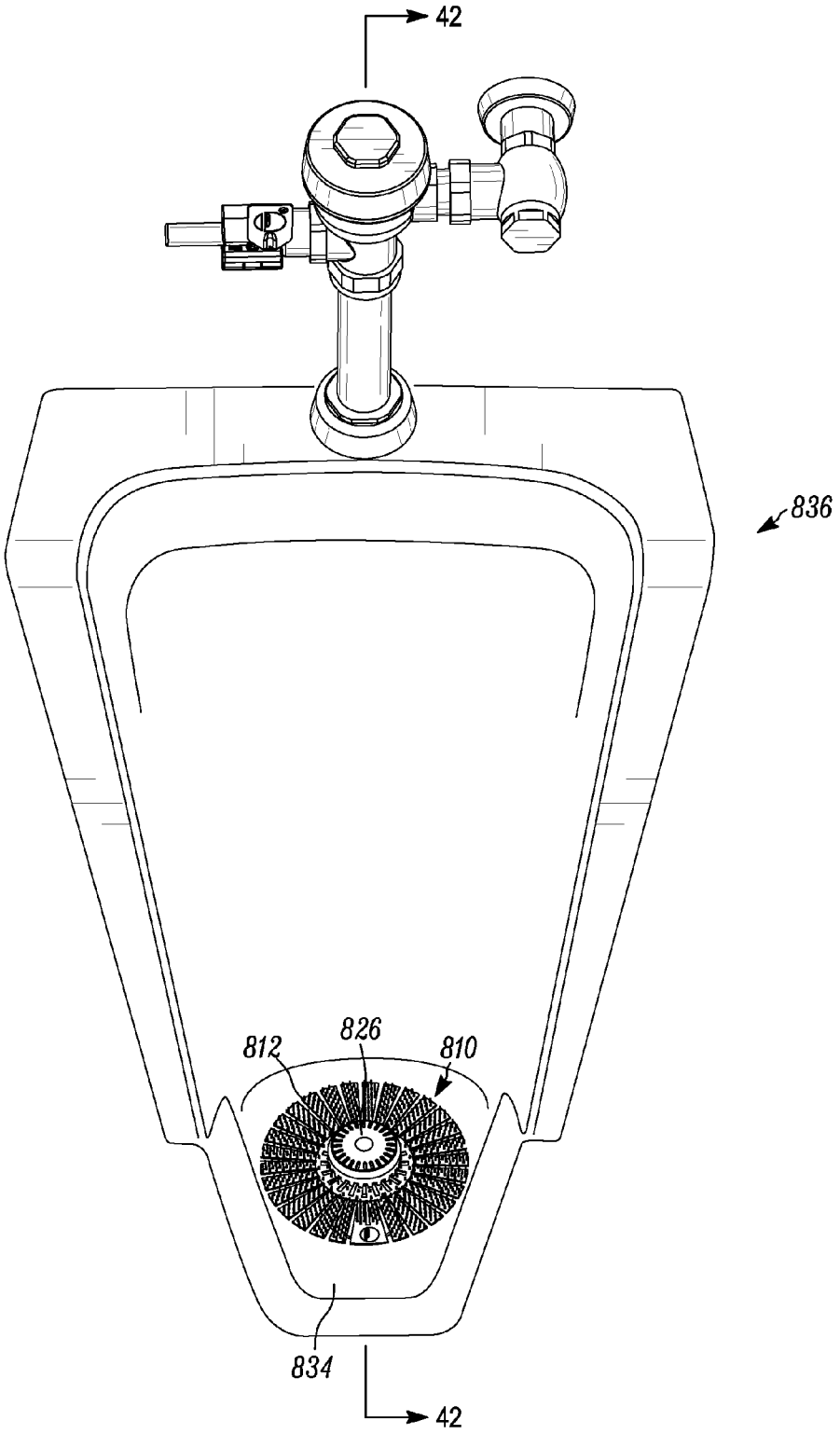
FIG. 41 is a perspective view of the adjustable urinal screen system of FIG. 37 installed over a drain of an embodiment of a floor mount urinal.
Figure 42:
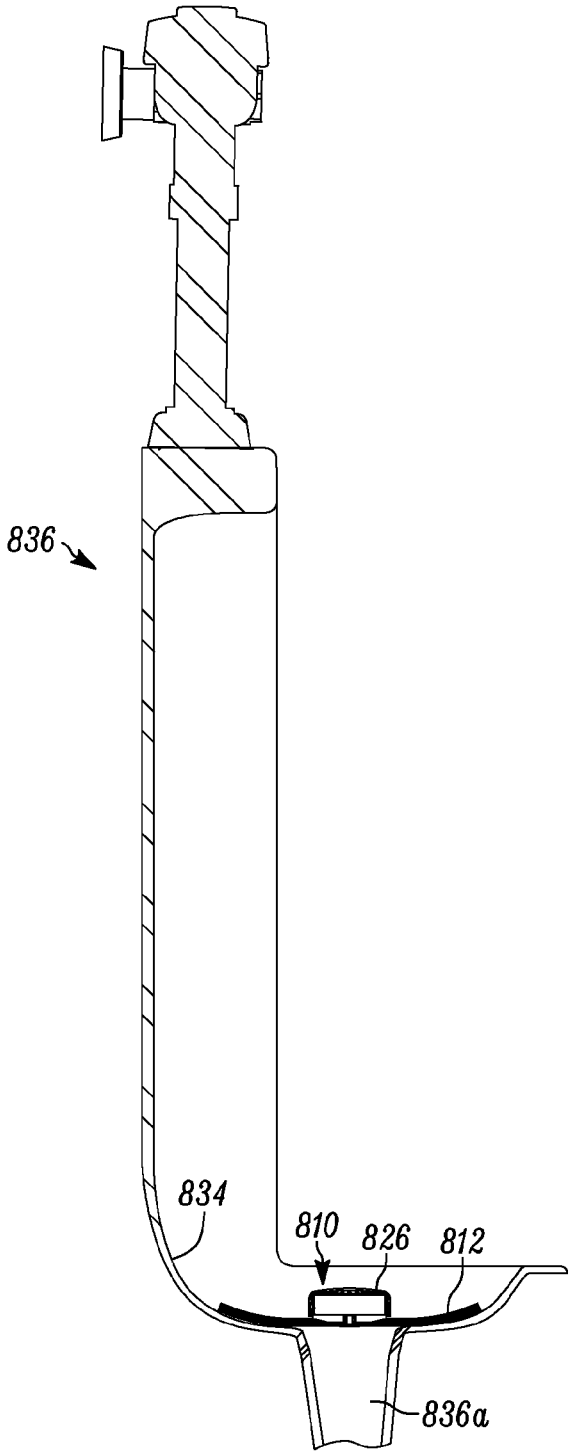
FIG. 42 is an elevational, cross-sectional view of the floor mount urinal and adjustable urinal screen system of FIG. 41.
Figure 43:
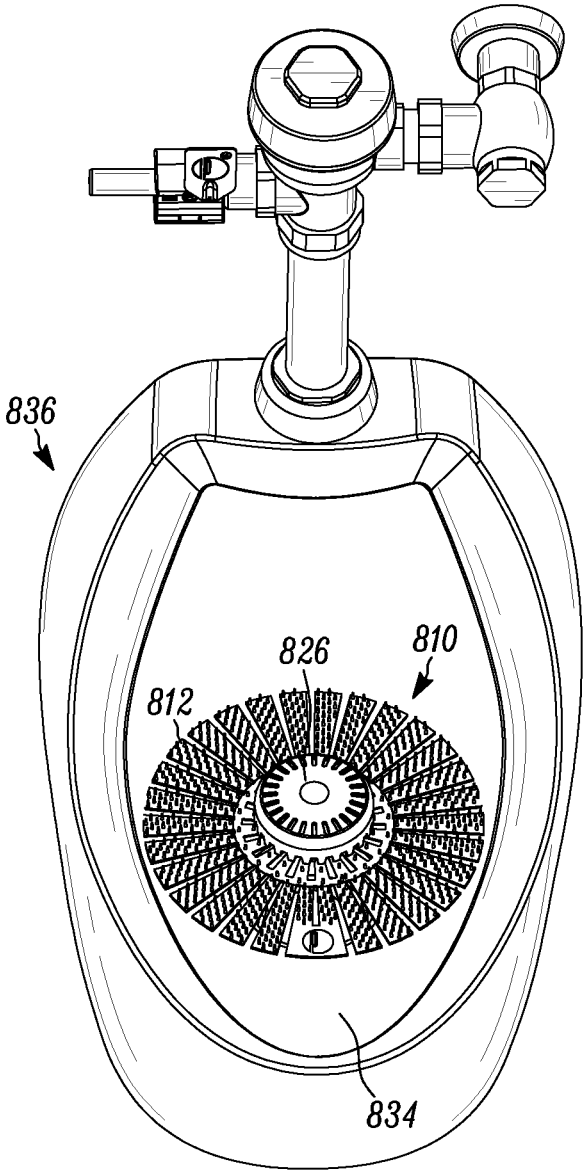
FIG. 43 is a perspective view of the adjustable urinal screen system of FIG. 37 installed over a drain of an embodiment of a pedestal urinal.
Figure 44:
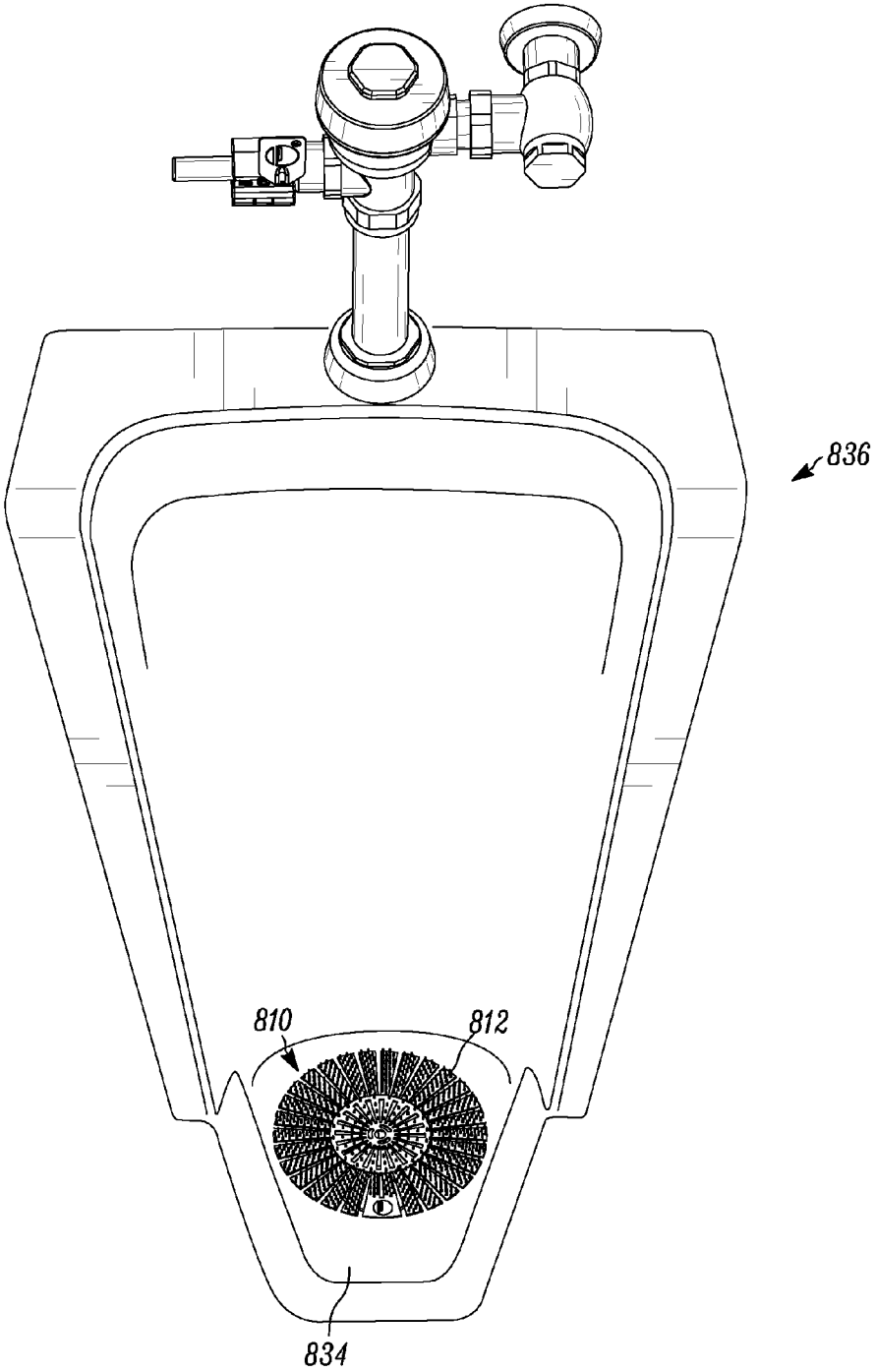
FIG. 44 is a perspective view of a flexible screen for an adjustable urinal screen system installed over a drain of an embodiment of a floor mount urinal.

Referring to FIGS. 41-44, in use, the adjustable screen 810 is adaptable to conform to the contours of the surface 834 of a urinal 836 or other substrate. FIGS. 41, 42 and 44 illustrate adjustable screen 810 in use with a floor mounted urinal 836, while FIG. 43 illustrates adjustable screen 810 in use with a wall mounted urinal 836. As depicted in FIGS. 37 and 38, the screen 812 can have a substantially flat or planar configuration when positioned on a flat surface but will substantially conform to the contours of the substrate surface, as shown in FIGS. 41-42.

As depicted in FIGS. 41-42, the adjustable screen assembly 810 composed of the screen 812 with the attached module 826 containing fragrance/cleaner can be used to screen the urinal drain 836*a* and to freshen the surrounding air. In other embodiments, as shown in FIG. 44, the screen 812 can be used alone over a urinal drain to screen debris from entering.

Figure 45:
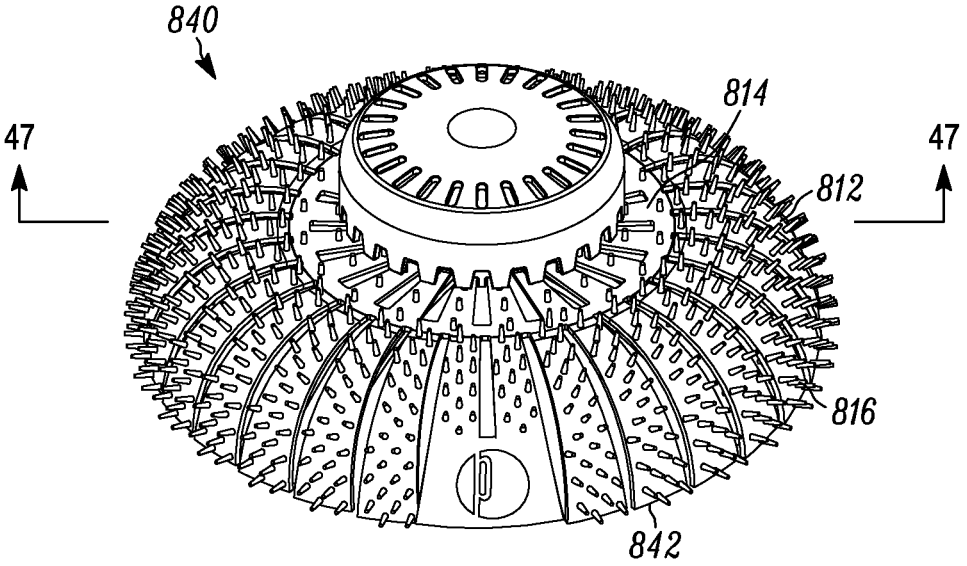
FIG. 45 is a perspective view of an embodiment of a domed screen assembly according to the disclosure in which the screen is mounted on an arched support.
Figure 46:
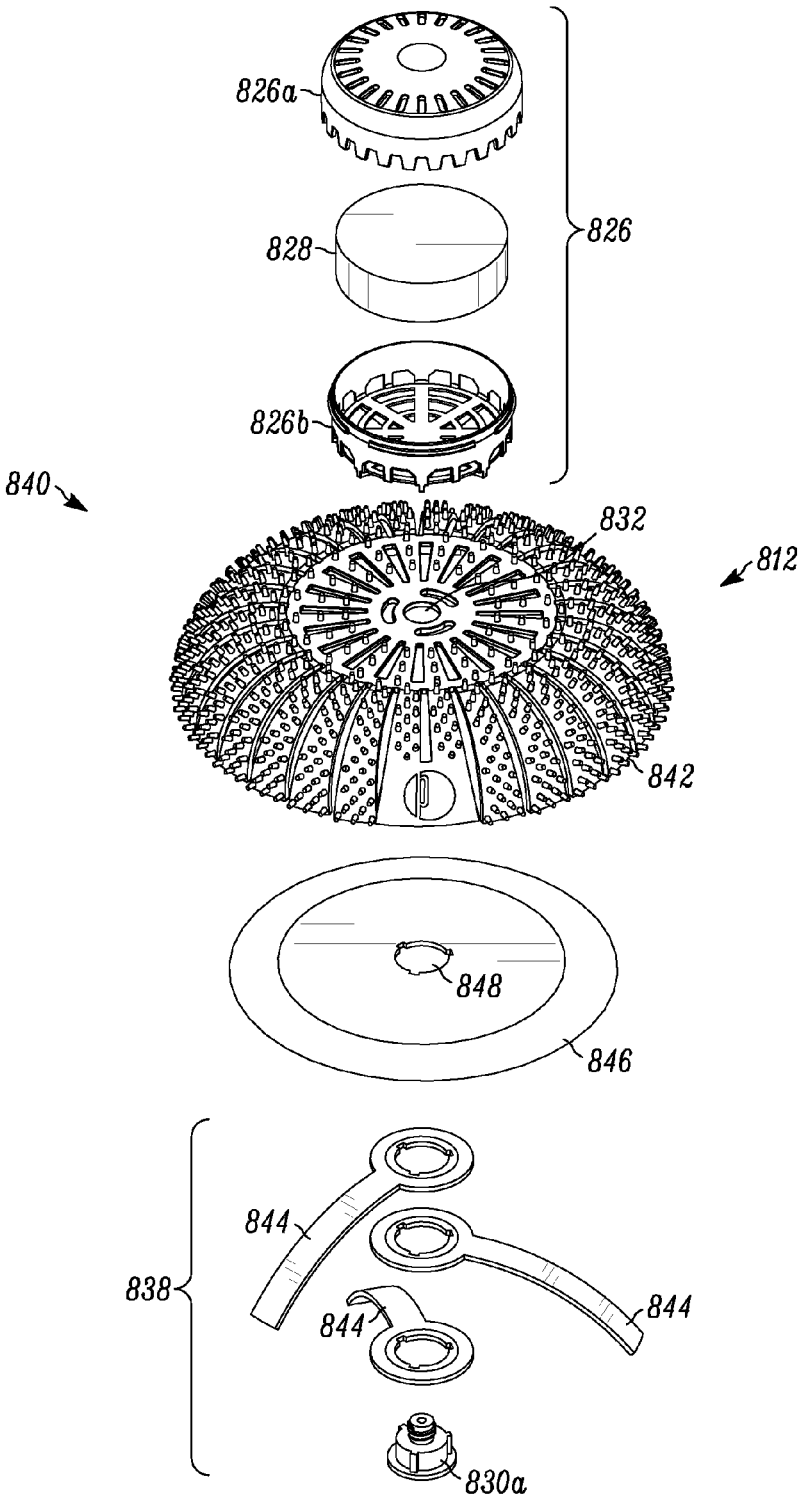
FIG. 46 is a perspective exploded view of the dome domed screen assembly of FIG. 45.
Figure 47:
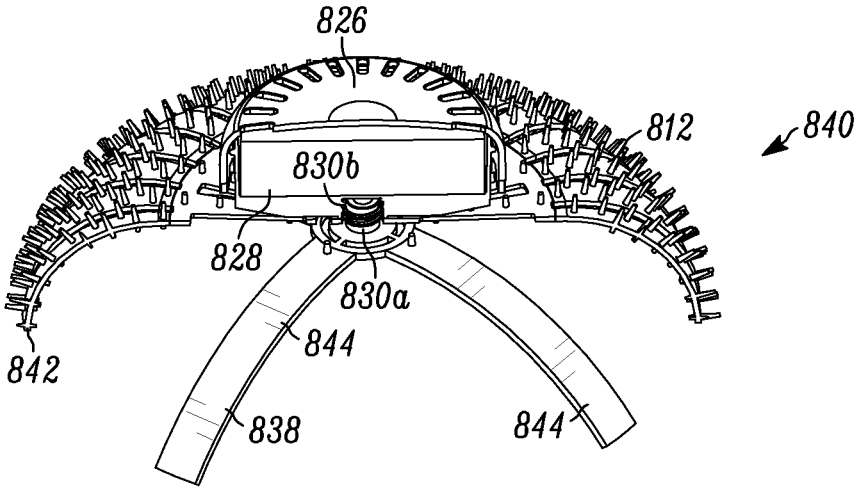
FIG. 47 is a cut-away view of the domed screen assembly of FIG. 45 taken along line 47-47.

Referring now to FIGS. 45-47, in other embodiments, the center portion 814 of the screen 812 can be elevated by use of an arched support stand 838 that is sized to be positioned under the screen to provide a domed screen assembly 840 with the screen 812 in a domed or mound-like configuration such that the perimeter edge 842 on outer portion 816 of the screen 812 can be placed in contact with a substrate surface. The use of a domed screen assembly 840 is advantageous for hiding unappealing urine if the urinal is not timely flushed or it has been converted to a "low flush" system to reduce water usage.

Figure 48:
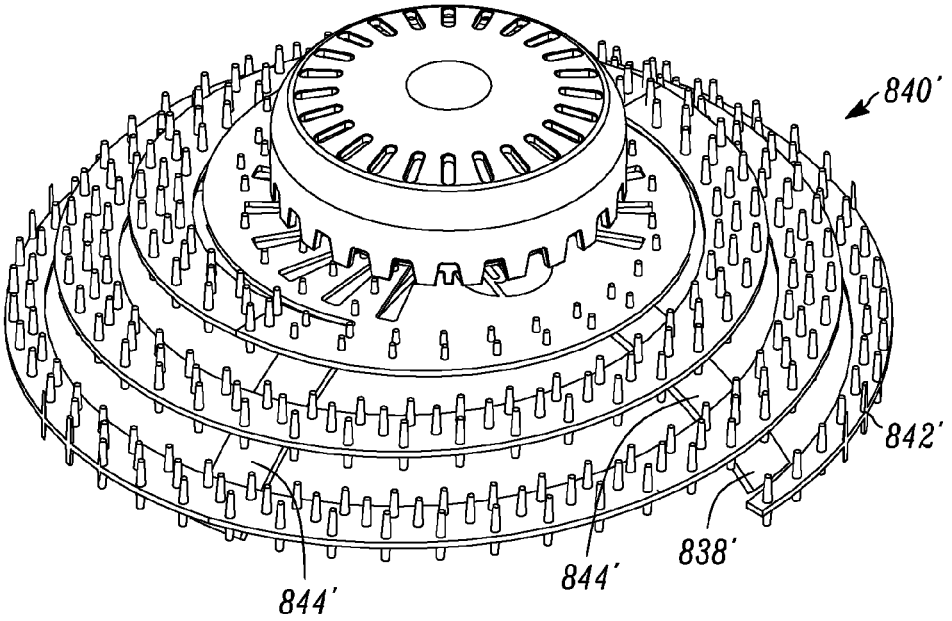
FIGS. 48 and 49 are perspective views of the domed screen assembly utilizing other embodiments of the flexible screen.
Figure 49:
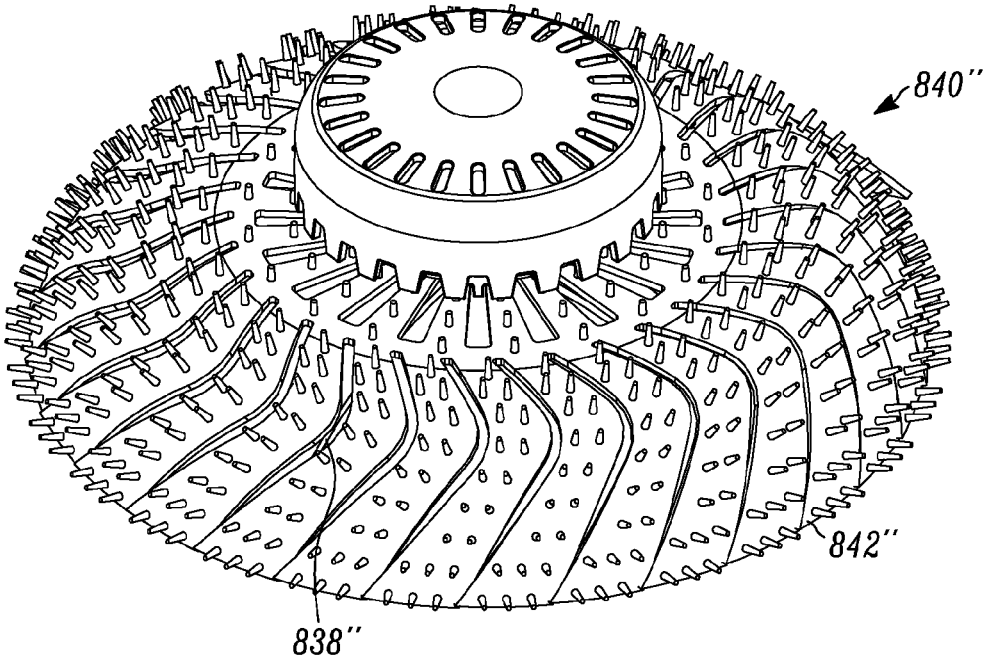

In one embodiment, the arched support stand 838 is composed of a plurality of arched leg sections 844 as depicted in FIGS. 46-47, which are attached together under the screen 812 and to the overlying fragrance/cleaner module 826 by means of a fastener 830*a*. The support stand 838 can be manufactured from a stiff material such as _polypropylene, polyoxymethylene, and other materials known in the art by injection molding and other processes known and used in the art. As shown in FIG. 47, the fastener 830*a* is inserted through center hole 832 within the center portion 814 of the screen 812, to engage the mating element 830*b* in the base section 826*b* of the fragrance/cleaner module 826. A support stand 838 can be used in combination with other embodiments of the screen, as illustrated in FIGS. 48-49.

In the exemplary embodiments shown, the arched leg sections 844 are specifically designed to provide the maximum height at weight center portion 814 of screen 812 may be elevated such that perimeter edge 842 maintains physical contact with a substrate surface around the entire circumference of screen 812. The maximum height is therefore dependent on the overall radius of screen 812 and the flexibility and/or rigidity of outer portion 816, as well as the size of corresponding arched support stand 838 (and leg portions 844 and/or domed center section 850 as in FIGS. 50-51). In further embodiments, support stand 838 and/or arched leg sections 844 or domed center section 850 (as seen in FIGS. 50-51) may be adjustable in height up to the maximum height.

Optionally, as shown in FIG. 46, a flexible, circular support structure 846 having a center opening 848 can be positioned between the adjustable screen 810 and the arched support 838. The circular support structure 846 can be fabricated from polypropylene, polyoxymethylene or other material known in the art.

Figure 50:
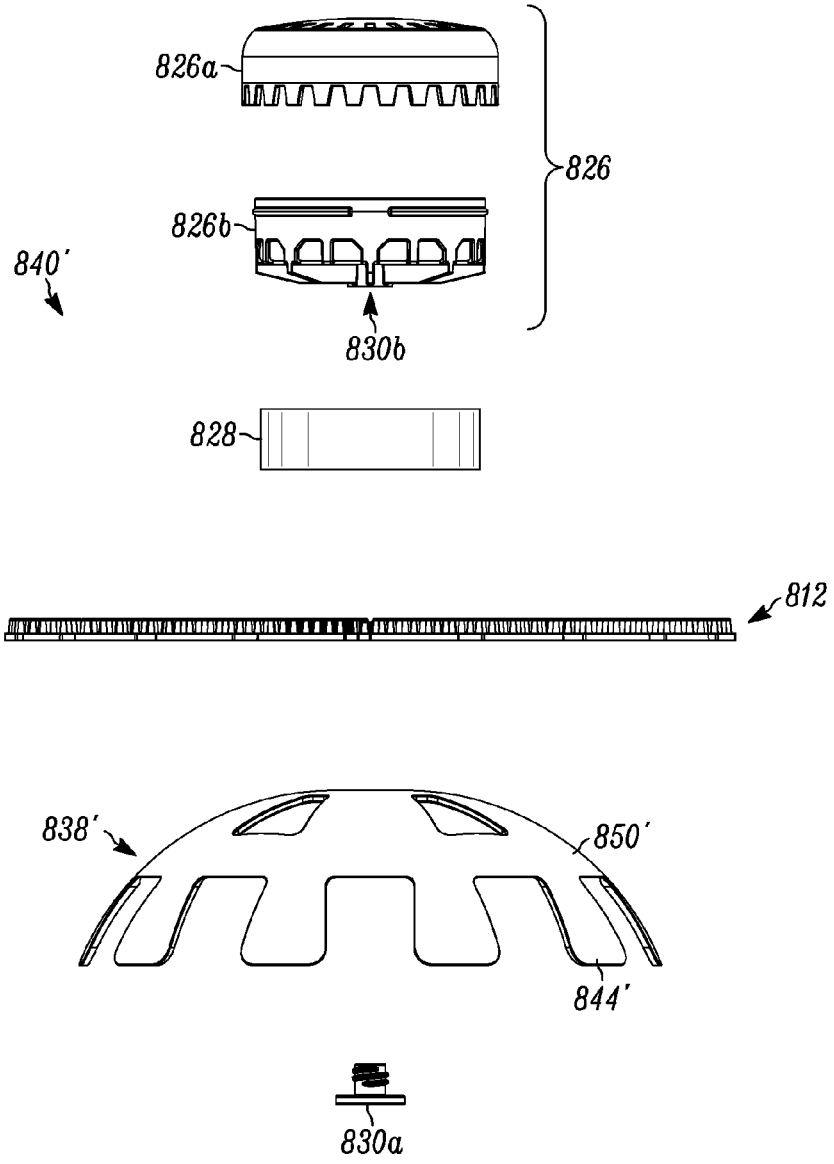
FIG. 50 is an exploded view of another embodiment of a domed screen assembly according to the disclosure.
Figure 51:
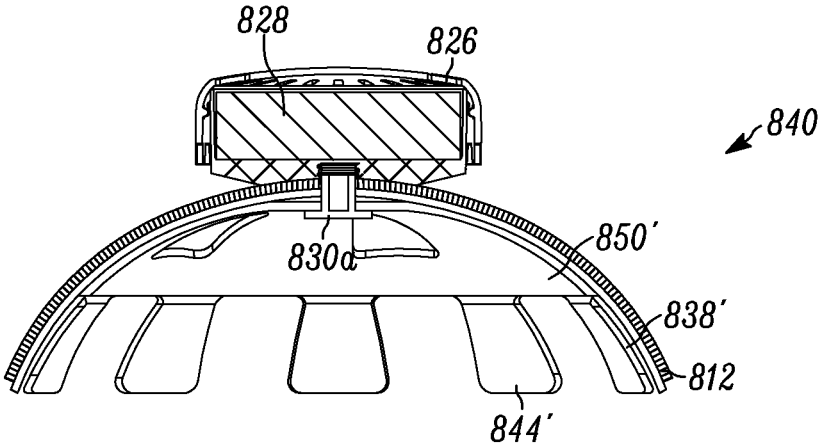
FIG. 51 is an elevational, cross-sectional view of the assembled domed screen assembly of FIG. 50.
Figure 52:
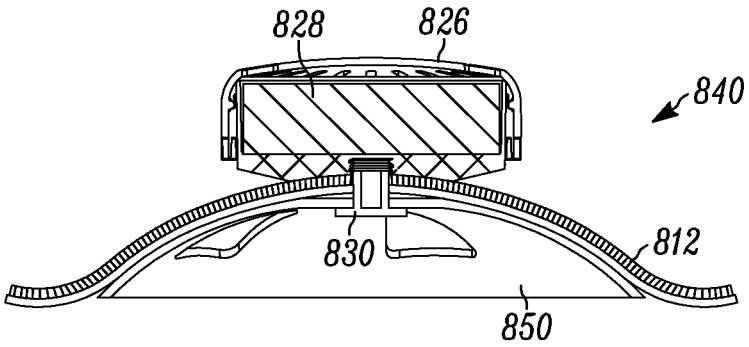
FIG. 52 is an elevational, cross-sectional view of the domed screen assembly of FIG. 51 with the leg sections having been removed.

In another embodiment depicted in FIGS. 50-51, the support stand 838' can be structured with leg portions 844' attached to a domed center section 850'. The leg portions 844' are configured to be removable to provide a domed screen arrangement at a lowered height, as shown in FIG. 52.

Figure 53:
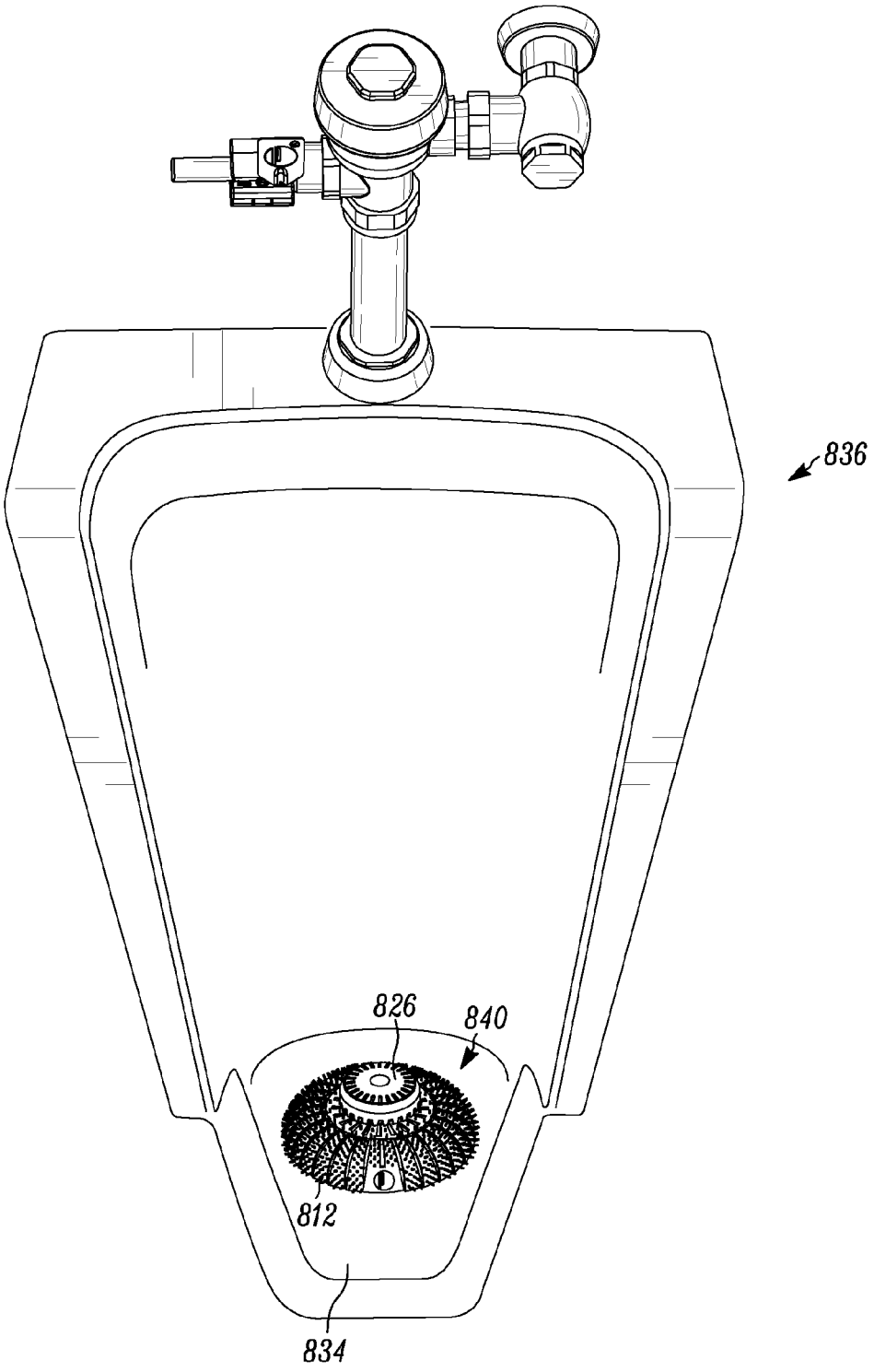
FIG. 53 is a perspective view of the domed screen assembly of FIG. 45 installed over a drain of an embodiment of a floor mount urinal.
Figure 54:
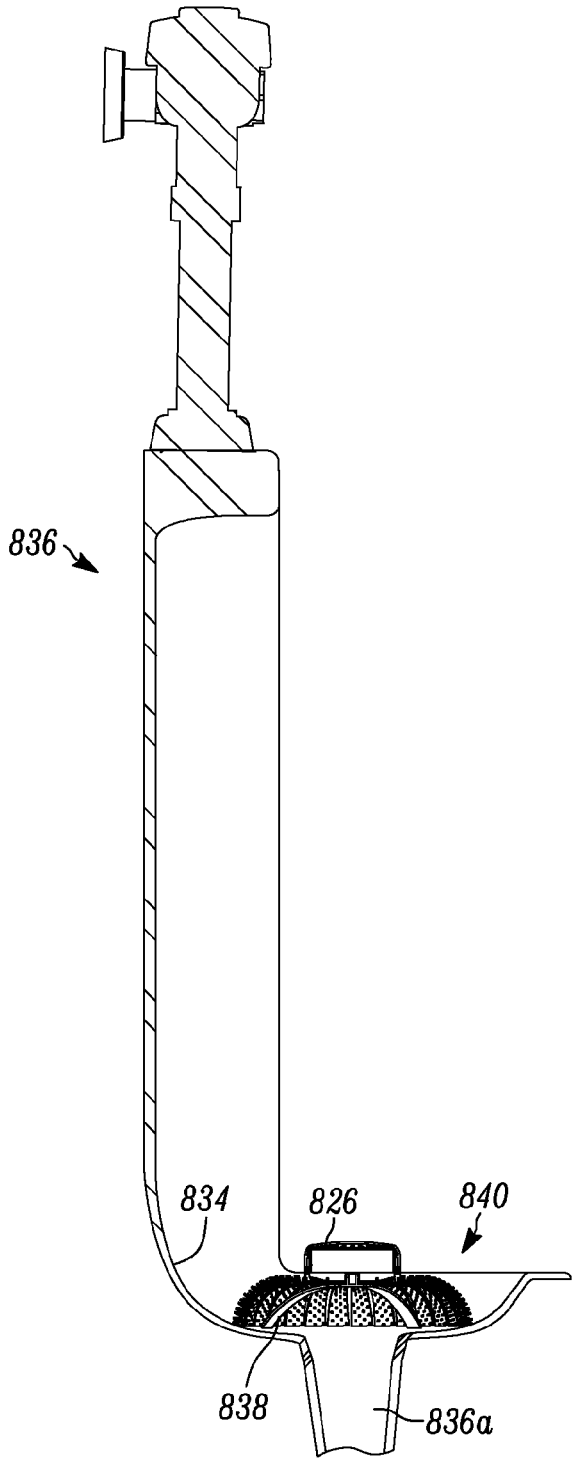
FIG. 54 is an elevational, cross-sectional view of the floor mount urinal and domed screen assembly depicted in FIG. 53.
Figure 55:
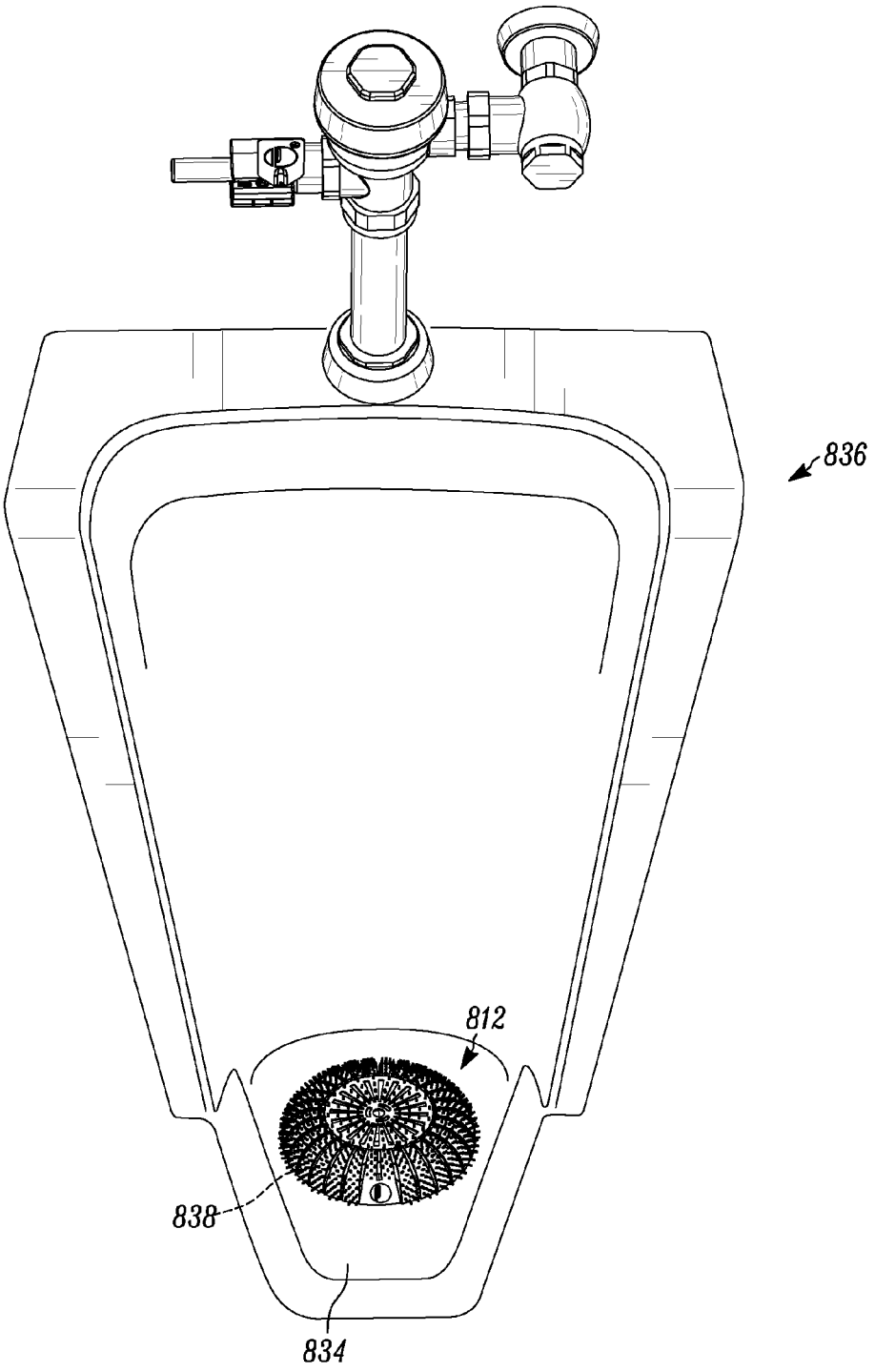
FIG. 55 is a perspective view of the domed urinal screen shown in FIG. 45 installed as a domed screen over a drain of an embodiment of a floor mount urinal.

In use, the domed screen assembly 840 can be installed over a drain 836*a* of a urinal 836 as depicted in FIGS. 53-54 showing the screen 812 with an attached fragrance/cleaner module 826. In other embodiments, as shown in FIG. 55, the domed screen 812 with an underlying arched screen support can be used alone over a urinal drain.

Method of Controlling Water Consumption with Fixture System

By using fixture system 500, water consumption may be controlled, reduced or nearly eliminated for fixtures on which the system 500 is installed. In some embodiments, the method comprises placing a handle lock assembly on a handle of a fixture, wherein the handle lock assembly prevents flushing if a release key has not been inserted into the assembly. Thus, the handle lock assembly provides for control over when flushing occurs, and provides for the reduction in the number of flushes for a particular installation over a period of time.

A fixture drain trap insert 300 may further be installed in the drain of a urinal to provide a dry trap so that liquid (i.e., water and urine) may drain from the fixture without requiring additional rinsing or flushing liquid. An adjustable urinal screen system 810 may be used with or without a fixture drain trap insert 300 to conceal and prevent blockage of fixture drain insert 300 or other drain assembly.

In the embodiments described above, fixture system 500 may include only handle lock assembly 100, only fixture drain insert 300, or only urinal screen system 810. However, in further exemplary embodiments, fixture system 500 may include two or all three of handle lock assembly 100, only fixture drain insert 300, and only urinal screen system 810. For example, in some exemplary embodiments, fixture system 500 comprises handle lock assembly 100 and fixture drain insert 300. In further exemplary embodiments, fixture system 500 comprises handle lock assembly 100 and urinal screen system 810. In still further exemplary embodiments, fixture system 500 comprises urinal screen system 810 and fixture drain insert 300. Further exemplary embodiments of fixture system 500 and the components of fixture system 500 are as follows:

Handle Lock Assembly

A handle lock assembly configured for placement on a handle of a urinal or toilet, the handle lock assembly comprising a top component having an arcuate inner surface and first and second ends, and a bottom component comprising first and second arm sections and a center support section situated there between, each of said sections having an arcuate inner surface and first and second ends, each of the first ends being pivotally connected to the first end of the top component, the second end of the center support section being rigidly connected to the second end of the top component, and each of the second ends of the arm sections comprising a locking element for releasably locking with a mating locking element on the second end of the top component. The second end of the top component has two spaced apart apertures, each aperture configured for releasably engaging a lock spring. The locking elements of the arm sections comprise a lock spring are configured for insertion into and releasable engagement within the aperture in the second end of the top component. A release key is configured for insertion into the apertures in the top component to disengage the lock spring. The handle lock assembly further comprises one or more shims sized for placement in contact with the inner surface of an arm section. The handle lock assembly can be secured to a right or left handle installation.

A handle lock assembly configured for placement on a handle of a urinal, the handle lock assembly comprising a top component having an arcuate inner surface and first and second ends, the second end having two spaced apart apertures, each aperture configured for releasably engaging a lock spring therein and a bottom component comprising first and second arm sections and a center support section situated there between, each of said sections having an arcuate inner surface and first and second ends, each of the first ends being pivotally affixed to the first end of the top component, the second end of the center support section being rigidly affixed to the second end of the top component, and each of the second ends of the arm sections comprising a lock spring configured for insertion into and releasable engagement within one of the apertures in the top component. A release key is configured for insertion into the apertures in the top component to disengage the lock spring. The handle lock assembly further comprises one or more shims sized for placement in contact with the inner surface of an arm section. The handle lock assembly can be secured to a right or left handle installation.

A urinal or toilet comprising a flush valve having a body with a handle projecting from the body, the handle having a first end attached to the flush valve body and a second end distal from the flush valve body; the handle being moveable from a seated position to an unseated position to flush the urinal or toilet; and a handle lock assembly mounted onto and encircling the handle, the handle lock assembly comprising a top component and a bottom component having an arcuate inner surface, the bottom component comprising first and second arm sections and a center support section situated there between; the top component having a first end pivotally connected to first ends of each of the sections of the bottom component, and a second end; the center support section having a second end rigidly connected to the second end of the top component, the first and second arm sections having second ends comprising a locking element releasably locked with a mating locking element on the second end of the top component; and the first arm section positioned proximal to the first end of the handle; wherein when the locking element of the first arm section is locked with the mating locking element on the top component, the handle cannot be moved from the seated position, and when the locking element of the first arm section is unlocked and the first arm section is pivoted downwardly, the handle is moveable from the seated to the unseated position. The second end of the top component has two spaced apart apertures, each aperture configured for releasably engaging a lock spring. The handle lock assembly further comprises a release key configured for insertion into the apertures in the top component to disengage the lock spring. The urinal or toilet further comprises one or more shims sized for placement in contact with the inner surface of an arm section. The handle lock assembly can be secured to a right or left handle installation.

A flush actuator lock assembly configured for placement on a flush actuator of a fixture, the actuator lock assembly comprising a top component having a first end, a second end, and a key receiving aperture, and a bottom component comprising at least one arm section pivotally connected to the first end of the top component and a locking element for releasably locking with a mating locking element on the second end of the top component wherein a key structure inserted into the key receiving aperture disengages the locking elements of the top component and the arm, allowing the arm to pivot.

Fixture Drain Insert and Trap Assembly

A fixture drain insert trap assembly comprising a material module support comprising a bottom surface with a securing component; at least one of a trap housing or trap cover comprising an upper surface with a securing component corresponding to the securing component of the material support module, wherein the trap housing or trap cover further includes a plurality of drain apertures, an inner diameter with an external surface, and an interlocking structure on the external surface of the inner diameter; a valve; a gasket; and a cylindrical housing support comprising a cylindrical body with an open top end, the open top end comprising an interlocking structure and an inner lip on the inner surface of the open top end, wherein the interlocking structure corresponds to and mates with the interlocking structure of the trap housing or trap cover. The trap housing has a sloped upper surface. The gasket is secured around the trap housing. The assembly further comprises a drain mounting component with an interlocking member. The trap housing comprises an interlocking member corresponding to and configured to matingly engage the interlocking member of the drain mounting component. The trap cover may be used with a drain cover skirt and have a plurality of legs. The gasket is secured to the cylindrical housing support and include a plurality of concentric rings and drain apertures. The valve may be an elastomer trap comprising an open top end and at least two flaps. The valve is selected from the group consisting of an elastomer trap, a bulb valve, a ball valve, and a two-inch code valve. The securing component of the material module is a threaded female member and the securing component of the upper surface of trap housing or trap cover is a threaded male member. The interlocking component of the cylindrical housing support and trap housing or trap cover is a plurality of protuberances together forming a bayonet mount.

A fixture drain trap insert assembly comprising a material support module comprising a cover and a bottom configured to secure together to house a material selected from the group consisting of a fragrance material, an enzyme material, a bacteria material, a cleaning material, and combinations thereof, and a female securing component on the bottom surface of the bottom; a trap housing comprising a sloped upper surface containing a plurality of drain apertures and a central male securing component corresponding to the female securing component of the material support module, an inner diameter containing a plurality of interlocking L-shaped protuberances on an outer surface of the inner diameter, and a plurality of interlocking structures around an outer surface of the housing, a housing support comprising an open end containing an inner lip and a plurality of protuberances on an inner surface of the open end, wherein the plurality of pin protuberances correspond to the plurality of interlocking L-shaped protuberances on the inner diameter of the trap housing, wherein the L-shaped protuberances of the inner diameter and the pin protuberances of the housing support are configured to matingly join as a bayonet mount, and a cylindrical body; a valve secured between the housing support and the trap housing and projecting to the housing support; and a drain mounting component comprising a plurality of interlocking structures corresponding to the interlocking structures around the outer surface of the housing. The valve is selected from the group consisting of an elastomer valve comprising at least two flexible flaps, a ball valve, a bulb valve, a two-inch code valve, a J-trap, and an S-trap.

A fixture drain trap insert assembly comprising a material support module comprising a cover and a bottom configured to secure together to house a material selected from the group consisting of a fragrance material, an enzyme material, a bacteria material, a cleaning material, and combinations thereof, and a female securing component on the bottom surface of the bottom; a trap cover comprising a sloped upper surface containing a plurality of drain apertures and a central male securing component corresponding to the female securing component of the material support module, an inner diameter containing a plurality of interlocking L-shaped protuberances on an outer surface of the inner diameter, and a plurality of legs; a housing support comprising an open end containing an inner lip and a plurality of protuberances on an inner surface of the open end, wherein the plurality of pin protuberances correspond to the plurality of interlocking L-shaped protuberances on the inner diameter of the trap housing, wherein the L-shaped protuberances of the inner diameter and the pin protuberances of the housing support are configured to matingly join as a bayonet mount, and a ridge; a drain cover skirt secured between the housing support component and the trap cover; a valve secured between the housing support and the trap cover and projecting into the housing support; and a gasket secured in the ridge of the housing support component. The valve is selected from the group consisting of an elastomer valve comprising at least two flexible flaps, a ball valve, a bulb valve, a two-inch code valve, a J-trap, and an S-trap.

Adjustable Fixture Screen System

An adjustable fixture screen, comprising a flexible screen comprising a center portion and a contiguous outer portion encircling the center portion, the outer portion being separated into one or more elongated strips extending outwardly from the center portion, and the center portion having a center hole extending therethrough; wherein when positioned on a surface of a fixture, the screen is substantially conformable to the fixture surface. The fixture surface is flat and the screen positioned on the fixture surface is in a substantially flat configuration. The fixture surface has a variable contour and the screen is substantially conformable to the fixture surface. The center portion of the screen can be elevated such that the screen is in a mound-like configuration while still in physical contact with a fixture surface to prevent debris from entering trap from any angle. The screen positioned over a fixture drain is operable to prevent passage of debris therethrough into the drain. The one or more elongated strips may extend outwardly from the center portion in a spiral configuration. The one or more elongated strips may extend radially outward from and in a perpendicular orientation to the center portion. The one or more elongated strips may extend outward from the center portion in a zigzag configuration. The one or more elongated strips in the zigzagged pattern comprise a plurality of bent arm portions connected together at an angle. The one or more elongated strips may comprise a surface with multiple protrusions extending therefrom. The module contains a material containing a cleaning agent, fragrance or a combination thereof. The material may be a block, gel or liquid.

The adjustable urinal screen may also comprise a fastening element inserted through the center hole of the screen; and a module for containing a cleaner or fragrance material, the module connected to the fastening element and positioned over the center portion of the screen, wherein the fastening element comprises external threads and the module comprises internal threads, and the fastening element and the module are connected in a threaded engagement. The fixture screen may further comprise an adjustable support stand, wherein the screen is situated over the adjustable support stand in a domed configuration. The fixture screen is attached to the support stand by a fastening element inserted through the center hole of the screen. The fixture screen may further comprise a module for containing a cleaner or fragrance block, connected to the fastening element and positioned over the center portion of the screen.

An adjustable fixture screen assembly, comprising a flexible screen comprising a center portion and a contiguous outer portion encircling the center portion, the outer portion being separated into one or more elongated strips extending outwardly from the center portion, and the center portion having a center hole extending therethrough; and at least one of: a) a fastening element sized for insertion through the center hole of the screen; b) an arched support stand sized for placement of the screen thereover in a domed configuration; and c) a module for containing a cleaner or fragrance block, configured for attachment to the flexible screen. The outer portion comprises a plurality of elongate strips extending radially outwardly from the center portion.

It is specifically intended that the present disclosure not be limited to the embodiments and illustrations contained herein, but include modified forms of those embodiments including portions of the embodiments and combinations of elements of different embodiments as come within the scope of the following claim.

We claim:

1. A fixture system comprising:

a handle lock assembly configured for placement on a handle of a fixture, the handle lock assembly comprising (A) a top component having an arcuate inner surface and first and second ends, and (B) a bottom components comprising first and second arm sections and a center support section situated there between, each of said sections having an arcuate inner surface and first and second ends, wherein each of the first ends is pivotally connected to the first end of the top component, the second end of the center support section is rigidly connected to the second end of the top component, and each of the second ends of the arm sections comprises a locking element for releasably locking with a mating locking element on the second end of the top component; and an adjustable fixture screen comprising a flexible screen with a center portion and a contiguous outer portion encircling the center portion and having an outer edge, wherein the outer edge is configured to form a continuous seal with a fixture surface and the screen is substantially conformable to the fixture surface.

2. The fixture system of claim 1 wherein the center portion of the screen is elevated such that the screen is in a mound-like configuration while still in physical contact with the fixture surface to prevent debris from entering the fixture drain insert from any angle.

3. The fixture system of claim 1 further comprising one or more shims configured to adapt the handle lock assembly to any size fixture handle.

4. The fixture system of claim 1, further comprising at least one material selected from the group consisting of a fragrance, a cleaning agent, an enzyme, a bacteria material and combinations thereof, and wherein the at least one material is in a form selected from the group consisting of a block, a gel, a liquid and combinations thereof, and wherein the at least one material is secured to the fixture screen.

5. The fixture system of claim 1, further comprising an adjustable support stand, wherein the screen is situated over the adjustable support stand in a domed configuration.

6. The fixture system of claim 1 wherein the outer portion of the adjustable fixture screen is separated into one or more elongated strips extending outwardly from the center portion.

7. The fixture system of claim 6, wherein the one or more elongated strips extend radially outward from and in a perpendicular orientation to the center portion.

8. The fixture system of claim 1 comprising a fixture drain insert assembly configured to insert into and secure to a fixture drain comprising a trap.

9. The fixture system of claim 8 wherein the fixture drain insert comprises a trap housing comprising a sloped upper surface containing a plurality of drain apertures and a plurality of interlocking structures, a trap, and a drain mounting component configured to secure within a fixture drain and comprising a plurality of interlocking structures corresponding to and configured to matingly engage the interlocking structures of the trap house to secure the trap housing to the fixture drain.

10. The fixture system of claim 8 wherein the drain insert comprises a trap cover with a sloped upper surface containing a plurality of drain apertures and an inner diameter containing a plurality of interlocking protuberances on an outer surface of the inner diameter, a drain cover skirt secured between the housing support component and the trap cover;

a housing support containing a plurality of interlocking structures configured to engage the interlocking protuberances of the trap cover and secure housing support to trap cover, thereby confining the drain cover skirt between the trap cover and the housing support;

a trap, and a gasket, wherein the gasket is secured to the housing support configured to insert into an existing fixture drain and secure the drain insert assembly in the existing fixture drain.

11. The fixture system of claim 8 further comprising at least one material selected from the group consisting of a fragrance, a cleaning agent, an enzyme, a bacteria material and combinations thereof.

12. The fixture system of claim 11 wherein the material is selected from the group consisting of a block, a gel, a liquid, and combinations thereof.

13. The fixture system of claim 11 wherein the material is secured to at least one of the fixture drain insert assembly and the fixture screen.

14. A fixture comprising:

a flush valve having a body with a flush actuator, the flush actuator being moveable from a first position to a second position to flush the fixture;

a handle lock assembly mounted onto the flush actuator comprising (A) a top component having an arcuate inner surface and first and second ends, and (B) a bottom component comprising first and second arm sections and a center support section situated there between, each of said sections having an arcuate inner surface and first and second ends, wherein each of the first ends being pivotally connected to the first end of the top component, the second end of the center support section being rigidly connected to the second end of the top component, and each of the second ends of the arm sections comprising a locking element for releasably locking with a mating locking element on the top component, wherein when the locking element is locked with the mating locking element on the top component, the actuator cannot be moved from the first position to the second position; and an adjustable fixture screen comprising a flexible screen with a center portion and a contiguous outer portion encircling the center portion and having an outer edge, wherein the outer edge is configured to form a continuous seal with a fixture surface and the screen is substantially conformable to the fixture surface.

15. The fixture of claim 14 wherein the handle lock assembly can be secured to a right or left handle installation.

16. The fixture of claim 14 wherein a key structure inserted into a key receiving aperture disengages the locking elements of the handle lock assembly, allowing the flush actuator to move from the first position to the second position to flush the fixture.

17. The fixture of claim 14 comprising a fixture drain inset assembly configured to insert into and secure to a fixture drain and comprising a trap.

18. The fixture of claim 17 wherein the fixture drain insert includes an adjustable gasket component, wherein the adjustable gasket component stabilizes the fixture drain insert in the fixture drain.

* * * * *